US007450882B2

(12) United States Patent
Shiraki

(10) Patent No.: US 7,450,882 B2
(45) Date of Patent: Nov. 11, 2008

(54) ATTACHABLE/DETACHABLE GUIDING MEMBER, DEVELOPER CARTRIDGE INCLUDING ATTACHABLE/DETACHABLE GUIDING MEMBER AND PROCESS CARTRIDGE INCLUDING ATTACHABLE/DETACHABLE GUIDING MEMBER

(75) Inventor: Masatoshi Shiraki, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 265 days.

(21) Appl. No.: 11/196,688

(22) Filed: Aug. 4, 2005

(65) Prior Publication Data

US 2006/0029419 A1 Feb. 9, 2006

(30) Foreign Application Priority Data

| | | |
|---|---|---|
| Aug. 6, 2004 | (JP) | 2004-231201 |
| Aug. 6, 2004 | (JP) | 2004-231202 |
| Oct. 20, 2004 | (JP) | 2004-305551 |
| Oct. 20, 2004 | (JP) | 2004-305552 |
| Dec. 27, 2004 | (JP) | 2004-375936 |
| Dec. 27, 2004 | (JP) | 2004-377284 |
| Dec. 27, 2004 | (JP) | 2004-377285 |

(51) Int. Cl.
*G03G 21/16* (2006.01)

(52) U.S. Cl. ..... 399/111

(58) Field of Classification Search ..... 399/111, 399/124

See application file for complete search history.

(56) References Cited

U.S. PATENT DOCUMENTS 5,784,671 A * 7/1998 Damji et al. ..... 399/110
5,903,803 A 5/1999 Kawai et al.
5,923,926 A 7/1999 Isobe et al.
6,041,203 A 3/2000 Suzuki et al.
6,128,454 A 10/2000 Kawai et al.
6,169,865 B1 1/2001 Miyabe et al.
6,175,706 B1 1/2001 Watanabe et al.
6,185,390 B1 2/2001 Higeta et al.
6,226,476 B1 5/2001 Miyabe et al.
6,226,478 B1 5/2001 Watanabe et al.
6,240,266 B1 5/2001 Watanabe et al.

(Continued)

FOREIGN PATENT DOCUMENTS

CN 1746780 3/2006

(Continued)

*Primary Examiner*—David M Gray
*Assistant Examiner*—Bryan Ready
(74) *Attorney, Agent, or Firm*—Oliff & Berridge PLC

(57) ABSTRACT

A developer cartridge that is attachable to and detachable from a photosensitive drum cartridge and includes a frame, a developer housing section, a developer supplying section, and a guide member is provided. The frame includes a first side wall and a second side wall, and the first side wall and the second side wall extend substantially in a length direction. The developer housing section, for housing a developer, extends from the first side wall to the second side wall in a width direction perpendicular to the length direction. The developer supplying section, for supplying the developer to a photosensitive member, extends from the first side wall to the second side wall in the width direction. The guide member is provided over an outer surface of the developer supplying section, and the guide member being detachable from the developer supplying section. The developer supplying section is formed from a first material, the guide member is formed from a second material, and the first material is different from the second material.

24 Claims, 49 Drawing Sheets

U.S. PATENT DOCUMENTS

| | | | |
|---|---|---|---|
| 6,330,410 | B1 | 12/2001 | Okabe et al. |
| 6,343,192 | B1 | 1/2002 | Miyabe et al. |
| 6,349,188 | B1 | 2/2002 | Kawai et al. |
| 6,400,914 | B1 | 6/2002 | Noda et al. |
| 6,411,789 | B1 | 6/2002 | Okabe et al. |
| 6,501,926 | B1 | 12/2002 | Watanabe et al. |
| 6,501,927 | B1 | 12/2002 | Watanabe et al. |
| 6,546,217 | B2 | 4/2003 | Okabe et al. |
| 6,690,903 | B2 | 2/2004 | Okabe et al. |
| 7,280,784 | B2 | 10/2007 | Manabe |
| 2002/0018666 | A1 | 2/2002 | Noda et al. |
| 2003/0185594 | A1 | 10/2003 | Okabe |
| 2004/0086300 | A1 | 5/2004 | Kawai et al. |
| 2004/0126132 | A1 | 7/2004 | Okabe et al. |

FOREIGN PATENT DOCUMENTS

| | | |
|---|---|---|
| JP | A 09-26737 | 1/1997 |
| JP | A 09-43925 | 2/1997 |
| JP | A 09-43927 | 2/1997 |
| JP | A 10-153912 | 6/1998 |
| JP | A 10-240103 | 9/1998 |
| JP | A 11-161131 | 6/1999 |
| JP | A 11-167335 | 6/1999 |
| JP | A 2000-112200 | 4/2000 |
| JP | A 2000-267547 | 9/2000 |
| JP | A 2000-280519 | 10/2000 |
| JP | A 2003-295614 | 10/2003 |

* cited by examiner

28

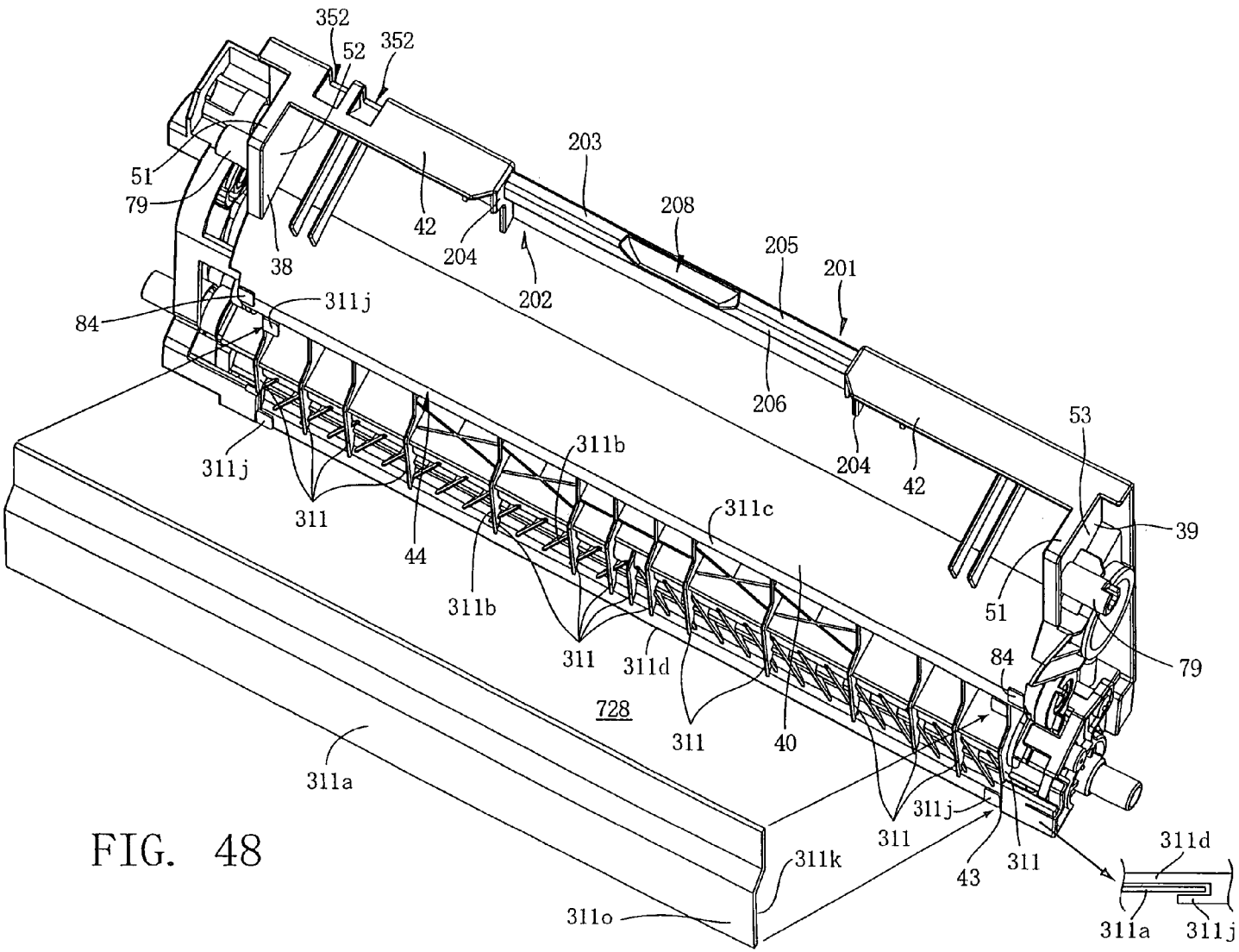
39
79
53
51
84
42
204
201
205
206
208
203
202
204
42
352
52
352
38
51
79
84
311j
311j
311
311
311

ATTACHABLE/DETACHABLE GUIDING MEMBER, DEVELOPER CARTRIDGE INCLUDING ATTACHABLE/DETACHABLE GUIDING MEMBER AND PROCESS CARTRIDGE INCLUDING ATTACHABLE/DETACHABLE GUIDING MEMBER

CROSS-REFERENCE TO RELATED APPLICATIONS

This application claims priority from Japanese Patent Application Nos. 2004-231201 and 2004-231202, filed Aug. 6, 2004, Japanese Patent Application Nos. 2004-305551 and 2004-305552, filed on Oct. 20, 2004, and Japanese Patent Application Nos. 2004-377284, 2004-377285 and 2004-375936, filed Dec. 27, 2004, the disclosures of are incorporated herein by reference in their entireties.

BACKGROUND

The invention relates to an attachable/detachable process cartridge, an attachable/detachable drum cartridge, an attachable/detachable developer cartridge, and an image forming device capable of employing an attachable/detachable process cartridge, an attachable/detachable drum cartridge, and/or an attachable/detachable developer cartridge.

Electrostatographic image forming devices may include an optical system, a photosensitive device (e.g., a photosensitive drum), a charging device arranged in the vicinity of the photosensitive device, a developer device (e.g., developer roller), a transfer device (e.g., transfer roller), and a cleaning means. In general, electrostatographic image forming devices record images by forming an electrostatic latent image on a photosensitive device, forming a developer image by supplying developer to the formed electrostatic latent image on the photosensitive device, and transferring the developer image onto a recording medium. More particularly, for example, to form an image on a recording medium, the surface of the photosensitive drum is uniformly charged by the charging device before the surface is irradiated with a laser beam so as to form an electrostatic latent image corresponding to the image to be formed on the photosensitive drum. The latent image is then developed using a developer supplied by the developer roller such that a developer image is formed on the photosensitive drum. The developer image is then transferred to the recording medium by the transfer roller. After the visible image is transferred most, and preferably all, of any toner remaining on the photosensitive body is removed by the cleaning means.

In many of these image formation devices, many of the image forming components, such as, the photosensitive device, the charging device, the developer roller, the transfer roller and/or the cleaning means are provided, for example, in a process cartridge that is attachable to/detachable from the image forming device. Examples of such a process cartridge are disclosed in, for example, U.S. Pat. Nos. 6,041,203 and 6,546,217. Such process cartridges may be employed to facilitate, for example, replacement and/or maintenance operations of one or more of the components included in the process cartridge.

With such process cartridges, the photosensitive device and the developer roller may be attached to/detached from each other. Thus, it is possible to replace, for example, the developer roller independently of the photosensitive device. As a result, the burden on the environment can also be reduced because a usable photosensitive device cartridge need not be discarded in order to replace a deteriorated developer roller.

Recently, there has been an increased desire to recycle components used in printing devices in order to reduce the amount of environmentally harmful waste. For example, developer cartridges are made such that they can be refilled with toner in order to increase the lifetime of the developer cartridge. As the lifetime of developer cartridges may be increased by providing refillable developer cartridges, however, other components of the developer cartridge are more susceptible to wear and damage.

For example, developer cartridges may include paper guiding members that help transport the paper through an image forming device. Such paper guiding members may be molded as part of a process cartridge and may be susceptible to wear and damage from repeated contact with paper during printing. If the paper guiding member is damaged, paper may get jammed and/or damaged within the image forming device and the image forming process may be interrupted and/or the quality of the formed image may be reduced.

SUMMARY

In various exemplary embodiments, a developer cartridge that is attachable to and detachable from a photosensitive drum cartridge and includes a frame, a developer housing section, a developer supplying section, and a guide member is provided. The frame includes a first side wall and a second side wall, and the first side wall and the second side wall extend substantially in a length direction. The developer housing section, for housing a developer, extends from the first side wall to the second side wall in a width direction perpendicular to the length direction. The developer supplying section, for supplying the developer to a photosensitive member, extends from the first side wall to the second side wall in the width direction. The guide member is provided over an outer surface of the developer supplying section, and the guide member being detachable from the developer supplying section. The developer supplying section is formed from a first material, the guide member is formed from a second material, and the first material is different from the second material.

In various exemplary embodiments, a developer cartridge that is attachable to and detachable from a photosensitive drum cartridge useable in an image forming device is provided. The developer cartridge includes a frame and a guide member. The frame defines at least a developer supplying section and a developer housing section. The guide member is attached to the frame at a location on the frame where a recording sheet is conveyed in contact with the developer cartridge during printing, the guide member being detachable from the frame. The frame is formed from a first material, the guide member is formed from a second material, and the first material is different from the second material.

In various exemplary embodiments, a process cartridge for use with an image forming device is provided. The process cartridge includes a frame and a guide member. The frame defines at least a developer housing section, a developer supplying section, a photosensitive member housing section, and a developer cartridge receiving section. The guide member is attached to the frame at a location on the frame where a recording sheet is conveyed in contact with the process cartridge during printing. The guide member is detachable from the frame. The frame is formed from a first material, the guide member is formed from a second material, and the first material is different from the second material. When the guide member is detachably attached to the frame, the guide member faces a portion of the developer cartridge receiving section of the frame.

In various exemplary embodiments, a recording medium guiding member for attachment to a developer cartridge that is attachable to and detachable from a photosensitive drum cartridge useable in an image forming device is provided. The guiding member includes a first surface for attachment to the developer cartridge and a second surface for guiding a recording medium during printing. The first surface extends from a first end of the guiding member to a second end of the guiding member. The second surface extends from the first end to the second end. The first surface is substantially opposite from the second surface. The guiding member is provided with a plurality of projecting members that extend away from at least one of the first surface or the second surface. The guiding member has at least one of a stepped or a wavy cross-sectional shape in a cross-section including the first surface, the second surface, the first end and the second end.

These and other optional features and possible advantages of various aspects of this invention are described in, or are apparent from, the following detailed description of exemplary embodiments of systems and methods which implement the various aspects of the invention.

BRIEF DESCRIPTION OF THE DRAWINGS

Exemplary embodiments of the invention will be described in detail with reference to the following figures, wherein:

FIG. 23(*a*) is a cross sectional view, FIG. 23(*b*) is a perspective view, and FIG. 23(*c*) is a perspective view;

FIG. 48 is a front-bottom-right perspective view of the developer cartridge shown in FIG. 31 with an exemplary engaging member for attaching the guiding film shown in FIG. 43;

DETAILED DESCRIPTION OF EMBODIMENTS

Throughout the following description, numerous specific structures are set forth in order to provide a thorough understanding of one or more aspects of the invention. The various aspects of the invention can be practiced without utilizing all of these specific structures. In other instances, well known elements have not been shown or described in detail, so that emphasis can be focused on the various aspects of the invention.

To form an image, some image forming devices such as laser printers and copiers, charge a surface of the photosensitive device (e.g., the photosensitive drum) with a charging device (e.g., a corona charger) before irradiating the photosensitive drum with a laser beam to form an electrostatic latent image, corresponding to the image to be formed, on the photosensitive drum. The formed latent image is then developed using a developing agent (e.g., toner) supplied by a developer carrying device (e.g., developer roller). The formed developer image is then transferred to a recording medium (e.g., paper) by a transfer device (e.g., transfer roller). The transferred developer image is then subjected to heat and/or pressure by a fixing device.

For ease of discussion, in the following description of the exemplary embodiments of one or more aspects of the invention, the side of the laser printer 1 on which a front cover 7 is arranged will be referred to as the "front" or "front side" and the side substantially opposite the side on which the front cover 7 is arranged will be referred to as the "back" or "back side". With regard to various individual objects of the laser printer 1 and/or process cartridge 20, sides of the individual objects will be similarly identified based on the arranged/attached position of the object on/in the laser printer 1. Further, a side will be considered to be the "left side" if, while the object is arranged in the laser printer 1, the side is on the left side when viewing the object from the front of the laser printer 1, and a side will be considered to be the "right side" if, while the object is arranged in the laser printer 1, the side is on the right side when viewing the object from the front of the laser printer 1.

Figure 1:
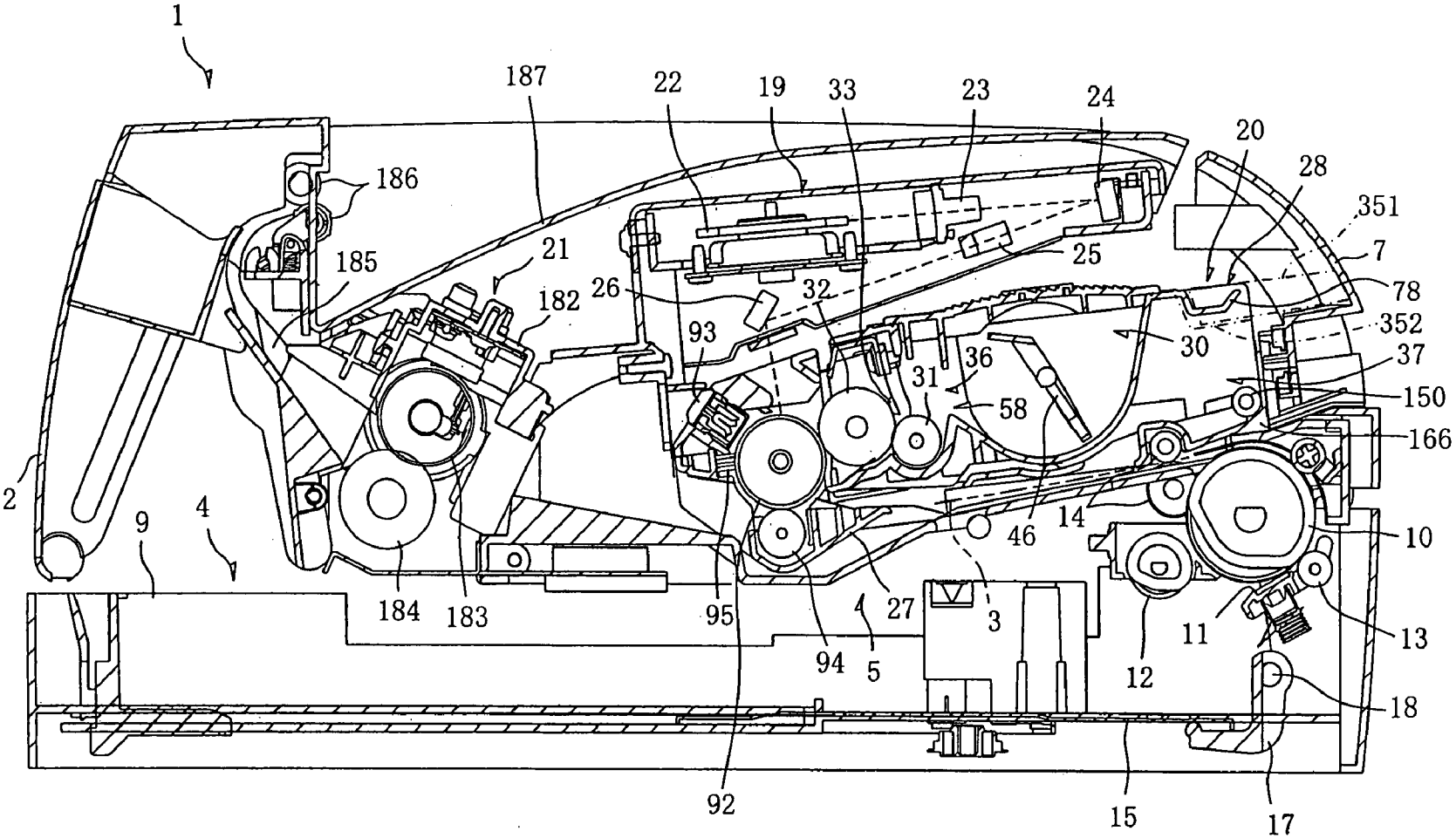
FIG. 1 is a cross-sectional view of an exemplary image forming device with a closed front cover including an exemplary process cartridge.

Further, a side or portion will be considered to be the "top" or "upper" side if, while the object is arranged in the laser printer 1, the side or portion is on the top side or top portion when viewing the object from the front of the laser printer 1, as situated in FIG. 1. A side or portion will be considered to be the "bottom" or "lower" side if, while the object is arranged in the laser printer 1, the side is on the bottom side or lower portion when viewing the object from the front of the laser printer 1, as situated in FIG. 1. For example, a first reflective mirror 24 is located in the top or upper portion of the exemplary laser printer 1 and a sheet pressing member 15 is located in the bottom or lower portion of the exemplary laser printer 1.

In the following description, an object's width or a width direction refers to a direction or axis extending from substantially the right side to substantially the left side or from substantially the left side to substantially the right side, and an object's length or a length direction refers to a direction or axis extending from substantially the front side to substantially the back side or from substantially the back side to substantially the front side. Therefore, in the following description, for example, an object's width may be longer than the object's length, while another object's width may be shorter than that object's length. Further, in the following description, an object's height or a thickness direction refers to a direction or axis extending from substantially the bottom side to substantially the top side, or visa versa. Also, in the following description, while a device may be referred to as roller, the device is not limited to a roller, the device may, for example, be in the form of a conveyer belt.

Further, while features may be described as being to the "left", "right", "back", "front" etc., in no way is it intended for the features to be limited to that arrangement. One skilled in the art would understand that position/arrangement of the various features may be different from the position/arrangement of those features described herein. Also, in the following description when something is referred to as "substantially Z", it is intended to include "exactly Z" and "about Z". With regard to specific distances or sizes, in the following description, "is Y mm", for example, includes "exactly Y mm" and "about Y mm", unless specified otherwise.

Figure 2:
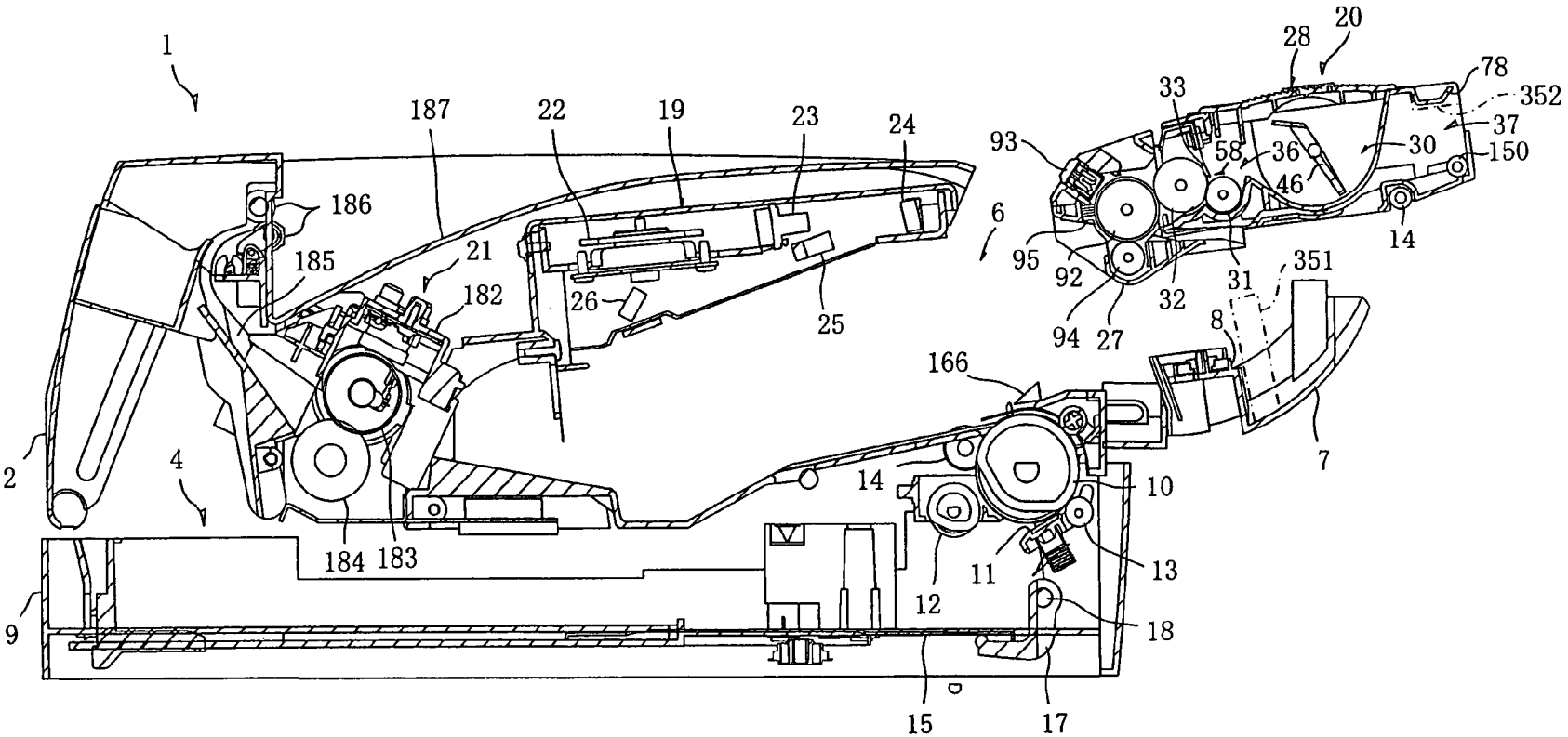
FIG. 2 is a cross-sectional view of the image forming device shown in FIG. 1, with an opened front cover.

FIGS. 1 and 2 illustrate cross-sectional views, along the length direction, of an exemplary laser printer 1, as an exemplary image forming device. The laser printer 1 includes a main casing 2, a feeding section 4 for feeding a sheet 3, as a recording medium, and an image forming section 5 for forming an image on the fed sheet 3.

The main casing 2 has an attachment/detachment cavity 6 and the front cover 7. The attachment/detachment cavity 6 houses an attachable/detachable process cartridge 20. The process cartridge 20 can be loaded into and unloaded from the attachment/detachment cavity 6 by way of the front cover 7 in order to be attached to and detached from the main casing 2.

The front cover 7 is, for example, rotatably supported by a shaft (not shown) in the main casing 2 such that the front cover 7 may be rotated to allow access to the attachment/detachment cavity 6 or to cover the attachment/detachment cavity 6. In the exemplary laser printer 1, the shaft is provided at a lower end portion of the front cover 7. The front cover 7 may, of course, be attachable/detachable in any suitable manner to allow for the loading/unloading or attachment/detachment of the process cartridge 20.

The front cover 7 may include projecting portions 351 for reducing, and preferably preventing, a possibility of an incorrect replacement cartridge (e.g., process cartridge) from being installed. The projecting portions 351 project towards the inside of the laser printer 1 when the front cover 7 is closed/attached and the projecting portions project into receiving portions 352 (FIG. 5) of the exemplary process cartridge 20 when the process cartridge 20 is attached to the laser printer 1. When the front cover 7 is opened/detached, the projecting portions 351 do not occupy the receiving portions 352.

In environments, such as offices, different types of image forming devices may be employed and thus, many different types of replacement cartridges may be available. Thus, a user may inadvertently install a replacement cartridge for another type of printer.

By providing projecting portions 351 that project into receiving portions 352 of the process cartridge 20 when the front cover 7 is closed, if a process cartridge of a similar size/shape, but without the receiving portions 352, is installed, when the user attempts to close the front cover 7, the projecting portions 351 may prevent the front cover 7 from closing properly. The user will then know that an incorrect process cartridge was placed in the laser printer 1 before attempting to print an image.

Thus, in embodiments including such projecting portions 351 and receiving portions 352, the front cover 7 may not close if an incorrect process cartridge is installed/arranged because the incorrect process cartridge may not have corresponding receiving portions 352 for receiving the projecting portions 351. Although two receiving portions 352 and two projecting portions 351 are illustrated, in some embodiments, no receiving portions 352 or projecting portions 351 may be provided, while in some embodiments, more than two receiving portions 352 or projecting portions 351 may be provided.

Further, in some embodiments, the projecting portions 351 may be provided on the process cartridge 20 and the receiving portions 352 may be provided on the main casing 2. In some embodiments, each of the main casing 2 and the process cartridge 20 may include both a projecting portion 351 and a receiving portion 352.

The feeding section 4 includes a sheet supply tray 9, a sheet supply roller 10, a separating pad 11, a pickup roller 12, a pinch roller 13, and a pair of resist rollers 14 (e.g., upper resist roller and lower resist roller).

The sheet supply tray 9 is attachable/detachable to/from, for example, a bottom portion of the main casing 2. The sheet supply roller 10 and the separating pad 11 may be arranged in a front end portion of laser printer 1 at a higher level than the sheet supply tray 9. The separating pad 11 presses against the sheet supply roller 10 by a force generated by a compression spring (not shown). The pickup roller 12 may be arranged close to a lower back portion of the sheet supply roller 10 and the pinch roller 13 may be arranged close to a lower front portion of the sheet supply roller 10.

The pickup roller 12 and the pinch roller 13 may be arranged substantially symmetrically about the sheet supply roller 10. The upper and lower resist rollers 14 may be arranged above the pickup roller 12. More particularly, the lower resist roller 14 may be arranged close to an upper back portion of the sheet supply roller 10 while the upper resist roller 14 may be arranged above the lower resist roller 14.

The sheet supply tray 9 includes a sheet pressing member 15 that can support a stack of sheets 3 arranged thereon. The sheet pressing member 15 may be in the form of a plate. One end of the sheet pressing member 15 may be supported by a bottom of the sheet supply tray 9 while the other end of the sheet pressing member 15 may move upward and downward, as necessary based on a height of the stack of sheets 3 arranged thereon.

The sheet pressing member 15 functions to press the stack of sheets 3 upward so that a top most sheet of the stack of sheets 3 is in compressive contact with the pickup roller 12 such that the top most sheet 3 can be picked-up by the pick up roller 12 and transported towards the sheet supply roller 10 and the separating pad 11.

In the exemplary laser printer 1 shown in FIGS. 1 and 2, a lever 17 is provided to lift and support the front end portion of the sheet pressing member 15. As shown in FIGS. 1 and 2, the lever 17 may be substantially L-shaped in cross-section and arranged at a front end portion of the sheet supply tray 9. When the stack of sheets 3 with a substantially maximum height is arranged on the sheet pressing member 15, a first arm of the lever 17 is substantially parallel with the sheet pressing member 15 while a second arm of the lever 17 is substantially perpendicular to the first arm. The maximum height of the stack of sheets 3 may be substantially equal to the distance between a lowermost point of the pickup roller 12 and an uppermost point of the sheet pressing member 15, when the sheet pressing member 15 is lying substantially flat (i.e., the front end and the back end of the sheet pressing member 15 are at substantially a same height from a bottom surface of the laser printer 1).

The upper-end-portion of the second arm of the lever 17 is, for example, rotatably supported by a lever shaft 18 that is provided at the front end portion of the sheet supply tray 9. When the sheet supply tray 9 is arranged in the main casing 2, a clockwise rotational driving force is applied to the lever shaft 18 such that as the height of the stack 3 on the sheet pressing member 15 and/or the pressure subjected to the stack of sheets 3 by the pickup roller 12 decreases, the lever 17 rotates in a clockwise direction about an axis of the lever shaft 18, and thereby lifts the front end portion of the sheet pressing member 15 and the stack of sheets 3 arranged on the sheet pressing member 15.

On the other hand, when the sheet supply tray 9 is detached from the main casing 2 or when the clockwise rotational drive force is not applied to the lever shaft 18, the front end portion of the sheet pressing member 15 is not urged upward by the lever 17. Thus, the front end of portion of the sheet pressing member 15 moves downward such that the sheet pressing member 15 lies substantially flat (i.e., the front end and the back end of the sheet pressing member 15 are at substantially a same height from the bottom surface of the laser printer 1). The sheet supply tray 9 may be filled with the sheets 3 by the user when the sheet supply tray 9 is detached from the main casing 2.

On the other hand, when the sheet supply tray 9 is attached to/arranged in the main casing 2, the clockwise rotational driving force is applied to the lever shaft 18 such that the front-end-portion of the sheet pressing member 15 is lifted by the lever 17 and the top most sheet 3 is pressed against the pickup roller 12. Rotation of the pickup roller 12 feeds the top most sheet 3 between the sheet supply roller 10 and the separating pad 11. By rotation of the sheet supply roller 10, the sheet 3 is sandwiched between the sheet supply roller 10 and the separating pad 11 and the sheet 3 is fed to the pinch roller 13.

By rotation of the sheet supply roller 10 and the pinch roller 13, the sheet 3 is pinched between the sheet supply roller 10 and the pinch roller 13 and the sheet 3 is then conveyed between the upper and lower resist rollers 14. The upper and lower resist rollers 14 help further convey the sheet 3 to a transfer position of the image forming section 5.

The transfer position is between a photosensitive element, such as a photosensitive drum 92, and a transfer element, such as a transfer roller 94. At the transfer position, a developer image carried by the photosensitive drum 92 is transferred, with the help of the transfer roller 94, to the sheet 3.

The image forming section 5 may include a scanner 19, the process cartridge 20 and a fixing portion 21.

The scanner 19 is provided in an upper portion of the main casing 2 and may include a laser light source (not shown), a rotatable polygonal mirror 22, an fθ lens 23, the first reflective mirror 24, a lens 25, and a second reflective mirror 26. The laser light source emits a laser beam, based on image data corresponding to an image to be formed, and the emitted laser beam is biased/deflected by the rotatable polygonal mirror 22.

As shown by the dashed lines in FIG. 1, the deflected laser beam passes through the fθ lens 23 before the optical path of the laser beam (dashed lines in FIG. 1) is bent by the first reflective mirror 24. From the first reflective mirror 24, the laser beam passes through the lens 25 before being bent once more by the second reflective mirror 26 such that the laser beam irradiates the surface of the photosensitive drum 92, when the process cartridge 20 is arranged in the main casing 2.

Figure 3:
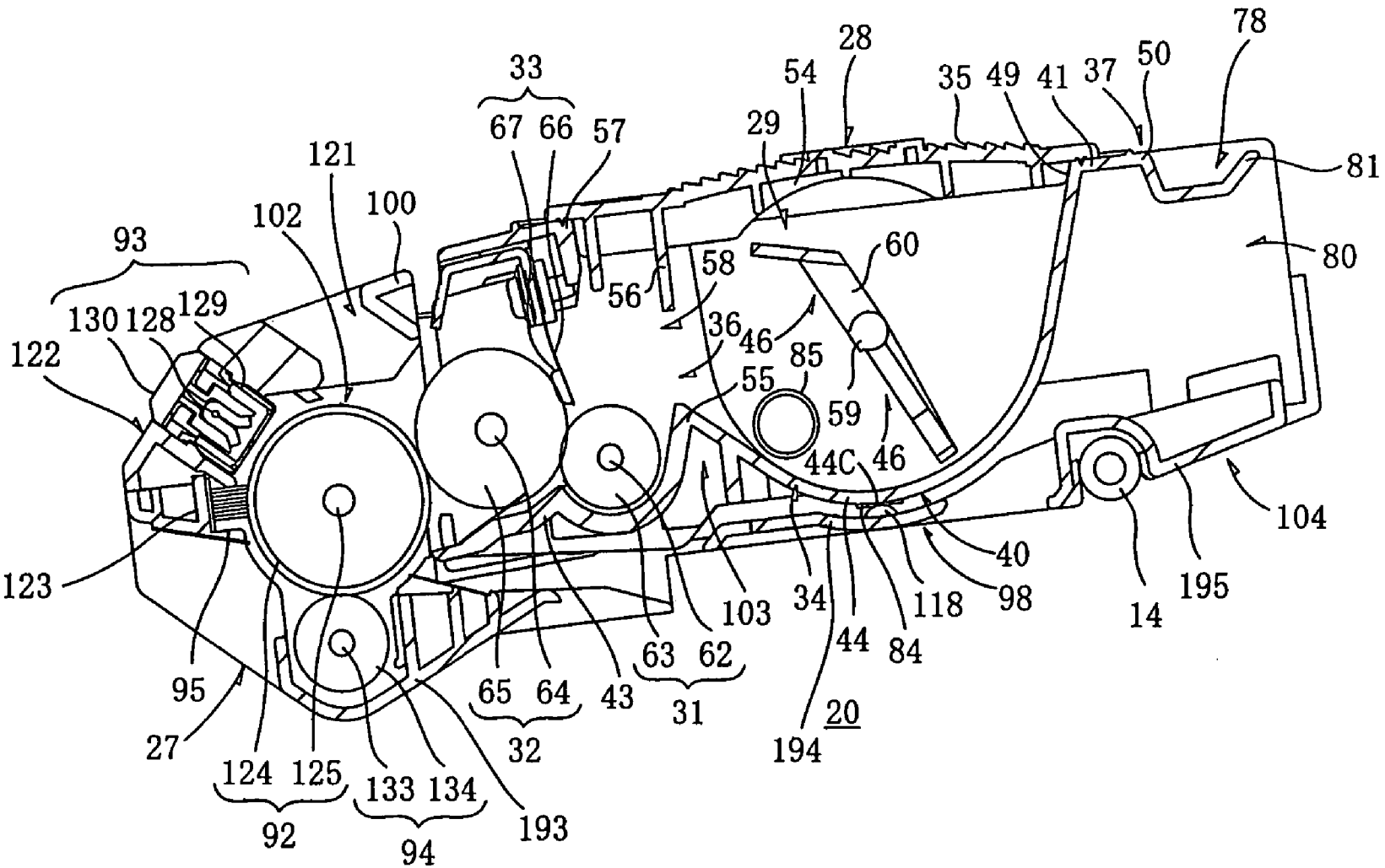
FIG. 3 is a cross-sectional view of the process cartridge shown in FIG. 1.

The process cartridge 20 can be attached and removed with respect to the main casing 2, as shown in FIG. 2. In some embodiments, portions of the process cartridge 20 may be independently mounted and removed from the main casing 2. As shown in FIG. 3, the process cartridge 20 may include an attachable/detachable drum cartridge 27, and an attachable/detachable developer cartridge 28. In various embodiments, the process cartridge 20 may be attachable to and detachable from the main casing 2 as a single unit (e.g., the developer cartridge 28 is attached to the drum cartridge 27) and/or portions of the process cartridge 20 (e.g., the developer cartridge 28, the drum cartridge 27) may be attached to/detached from the main casing 2 as independently attachable/detachable sub-units (e.g., the developer cartridge 28 being attachable to the drum cartridge 27 after the drum cartridge 27 is attached to the main casing 2, or the developer cartridge 28 being detachable from the drum cartridge 27 before the drum cartridge 27 is detached from the main casing 2).

In some embodiments, the developer cartridge 28 may be attached to or detached from the drum cartridge 27 while the drum cartridge 27 is attached to the main casing 2 and while the drum cartridge 27 is separate from the main casing 2.

In some embodiments, the developer cartridge 28 may be attached to or detached from the drum cartridge 27 only if at least a portion of the drum cartridge 27 is removed from the main casing 2.

In some embodiments, the developer cartridge 28 may only be attached to or detached from the drum cartridge 27 when the drum cartridge 27 is completely removed from the main casing 2, and thus, in such embodiments, the process cartridge 20 is always attached to and detached from the main casing 2, as a single unit.

Figure 4:
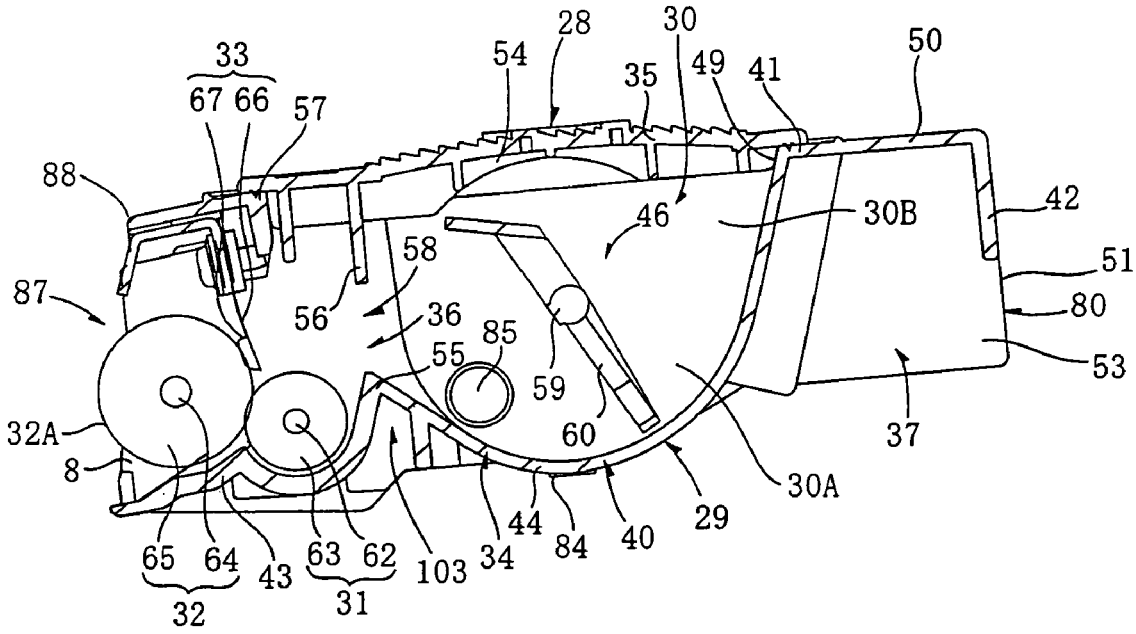
FIG. 4 is a cross-sectional view of an exemplary developer cartridge.

FIG. 4 is a cross-sectional view, along the length direction, of an exemplary embodiment of the developer cartridge 28. As shown in FIG. 4, the developer cartridge 28 includes a developer cartridge casing 29, as a first casing, a developer supply roller 31, a developer roller 32, as a developer carrying member, an agitator 46, and a thickness regulating member 33.

Figure 7:
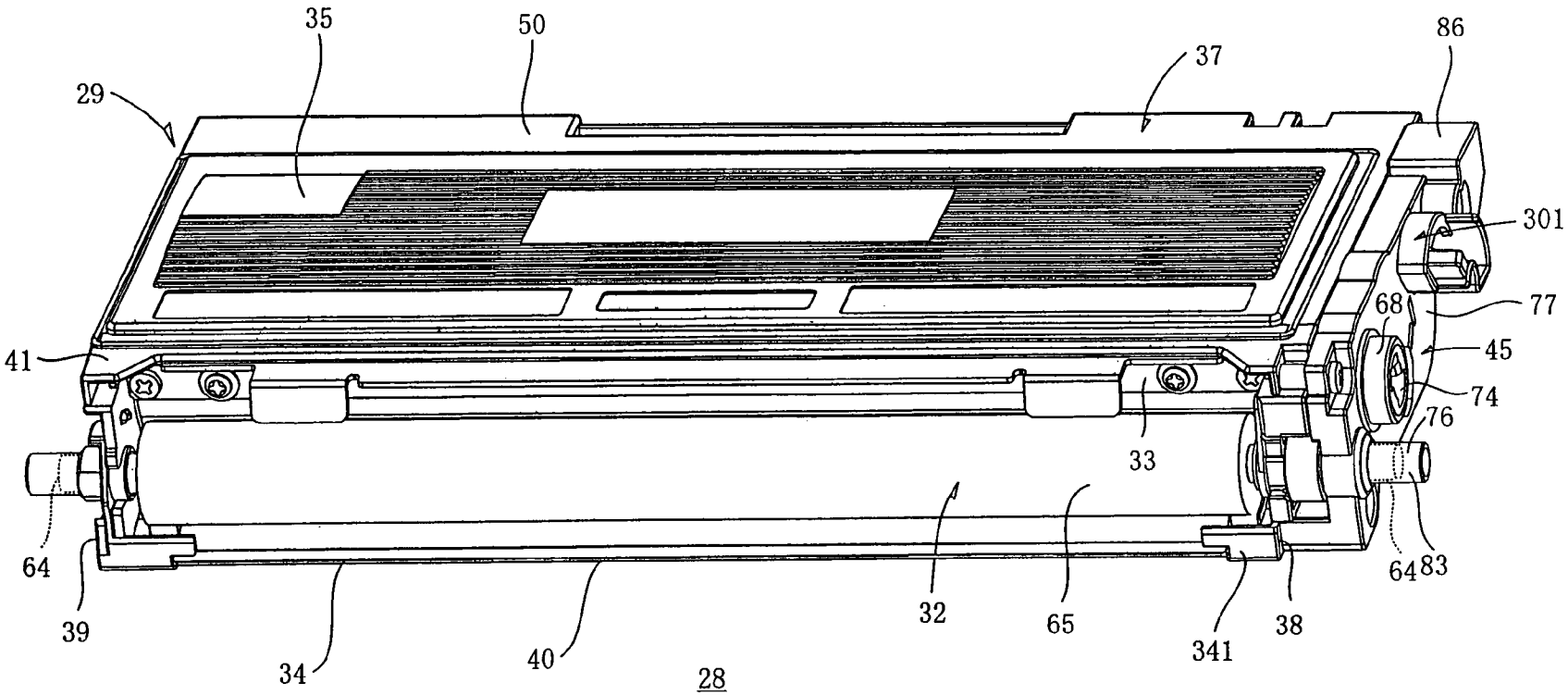
FIG. 7 is a back-top-left perspective view of the developer cartridge shown in FIG. 4.

The developer cartridge casing 29 may be formed of a resin material, such as, polystyrene and may have a generally box-like shape with an open side 8. As shown in FIGS. 4 and 7, the exemplary developer cartridge casing 29 has the open side 8 that exposes some of the components of the developer cartridge 28 that are arranged toward the back side of the developer cartridge 28. The open side 8 allows a portion 32A of the developer roller 32 to be exposed and accessible to the photosensitive drum 92 when the developer cartridge 28 is attached to the drum cartridge 27.

The developer cartridge casing 29 includes a developer housing section 30, a developer supplying section 36, and an upper extension section 37, as a first extension portion. The developer housing section 30 houses the developing agent, such as, toner therein.

The general shape of the developer cartridge casing 29 is defined by a lower frame 34 and an upper frame 35. As shown in FIGS. 4-10, the lower frame 34 includes as a single unit, a left side wall 38, a right side wall 39, a lower wall 40, an upper wall 41, and an upper front side wall 42, an upper wall extension 50, a left side wall extension 52 and a right side wall extension 53. Between the left side wall 38 and the right side wall 39, the developer housing section 30, the developer supplying section 36 and an upper extension section 37 are arranged.

Figure 5:
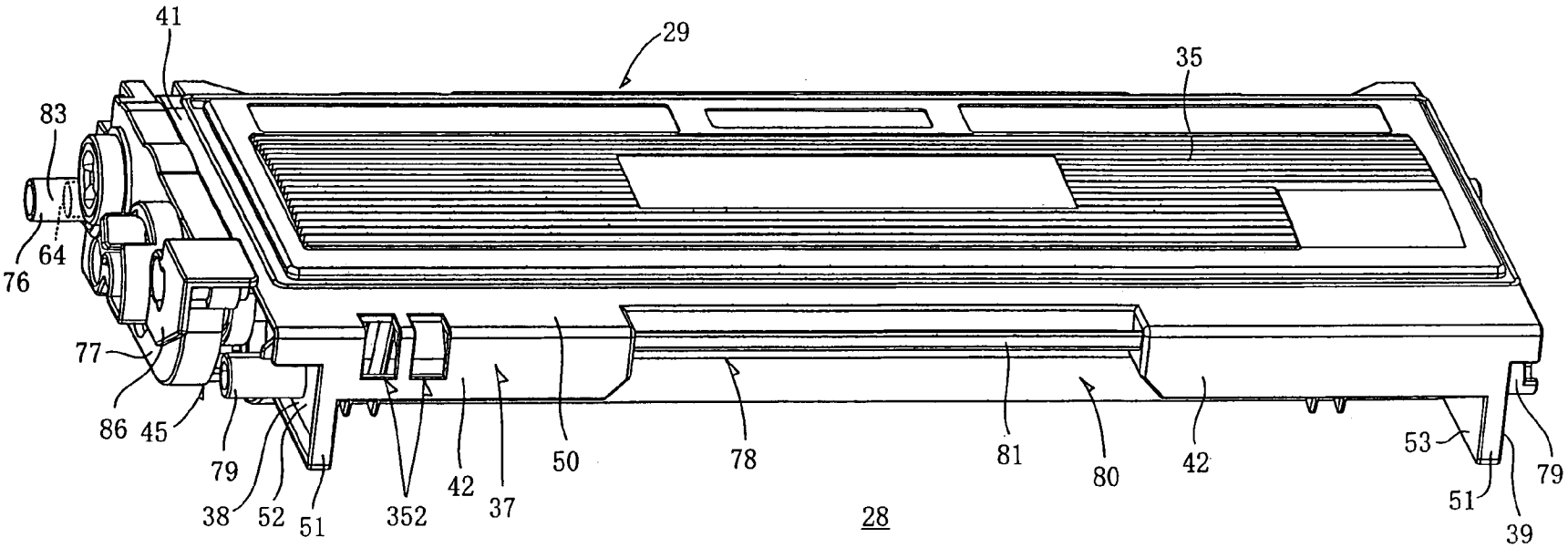
FIG. 5 is a front-top-left perspective view of the developer cartridge shown in FIG. 4.

The upper wall extension 50, the left side wall extension 52 and the right side wall extension 53 define the upper extension section 37. The left side wall extension 52 and the right side wall extension 53 extend forward from the left side wall 38 and right side wall 39, respectively. The lower wall 40 and the upper wall 41 extend substantially perpendicularly to the left side wall 38 and right side wall 39. The lower wall 40 and the upper wall 41 extend between the left side wall 38 and right side wall 39. The lower wall 40 includes, for example, a back portion 43 and a front portion 44. As shown in FIGS. 4 and 5, the upper front side wall 42, as a first wall portion, is a wall that extends, for example, downward from a front edge of the upper wall extension 50.

In exemplary embodiments, the upper wall 41 defines an upper wall opening 49 along the top portion of developer cartridge 28. The upper wall opening 49 is covered by the upper frame 35 when the upper frame 35 is attached to the lower frame 34. The upper wall opening 49 has a substantially rectangular-like shape, when viewed from the top of the developer cartridge 28, and exposes the developer housing section 30 and at least a portion of the developer supplying section 36 when the upper frame 35 is not attached to the lower frame 34.

As shown in FIG. 7, the lower wall 40 is sandwiched between the left side wall 38 and the right side wall 39. As shown in FIG. 4, the back portion 43 continuously extends from the front portion 44 of the lower wall 40. The back portion 43 generally corresponds to the portion of the lower wall 40 defining the lower boundary of the developer supplying section 36, while the front portion 44 generally corresponds to the portion of the lower wall 40 defining the lower and front side boundaries of the developer housing section 30.

More particularly, the back portion 43 defines the lower boundary of the developer supplying section 36 and extends substantially perpendicular to and between the left side wall 38 and the right side wall 39. In the exemplary embodiment of the developer cartridge 28 illustrated in FIG. 4, an inner surface of the back portion 43 of the lower wall 40 has a wave-like shape, in cross-section along the length direction.

The inner surface of the back portion 43, when viewed from the left or right side of the exemplary developer cartridge 28, includes an inclined portion corresponding to the portion of the lower wall below the developer roller 32, a concave portion corresponding to the portion of the lower wall below the developer supply roller 31 and a substantially upward extending portion. The substantially upward extending portion forms a lower partition 55 between the developer supplying section 36 and the developer housing section 30.

The front portion 44 includes a front segment 44A and a back segment 44B. The front segment 44A transitions to the back segment 44B at a bottommost portion 44C of the front portion 44. The front portion 44 further includes an interior surface 44D, which is an outer boundary of the developer housing section 30. Opposite from the interior surface 44D is an exterior surface 44E. The back segment 44B of the interior surface 44D declines downwardly from the lower partition 55. As shown in FIG. 4, the lower partition 55 is provided at the intersection of the back portion 43 and the front portion 44, and has an upside down V-like cross-section, which partitions the lower front end portion of the developer supplying section 36 from the lower back end portion of the developer housing section 30.

As shown in FIG. 4, at least the interior surface 44D of the front portion 44 of the lower wall 40 below the agitator 46 is substantially concave and curves upwardly toward the upper wall 41 along the front side of the agitator 46. In exemplary embodiments, the uppermost edge of the front segment 44A continuously connects to the upper wall 41 at the front side of the upper wall opening 49.

In some embodiments of a developer cartridge according to one or more aspects of the invention, the outer surface and the inner surface of the walls or frames may have different features (e.g., a cross sectional shape or texture of an inner surface may be different from a cross sectional shape or texture of an outer surface). In some embodiments, ribs or supporting members may be provided on the outer surface of the lower wall 40, as shown for example, in FIG. 4.

Figure 9:
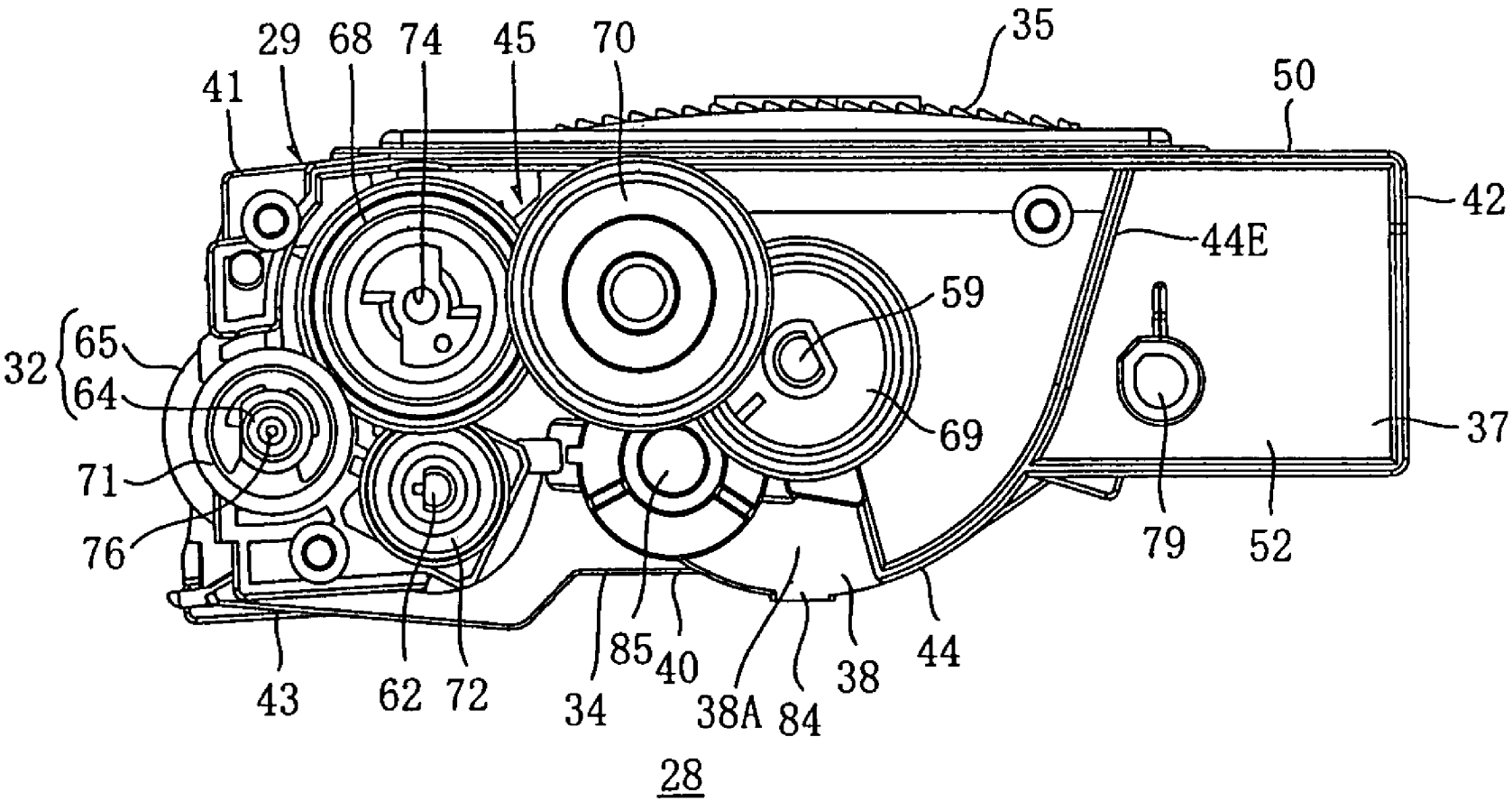
FIG. 9 is a left side view of the exemplary developer cartridge shown in FIG. 4 without a gear cover.
Figure 10:
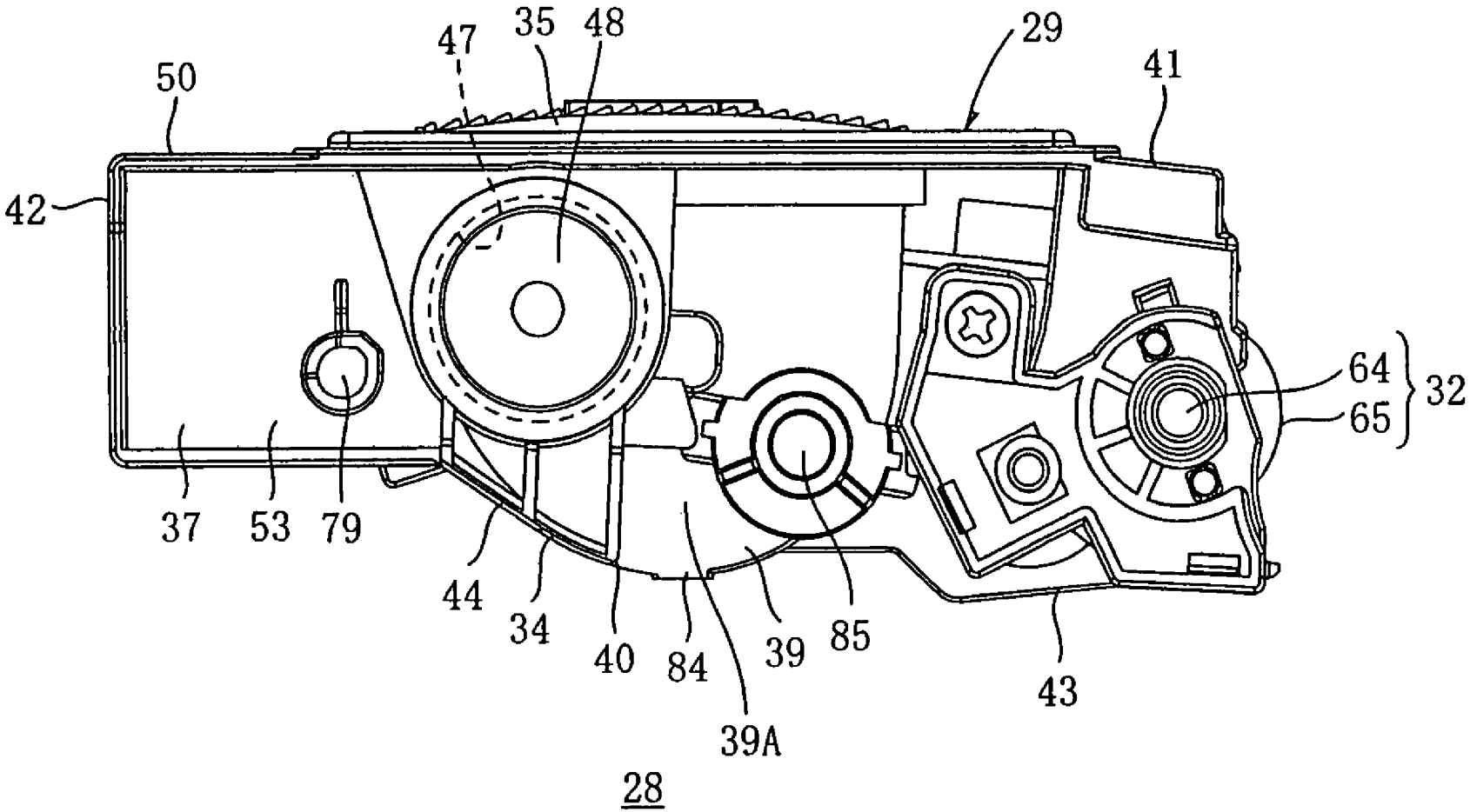
FIG. 10 is a right side view of the developer cartridge shown in FIG. 4.

As illustrated in FIGS. 3, 9 and 10, left and right sides of the developer housing section 30 are defined by corresponding respective portions 38A, 39A of the left side wall 38 and the right side wall 39. Further, in the following description of exemplary embodiments, a lower portion 30A of the developer housing section 30 may correspond to the portion of the developer housing section 30 that is below the rotation shaft 59 of the agitator 46 that is housed in the developer housing section 30, and an upper portion 30B of the developer housing section 30 may correspond to the portion of the developer housing section 30 that is above the rotation shaft 59 of the agitator 46 that is housed in the developer housing section 30.

At least one positioning member 84 may be provided on the developer cartridge 28 such that when the developer cartridge 28 is attached to the drum cartridge 27, the positioning member 84 helps correctly position the developer cartridge 28 relative to the drum cartridge 27. In exemplary embodiments, two positioning members 84 are provided on the bottom most portion 44C of the front portion 44 of the lower wall 40, and the positioning members 84 work in conjunction with protruding portions 118 (FIG. 11) of the drum cartridge 27.

In exemplary embodiments, two positioning members 84 are provided on the outer bottom surface of the front portion 44. The positioning members 84 are flat plate-like portions, spaced apart from each other along the width direction, on the base of the concave front portion 44 of the lower wall. The positioning members 84 provide flat surfaces that essentially sit on top of the protruding portions 118 of the drum cartridge 27 when the developer cartridge 28 is attached to the drum cartridge 27. As discussed below, in the exemplary embodiments, the protruding portions 118 are substantially convex shaped projecting surfaces.

Figure 6:
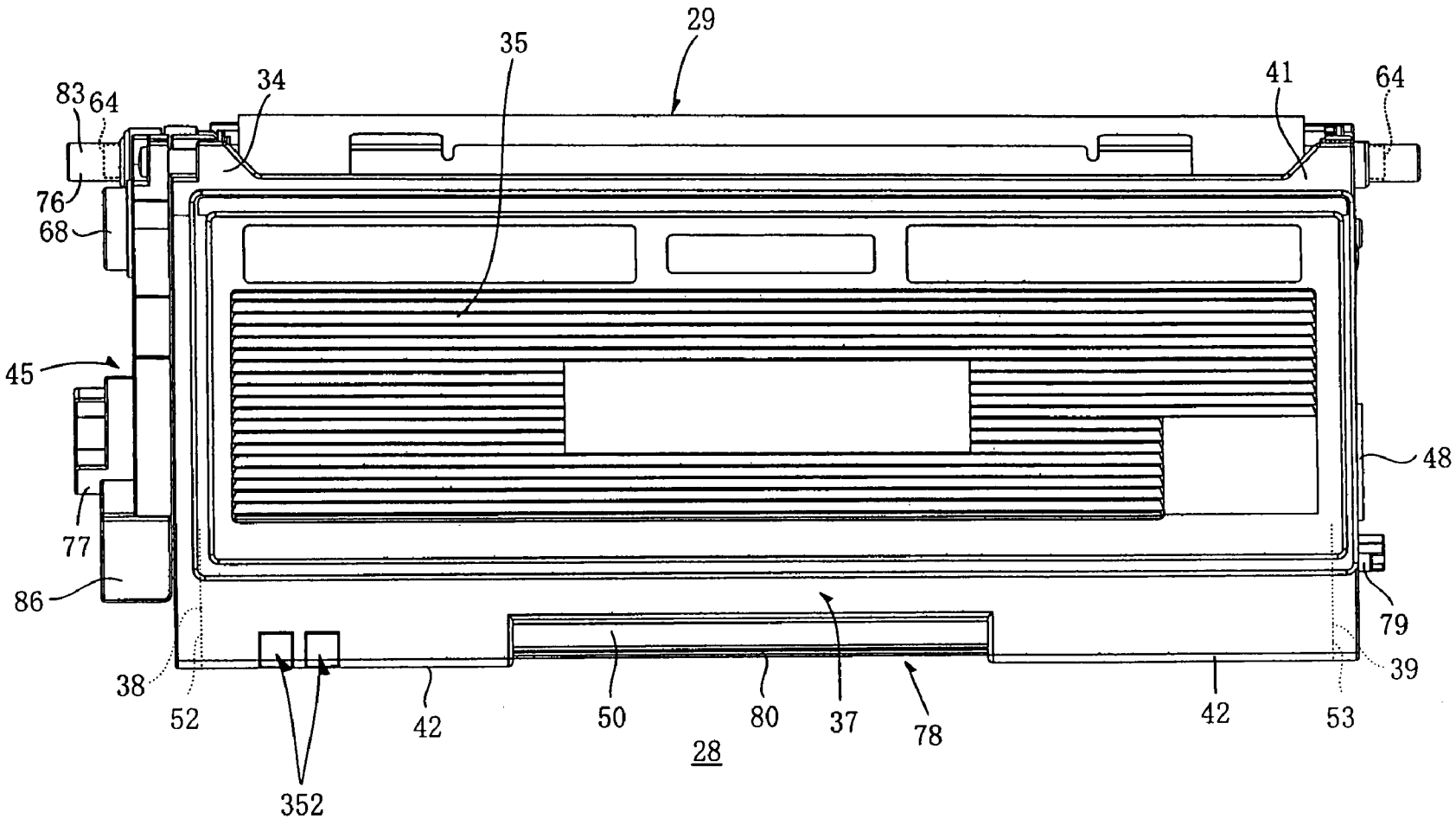
FIG. 6 is a plan view of the developer cartridge shown in FIG. 4.

FIG. 5 is a perspective view from the front-left side of the exemplary developer cartridge 28 illustrated in FIG. 4, and FIG. 6 is a plan view of the exemplary developer cartridge 28 illustrated in FIG. 4. As shown in FIGS. 5 and 6, the upper wall 41 of the lower frame 34 is substantially flat. The upper wall 41 of the lower frame 34 extends between the left side wall 38 and the right side wall 39. The upper wall 41 of the lower frame 34 may further extend outwardly from each of the left side wall 38 and the right side wall 39. The upper wall 41 connects the upper portions and/or surfaces of the left side wall 38 and right side wall 39.

A back portion of the upper wall 41, which substantially corresponds to a portion of the upper wall 41 above the developer roller 32 and the developer supply roller 31, includes a support member 57. As illustrated in FIG. 3, the exemplary support member 57 of the upper wall 41 protrudes substantially downward. In exemplary embodiments, the support member 57 may be a planar member that extends in a direction substantially between the left side wall 38 and right side wall 39 and projects substantially downward toward the developer roller 32.

As discussed above, the upper wall 41 defines the upper wall opening 49 that exposes, for example, a portion of the developer housing section 30 and the developer supplying section 36. Also, as discussed above, in exemplary embodiments, the upper edge of the front portion 44 of the lower wall 40 connects with the upper wall 41 at the front side of the upper wall opening 49. The upper wall 41 may extend frontward from the upper edge of the front portion 44 and continuously connect with the upper wall extension 50.

The upper wall extension 50 may extend frontward from the front edge of the upper wall 41 to the upper front side wall 42. In exemplary embodiments, the upper wall 41 may be continuous with the upper wall extension 50. As shown in FIG. 5, the upper wall extension 50 extends between the left side wall extension 52 and the right side wall extension 53. The upper wall extension 50 may further extend outwardly from each of the left side wall extension 52 and the right side wall extension 53. The top surface of the upper wall extension 50 may be substantially flat and the front edge of the upper wall extension 50 may connect to the upper front side wall 42.

The upper front side wall 42 may have a substantially planar shape and extend substantially perpendicularly downward from the front edge of the upper wall extension 50. As shown in FIG. 5, the portion of the upper front side wall 42 between the left side wall extension 52 and the right side wall extension 53 extends about halfway down the thickness of the developer cartridge casing 29 while the portions of the upper front side wall 42 extending beyond the left side wall extension 52 and the right side wall extension 53, respectively, extend downward a smaller amount.

Protruding members 51 may, for example, extend downward from the lower edge of the upper front side wall 42. In exemplary embodiments, the protruding members 51 extend downward from the lower edge of the upper front side wall 42 at portions substantially corresponding to front edges of the left side wall extension 52 and the right side wall extension 53. In exemplary embodiments, the protruding members 51 are substantially thin rectangular plate-like members that are formed continuously and in the same plane as the upper front side wall 42. As shown in FIG. 5, ignoring a notch 80, the upper front side wall 42 and the protruding members 51 form an upside-down U-like shape having substantially flat outer surfaces.

As shown in FIG. 5, the base of the inverted "U" shape is formed by the upper front side wall 42 and a substantially central portion of the upper front side wall 42 may bend inward to form the notch 80, as discussed below.

As discussed above, in the exemplary embodiment illustrated in FIG. 6, the left side wall 38 and the right side wall 39 are substantially parallel to each other and are connected via the upper wall 41 and the lower wall 40. The upper wall 41 and the lower wall 40 extend substantially perpendicular to the left side wall 38 and the right side wall 39.

The back edges of the left side wall 38 and right side wall 39 may extend to the back edge of the back portion 43 of the lower wall 40 and the back edge of the upper wall 41 and may define the open side 8 of the developer cartridge casing 29. The front edges of the left side wall 38 and right side wall 39 may extend to the upper front side wall 42 and/or to the protruding members 51.

The front side of the front portion 44 of the lower wall 40, which curves substantially upwardly along the front side of an outer circumferential path of the agitator 46, may be connected to a middle-front portion of the left side wall 38 and the right side wall 39 so as to define the corresponding portions 38A, 39A of the left side wall 38 and the right side wall 39.

An inner-surface of the front portion 44 of the lower wall 40 that faces the agitator 46 defines a front portion of the developer housing section 30. An outer-surface of the front portion 44 of the lower wall 40 that faces the drum cartridge 27 and includes positioning member 84 defines the back boundary of the upper extension portion 37.

The upper wall extension 50, the left side wall extension 52 and the right side wall extension 53 (i.e., first pair of side wall extensions) extend continuously and frontward from the outer surface of the front portion 44 of the lower wall 40. More particularly, the upper wall extension 50, the left side wall extension 52 and the right side wall extension 53 extend substantially perpendicularly from the front portion 44 of the lower wall 40.

In some embodiments, the upper extension portion 37 may extend from the left or right sides of the developer cartridge casing 29 and bend or continue extending at an angle so as to extend beyond the front portion 44 of the lower wall 40 in the length direction. In some embodiments, the upper extension portion 37 only projects forward beyond the lower wall 40 such that no portion of the upper extension portion 37 projects upward beyond the upper wall 41.

While in the description of the walls and portions provided herein, walls and portions may be described as being continuously connected/extended, in some embodiments the walls may, for example, be formed of attached wall portions or segments.

As shown in FIGS. 4 and 5, the upper frame 35 of the developer cartridge may have a substantially flat overall shape and the portion of the upper frame 35 corresponding to the developer housing section 30 may protrude slightly upward to form a slightly convex-like portion. As discussed above, the upper frame 35 attaches with the lower frame 34 and seals the upper wall opening 49 of the lower frame 34.

As shown in FIG. 4, the upper frame 35 may include a plurality of ribs 54 along an inner surface of the upper frame 35. The ribs 54 may extend substantially in the width direction between the left side wall 38 and the right side wall 39 and be substantially parallel to each other. A predetermined space exists between adjacent ribs 54.

As discussed above, the lower partition 55 projects upward from the lower wall 40 and partitions the lower portions of the developer supplying section 36 and the developer housing section 30. The lower partition 55 may be substantially aligned with an upper partition 56 that projects downward from the inner surface of the upper frame 35 that faces the developer roller 32.

As shown in FIG. 4, there is a gap between the upper partition 56 and the lower partition 55. The gap corresponds to a developing agent passage 58 for supplying the developing agent stored in the developer housing section 30 to the developer supplying section 36. The upper portion 56 and the lower portion 55 also define the front side of the developer supplying section 36 and the back side of the developer housing section 30.

The developer cartridge casing 29 with the features discussed above comprises an internal space behind the lower partition 55 and upper partition 56. The internal space behind the lower partition 55 and the upper partition 56 defines the developer supplying section 36. The internal space in front of the lower partition 55 and the upper partitions 56 defines the developer housing section 30.

In various embodiments, the developing agent stored in the developer housing section 30 may be a non-magnetic single component toner that may be positively charged. The toner may be a polymerized toner that is obtained by copolymerizing polymerizable monomers using a known polymerization method, such as a suspension polymerization method. A polymerizable monomer may be a styrene-based monomer, such as, a styrene monomer (e.g., styrene) or an acrylic-based monomer, such as, acrylic acid, alkyl(C1-C4) acrylate, or alkyl(C1-C4) methacrylate. The polymerization process forms substantially spherical toner particles that have good fluidity such that high quality images can be formed.

Wax and/or colorants, such as, carbon black may be combined with the toner. To improve the fluidity of the toner, silica may also be added. In various exemplary embodiments, the average grain diameter of the toner is about 6 μm to about 10 μm.

As shown in FIGS. 9 and 10, in some embodiments, the developer housing section 30 may be provided with a toner detecting window 85 on each of the left side wall 38 and the right side wall 39 of the lower frame 34. The toner detecting windows 85 may be arranged on facing lower portions of the left side wall 38 and the right side wall 39 such that the toner detecting windows 85 are opposite to one another.

When the amount of developing agent in the developer housing section 30 is running low or is empty (i.e., the developing agent supply is not sufficiently high enough to block a light irradiating one of the toner detecting windows 85 from passing through the developer housing section 30 and through the other toner detecting window 85), light from a developing agent low/empty sensor 371 (FIG. 25) passes through both of the toner detecting windows 85 and a developing agent low/empty signal is triggered. The developing agent low/empty sensor 371 may be provided in the main casing 2.

The agitator 46 for agitating the developing agent (e.g., toner) is housed in the developer housing section 30 and supplies the developing agent to the developer supplying section 36, via the developing agent passage 58. As shown in FIG. 3, a rotation shaft 59 of the agitator 46 is provided substantially in the center of the developer housing section 30. The rotation shaft 59 of the agitator 46 is rotatably supported by the left side wall 38 and the right side wall 39.

The agitator 46 includes, for example, an agitation member 60 that extends from the rotation shaft 59 toward the boundaries of the developer housing section 30, as defined by the interior surface 44D of the front portion 44 of the lower wall 40. The left end of the rotation shaft 59, which is supported by the left side wall 38, passes through the developing housing section 30 portion 38A of left side wall 38, as shown in FIG. 9.

In various embodiments, a film (not shown) may be provided at the end portion(s) of the agitation member 60 such that when the agitation member 60 rotates, the film glides along the interior surface 44D of the developer housing section 30 and helps mix the developing agent (e.g., toner) housed in the developer housing section 30.

As shown in FIG. 10, a developing agent supply opening 47 may be provided on the right side wall 39. The developing agent supply opening 47 allows the developer housing section 30 to be filled with the developing agent (e.g., toner) when the developer housing section 30 is empty. The developing agent supply opening 47 may be a round opening in portion 39A of the right side wall 39 at a portion corresponding to the developer housing section 30. A supply cap member 48 may be provided for sealing the developing agent supply opening 47.

As shown in FIG. 10, the supply cap member 48 may have a portion that is slightly larger than the developing agent supply opening 47 such that the portion of the supply cap member 48 overlaps the outer surface of the right side wall 39 to prevent the developing agent from leaking out of the developing agent supply opening 47. In some embodiments, the developing agent supply opening 47 may not be provided.

As shown in FIG. 4, adjacent to the developer housing section 30 is the developer supplying section 36 of the developer cartridge 28. In the developer supplying section 36, the developer supply roller 31 is arranged in a front-lower portion of the developer supplying section 36 and extends substantially perpendicular to the left side wall 38 and the right side wall 39. The developer supply roller 31 may include a supply roller shaft 62 and a sponge roller 63, which covers the periphery of the supply roller shaft 62.

The supply roller shaft 62 may be made of metal, and the sponge roller 63 may be made of a conductive foam. As shown in FIG. 9, in exemplary embodiments, the left end of the supply roller shaft 62 protrudes from left side wall 38 and is rotatably supported by the left side wall 38.

The developer roller 32 is also arranged in the developer supplying section 36. The developer roller 32 is arranged behind the developer supply roller 31 in the back-lower portion of the developer supplying section 36, as shown in FIG. 4. The developer roller 32 and the developer supply roller 31 are in pressure contact with each other. As shown in FIG. 3, one side of the developer roller 32 projects slightly beyond back ends 87 of the developer supplying section 36 of the developer cartridge casing 29 and is exposed via the open side 8 of the developer cartridge casing 29. The back ends 87 of the developer cartridge casing 29 define the opening 16

The developer roller 32 comprises a developer roller shaft 64 and a roller 65, which extend along a direction substantially perpendicular to the left side wall 38 and the right side wall 39. The roller 65 covers at least a portion of the periphery of the developer roller shaft 64. The developer roller shaft 64 can be made of metal and the roller 65 can be made of a conductive rubber material. The conductive rubber material may be, for example, a conductive urethane or silicon rubber including carbon micro-grains with a surface covered with a fluorine-containing urethane rubber or a fluorine-containing silicon rubber.

Figure 20:
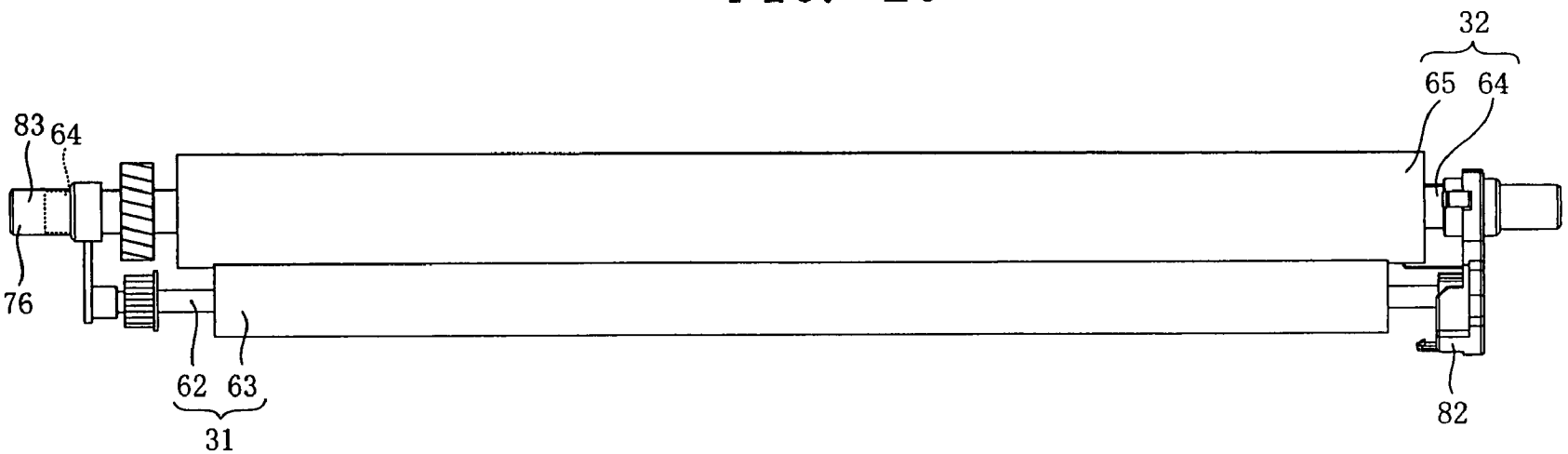
FIG. 20 is a back side view of an exemplary developer roller and an exemplary developer supply roller.
Figure 21A:
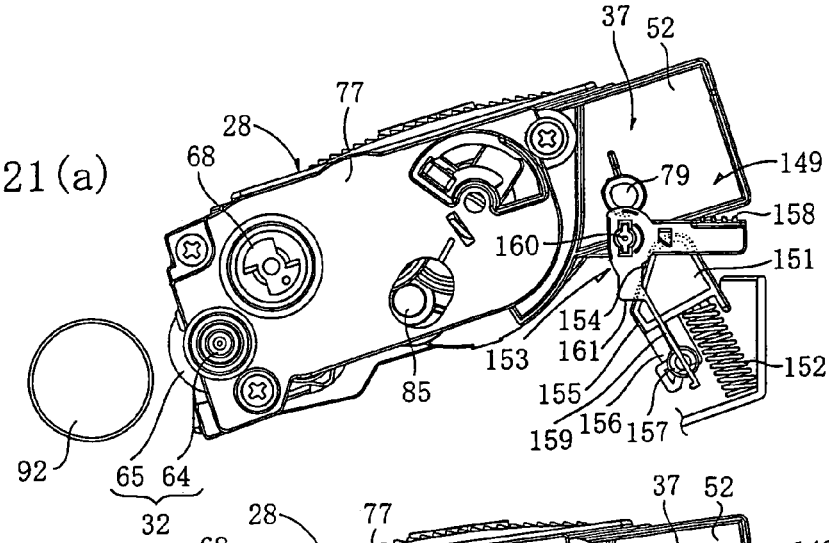
FIGS. 21(*a*), 21(*b*) 21(*c*) and 21(*d*) are sequential partial left side views showing attachment of the developer cartridge shown in FIG. 4 to the drum cartridge shown in FIG. 11.
Figure 21B:
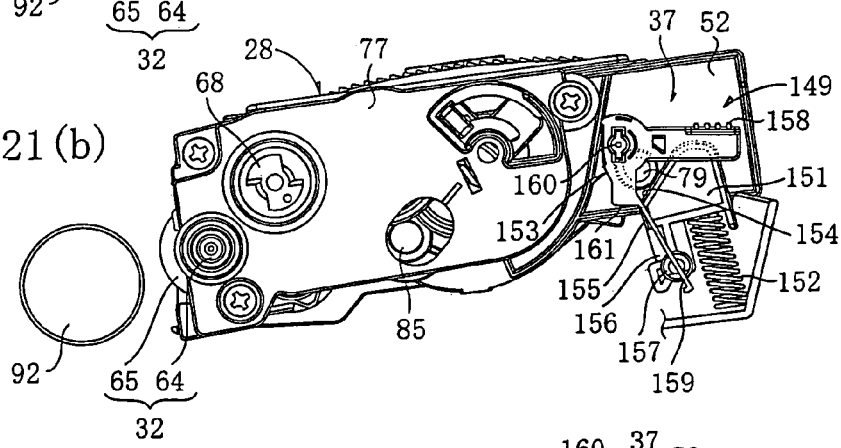
Figure 21C:
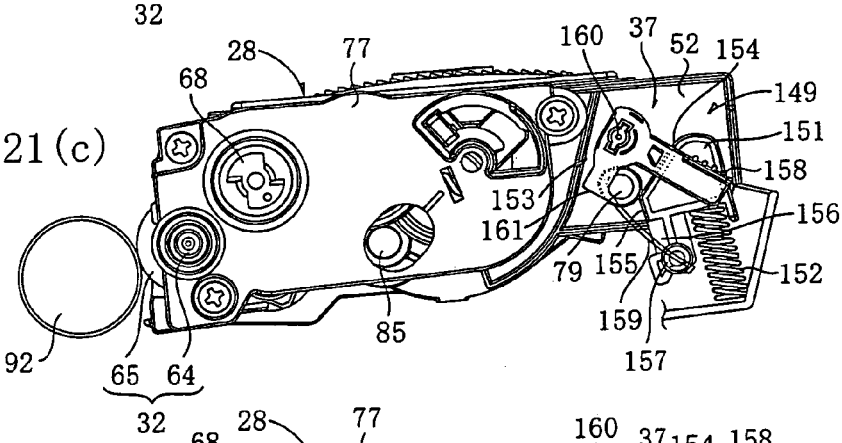
Figure 21D:
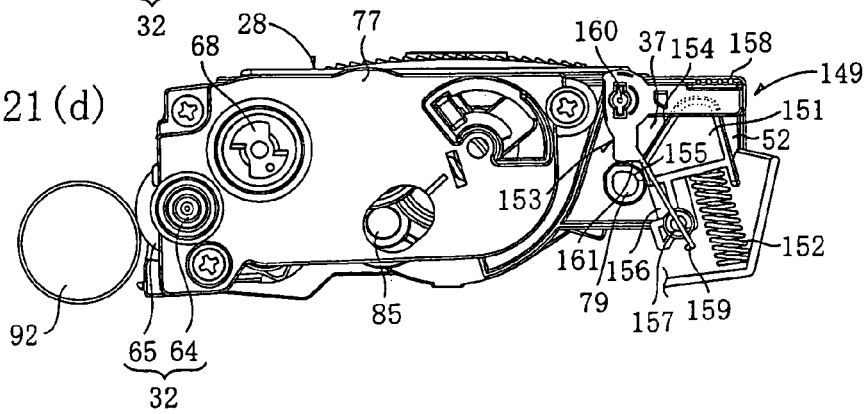

The left and right ends of the developer roller shaft 64 protrude from the left side wall 38 and the right side wall 39, respectively, as shown in FIG. 6. As shown in FIG. 20, the right end of the supply roller shaft 62 and the right end of the developer roller shaft 64 are rotatably supported by a bearing member 82. The bearing member 82 may be composed of an insulating resin material and may be arranged in the right side wall 39. A collar member 83 may be mounted to the left end of the supply roller shaft 62 and the left end of the developer roller shaft 64. In some embodiments, the collar member 83 is provided at both the left end and the right end of the developer roller shaft 64.

The collar member 83 is a conductive member that may be composed of a conductive resin material that maintains the developer supply roller 31 and the developer roller 32 at substantially the same electric potential. The collar member 83 may be slidably connected to the left end of the developer roller shaft 64 of the developer roller 32 and the left end of the supply roller shaft 62 of the developer supply roller 31.

The portion of the collar member 83 that covers the left end of the developer roller shaft 64 of the developer roller 32 functions as a developer roller electrode 76. The developer roller electrode 76 contacts a developer roller contacting member 175 of the laser printer 1 when the developer cartridge 28 is detachably arranged in or attached to the main casing 2.

As shown in FIG. 4, a thickness regulating member 33 is provided within the developer supplying section 36. The thickness regulating member 33 comprises a flexible member 66 that may be composed of an elastic/flexible metal plate, and a pressing member 67 on a lower end of the flexible 66. The flexible member 66 may be in the form of a plate-like member. The pressing member 67 may have a semi-circular or convex shape and may be made of an insulating silicon rubber.

The thickness regulating member 33 is situated near the developer roller 32. The upper end portion of the flexible member 66 is supported by the upper wall 41 and/or support member 57 of the upper wall 41 such that the pressing member 67, on the lower end of the flexible member 66, is pressed against the peripheral surface of the roller 65 of the developer roller 32 by an elastic force of the flexible member 66.

In exemplary embodiments of the developer cartridge 28, a gear mechanism 45 may be provided on the left side wall 38, as shown in FIG. 9. FIG. 9 is a left side view of the exemplary developer cartridge 28 illustrated in FIG. 4, without a gear cover 77. The gear mechanism 45 functions as a driving force input means for supplying a mechanical driving force to the developer roller 32, the developer supply roller 31 and the agitator 46.

The gear mechanism 45 includes an input gear 68, an agitator driving gear 69, an intermediate gear 70, a developer roller driving gear 71, and a supply roller driving gear 72. In various embodiments, a gear (e.g., the developer roller driving gear 71, the supply roller driving gear 72, the agitator driving gear 69, the intermediate gear 70) may be in the form of a round plate-like member with a serrated outer edge having an opening in a center of the plate-like member.

Such an exemplary gear rotates about an axis that extends in substantially the width direction and through the opening in the center of the gear. A plane defined by rotation of the round plate-like member, when the gear is driven, is parallel to or substantially parallel to the left side wall 38 In the following description, a gear (e.g., the developer roller driving gear 71, the supply roller driving gear 72, the agitator driving gear 69, the intermediate gear 70) will be referred to as parallel to the left side wall 38 of the plane defined by rotation of the gear is parallel to the left side wall 38. The serrated outer edges engage with the serrated outer edges of another gear.

The input gear 68 functions as a driving force transmitting part and is arranged substantially parallel to the left side wall 38, on the upper back portion of the left side wall 38. The intermediate gear 70 is arranged substantially parallel to the left side wall 38. The intermediate gear 70 is arranged to the front and left of the input gear 68. The intermediate gear 70 engages with the input gear 68.

The agitator driving gear 69 is provided on the left end of the rotation shaft 59 of the agitator 46. The agitator driving gear 69 is arranged substantially parallel to the left side wall 38. The agitator driving gear 69 is arranged to the front and right of the intermediate driving gear 70. The agitator driving gear 69 engages with the intermediate gear 70.

The developer roller driving gear 71 is arranged on the left end of the developer roller shaft 64. The developer roller driving gear 71 is substantially parallel to the left side wall 38. The developer roller driving gear 71 is to the back and to the left of the input gear 68. The developer roller driving gear 71 engages with the input gear 68.

The supply roller driving gear 72 is arranged on the left end of the supply roller shaft 62. The supply roller driving gear 72 is substantially parallel to the left side wall 38. The supply roller driving gear 72 is arranged substantially below the input gear 68. The supply roller driving gear 72 engages with the input gear 68.

The agitator driving gear 69, the developer roller driving gear 71 and the supply roller driving gear 72 are integrally rotatable with the rotation shaft 59, the developer roller shaft 64 and the supply roller shaft 62, respectively. That is, the agitator driving gear 69, the developer roller driving gear 71 and the supply roller driving gear 72 are not rotatable with respect to the rotation shaft 59, the developer roller shaft 64 and the supply roller shaft 62, respectively.

In a substantially center portion of the input gear 68, a connecting hole 74 is provided, as shown in FIG. 9. A coupling member 73 (FIG. 26) through which the driving force is inputted, is connected via the connecting hole 74. The coupling member 73 is connected in such a manner that it is integrally rotatable with the input gear 68. The coupling member 73 is connected in such a manner that it is not rotatable with respect to the input gear 68.

Figure 8:
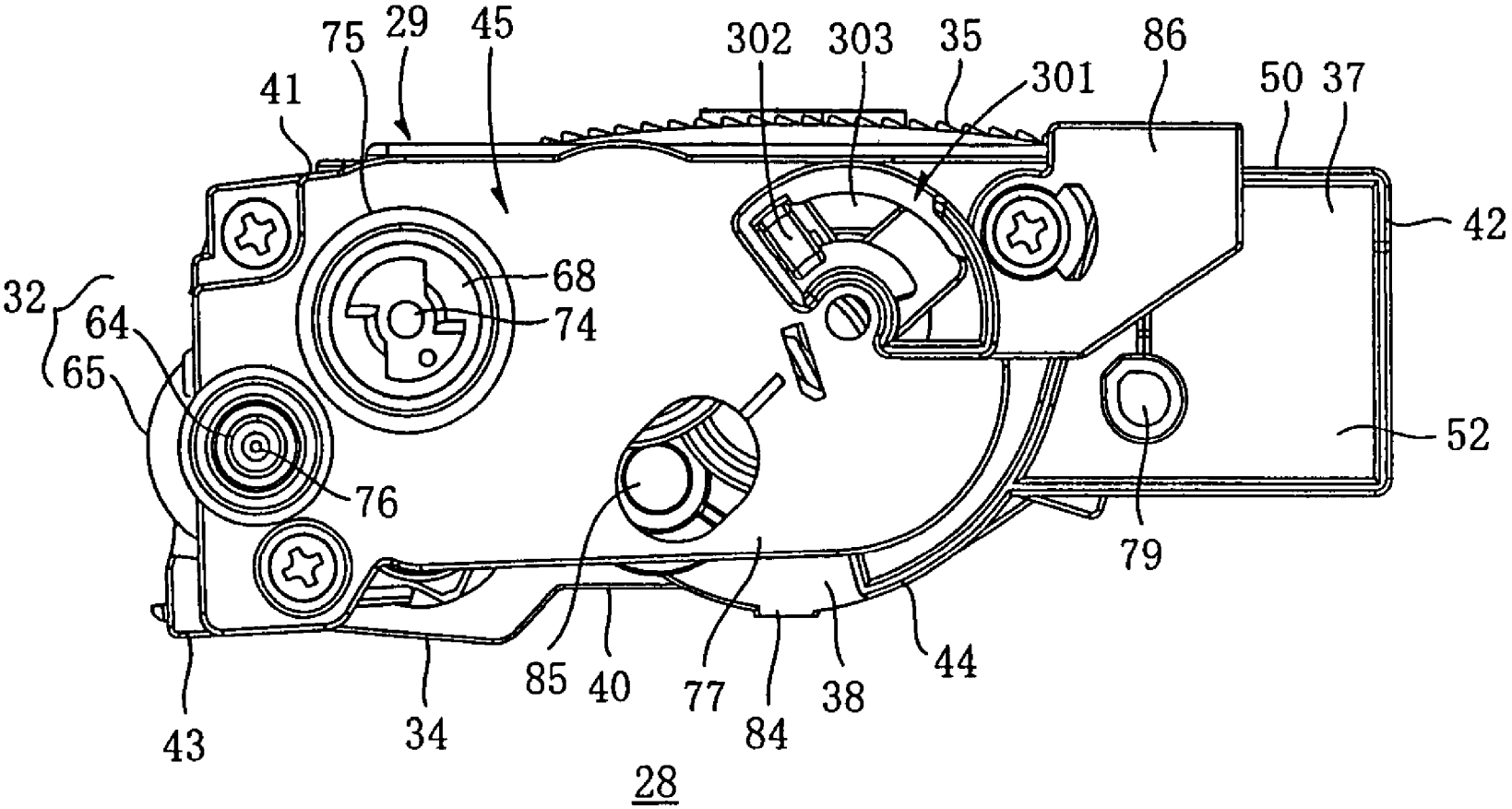
FIG. 8 is a left side view of the developer cartridge shown in FIG. 4 including an exemplary gear cover.

As shown in FIGS. 5 and 8, the gear mechanism 45 may be covered with a gear cover 77 that is mounted on the left side wall 38. The gear cover 77 may include at least one wall, which extends substantially parallel to the left side wall 38. The gear cover 77 may comprise a plurality of wall portions which extend toward the left side wall 38 from the at least one wall. The at least one wall may include one or more openings. The opening(s) allow access to the various gears (e.g., the input gear 68, the developer roller driving gear 71, the supply roller driving gear 72, the agitator driving gear 69, the intermediate gear 70) and/or the toner detecting windows 85 and toner detecting openings 101, As shown in FIG. 8, the gear cover 77 may include an opening 75 for accessing the input gear 68. The gear cover 77 may include an opening 75 that exposes and rotatably the input gear 68 so as to permit the input gear 68 to rotate.

The gear cover 77 also covers all or a part of the intermediate gear 70, the agitator driving gear 69, the developer roller driving gear 71 and the supply roller driving gear 72. The left end of the developer roller shaft 64 protrudes out beyond the outside surface of the gear cover 77. The developer roller shaft 64 protrudes through the left side wall 38, extends through a space between the left side wall 38 and the gear cover 77 and protrudes out beyond an outside surface of the gear cover 77 in the width direction (i.e., substantially perpendicular to the left side wall 38).

A cover extension portion 86 may be provided on an upper front portion of the gear cover 77. The exemplary cover extension portion 86 projects outward, in the width direction from the gear cover 77, and also extends in the length direction substantially parallel to the left side wall 38. The cover extension portion 86 partially overlaps the upper portion of the left side wall extension 52 and slightly extends above the upper wall 41.

Figure 13:
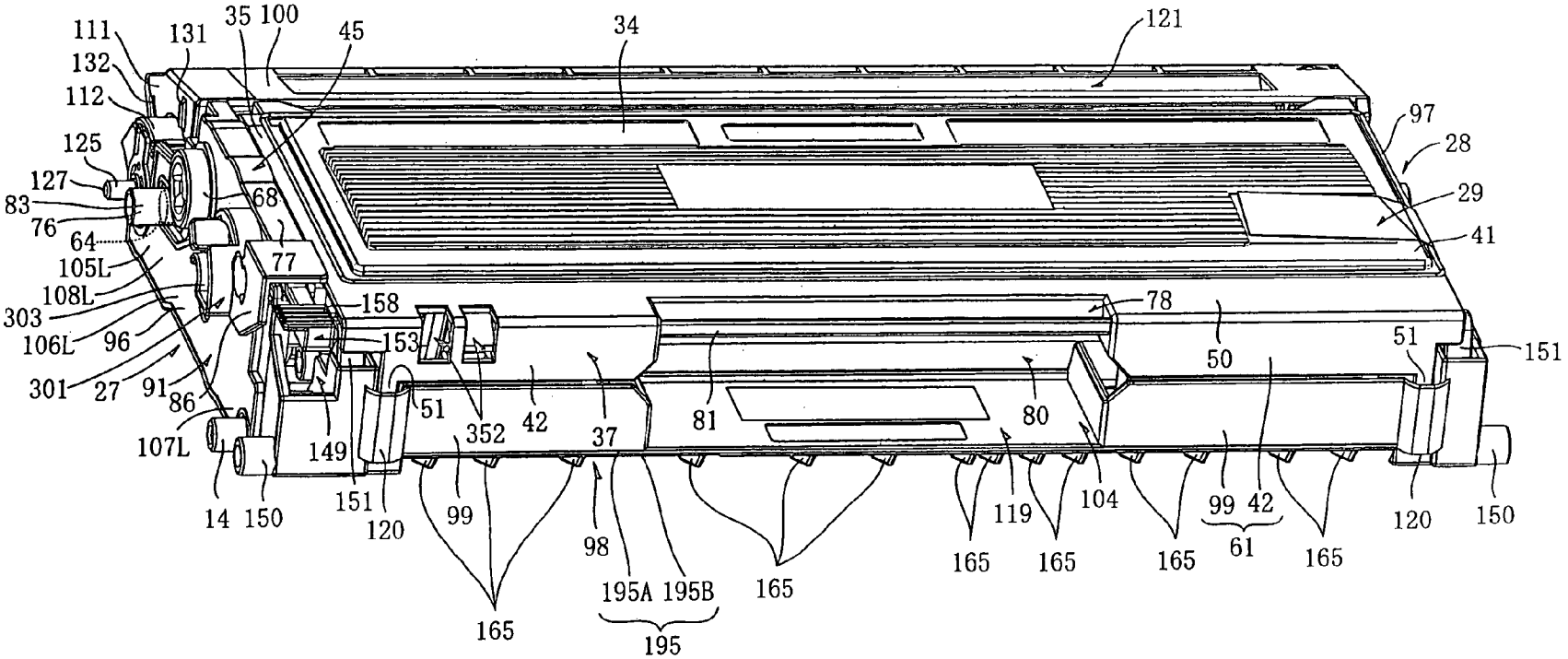
FIG. 13 is a front-top-left perspective view of the process cartridge shown in FIG. 3.

As shown in FIG. 13, the cover extension portion 86 is arranged to the left of a left side wall 96 of a drum cartridge casing 91 when the developer cartridge 28 is attached to the drum cartridge 27, as discussed below. The cover extension portion 86 reduces possible bending of the left side wall 96 of the drum cartridge casing 91.

While exemplary embodiments of the developer cartridge 28 include the gear cover 77, in some embodiments, a gear cover and/or a cover extension portion may be omitted. In some embodiments, the gear cover 77 and/or cover extension portion 86 may be integrally provided with the developer cartridge casing 29.

As shown in FIGS. 5 and 6, in exemplary embodiments, a gripping portion 78 and developer cartridge bosses 79 are provided in the upper extension portion 37. The gripping portion 78 includes a handle 81 arranged in the notch 80, as a first cutout portion, in the upper extension portion 37. The notch 80 (first notch portion) is formed along a front-top corner of upper extension portion 37 and extends along a substantially central portion of the front and top edges of the upper wall extension 50 and the upper front side wall 42, respectively.

In exemplary embodiments, the portion of the upper wall extension 50 which adjoins the notch 80 does not extend forward as far as the other portions of upper wall extension 50 forming a substantially "U" shaped portion when viewed from above. The portion of the upper front side wall 42, which corresponds to the notch 80, bends inward (i.e., towards the back) following the front edge of the upper wall extension 50 forming a substantially "U" shaped portion along a substantially front-center portion of the upper wall extension 50.

As discussed above, in some embodiments the developer cartridge 28 may include the receiving portions 352 in the front upper corner of the upper extension portion 37. As illustrated in FIG. 5, the receiving portions 352 may be openings or cutout portions in the upper front side wall 42 and the upper wall extension 50. Projecting portions 351 project from the front cover 7 of the exemplary laser printer 1 and help reduce the possibility of an incorrect developer cartridge from being installed/arranged in the main casing 2. More particularly, the receiving portions 352 are provided at locations that can receive the corresponding projecting portions 351 when the front cover 7 is closed, which in the exemplary embodiment illustrated in FIG. 5 corresponds to the left-front upper end of the developer cartridge 28.

Figure 11:
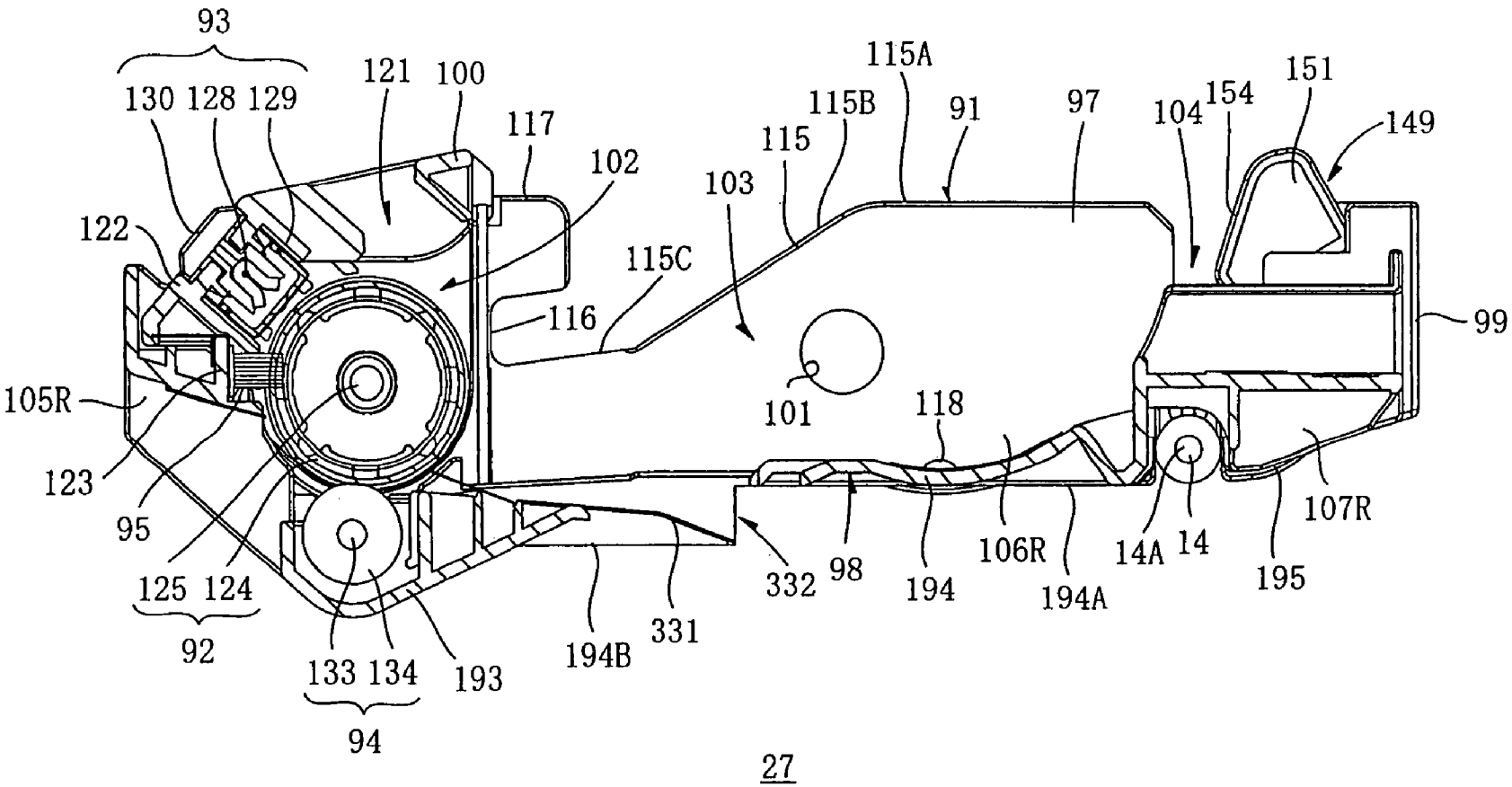
FIG. 11 is a cross sectional view of an exemplary drum cartridge.
Figure 12:
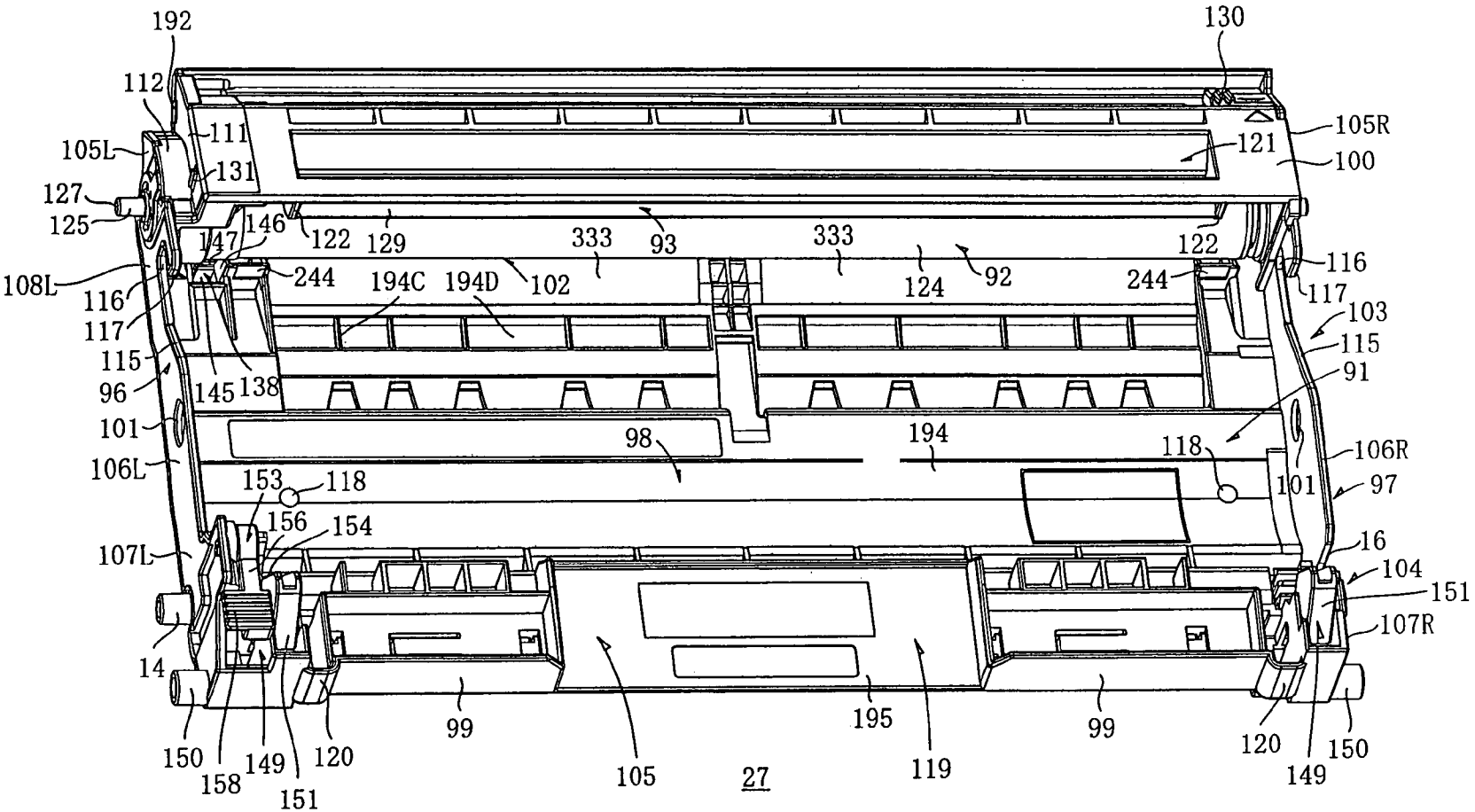
FIG. 12 is a front-top-left perspective view of the drum cartridge shown in FIG. 11.

FIG. 11 is a cross-sectional view, along the length direction, of an exemplary embodiment of a drum cartridge 27 which is attachably/detachably employable by the exemplary process cartridge 20 and/or the exemplary main casing 2, illustrated in FIG. 1. FIG. 12 is a front-top-left-side perspective view of the exemplary drum cartridge 27 illustrated in FIG. 11.

As illustrated in FIGS. 11 and 12, the exemplary drum cartridge 27 includes the drum cartridge casing 91, the photosensitive drum 92, as a photosensitive member, a charger 93 (e.g., scorotron type charger), the transfer roller 94 and a cleaning brush 95. The charger 93 is a scorotron type charger as a charging means for charging a peripheral surface of the photosensitive drum 92. The transfer roller 94 is a transferring means for transferring the image developed on the photosensitive drum 92. The cleaning brush 95 is a cleaning means for cleaning the peripheral surface of the photosensitive drum 92 to remove developer (e.g., toner) left on the peripheral surface of the photosensitive drum 92 after the developer image is transferred to the sheet 3.

The drum cartridge casing 91 may be made of a resin material. For example, polystyrene may be used to form the drum cartridge casing 91. The drum cartridge casing 91 may include the left side wall 96, a right side wall 97, a bottom wall 98, a lower front side wall 99 and an upper back side wall 100 (as a second wall portion).

As illustrated in FIG. 12, the left side wall 96 and the right side wall 97 of the drum cartridge casing 91 are arranged substantially parallel to each other. A space exists between the left side wall 96 and the right side wall 97. More particularly, the left side wall 96 and the right side wall 97 are arranged such that an inner surface of the left side wall 96 faces an inner surface of the right side wall 97. The photosensitive drum 92 is arranged between the left side wall 96 and the right side wall 97. An axis about which the photosensitive drum 92 rotates is substantially perpendicular to the left side wall 96 and the right side wall 97.

The drum cartridge casing 91 includes a drum housing portion 102, a developer cartridge housing portion 103, and a lower extension portion 104.

Each of the left side wall 96 and the right side wall 97 includes a back side wall portion 105L, 105R, respectively, a front side wall portion 106L, 106R, respectively, and an extension wall portion 107L, 107R, respectively. In exemplary embodiments, the features of each portion (i.e., the back-side wall portion 105L, the front side wall portion 106L and the extension wall portion 107L) of the left side wall 96 differ from the features of each portion of the right side wall 97 (i.e., the back-side wall portion 105R, the front side wall portion 106R and the extension wall portion 107R). The features of each portion of the exemplary embodiment relevant to one or more aspects of the invention will be described below.

The back-side wall portions 105L, 105R of the left side wall 96 and right side wall 97 may each include a first wall 108L, 108R, a second wall 109L, 109R, a third wall 110L, 110R. The back-side wall portion 105L of the left side wall 96 may further include a fourth wall 111, a fifth wall 112, a sixth wall 113, and a seventh wall 114.

As illustrated in FIGS. 14-17, the first wall 108L of the back side wall portion 105L extends back from the front side wall portion 106L of the left side wall 96. The second wall 109L may be substantially parallel to the first wall 108L, while being below and to the right of the first wall 108L.

The third wall 110L is substantially perpendicular to the first wall 108L and the second wall 109L so as to connect the bottom boundary of the first wall 108L and the top boundary of the second wall 109L. The fourth wall 111 is substantially parallel to the first wall 108L, and arranged above and between the first wall 108L and the second wall 109L.

The fifth wall 112 connects a bottom boundary of the fourth wall 111 with an upper boundary of the first wall 108L. The sixth wall 113 is arranged to the back and to the right of the first wall 108L, the second wall 109L and the fourth wall 111. The seventh wall 114 connects the second wall 109L, the fourth wall 111 and the sixth wall 113 together.

In exemplary embodiments, the first wall 108L is the outermost (e.g., leftmost) of the first wall 108L, second wall 109L, third wall 110L, fourth wall 111, fifth wall 112, sixth wall 113 and seventh wall 114 of the back side wall portion 105L of the left side wall 96. The first wall 108L extends, for example, along a same plane as the front side wall portion 106L and, when viewed from the side, encompasses substantially a central portion of the back-side wall portion 105L of the left side wall 96. A top-back portion of the first wall 108L may have a curved shape that substantially corresponds to a shape of a portion of the photosensitive drum 92.

Figure 17:
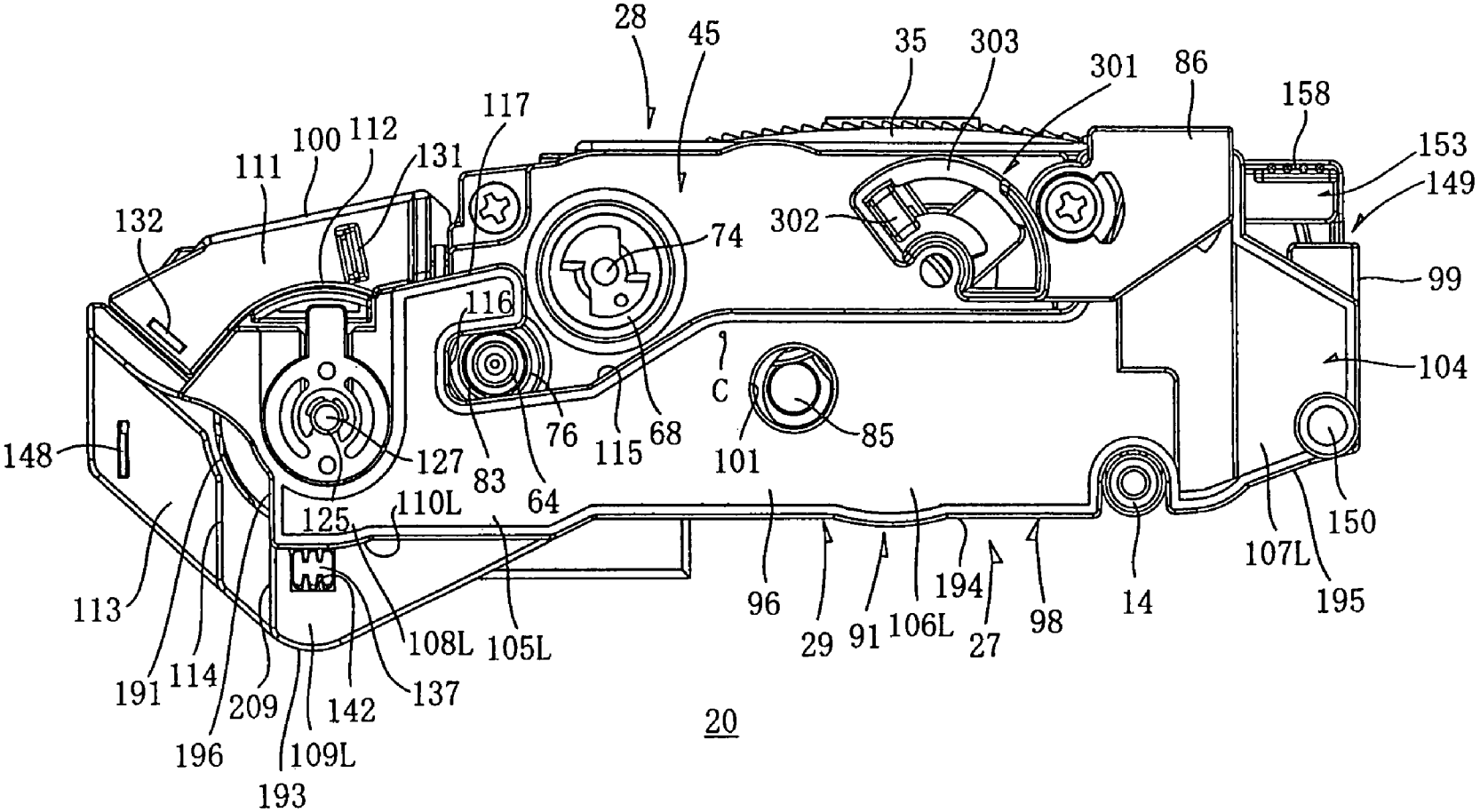
FIG. 17 is a left side view of the process cartridge shown in FIG. 3.
Figure 18:
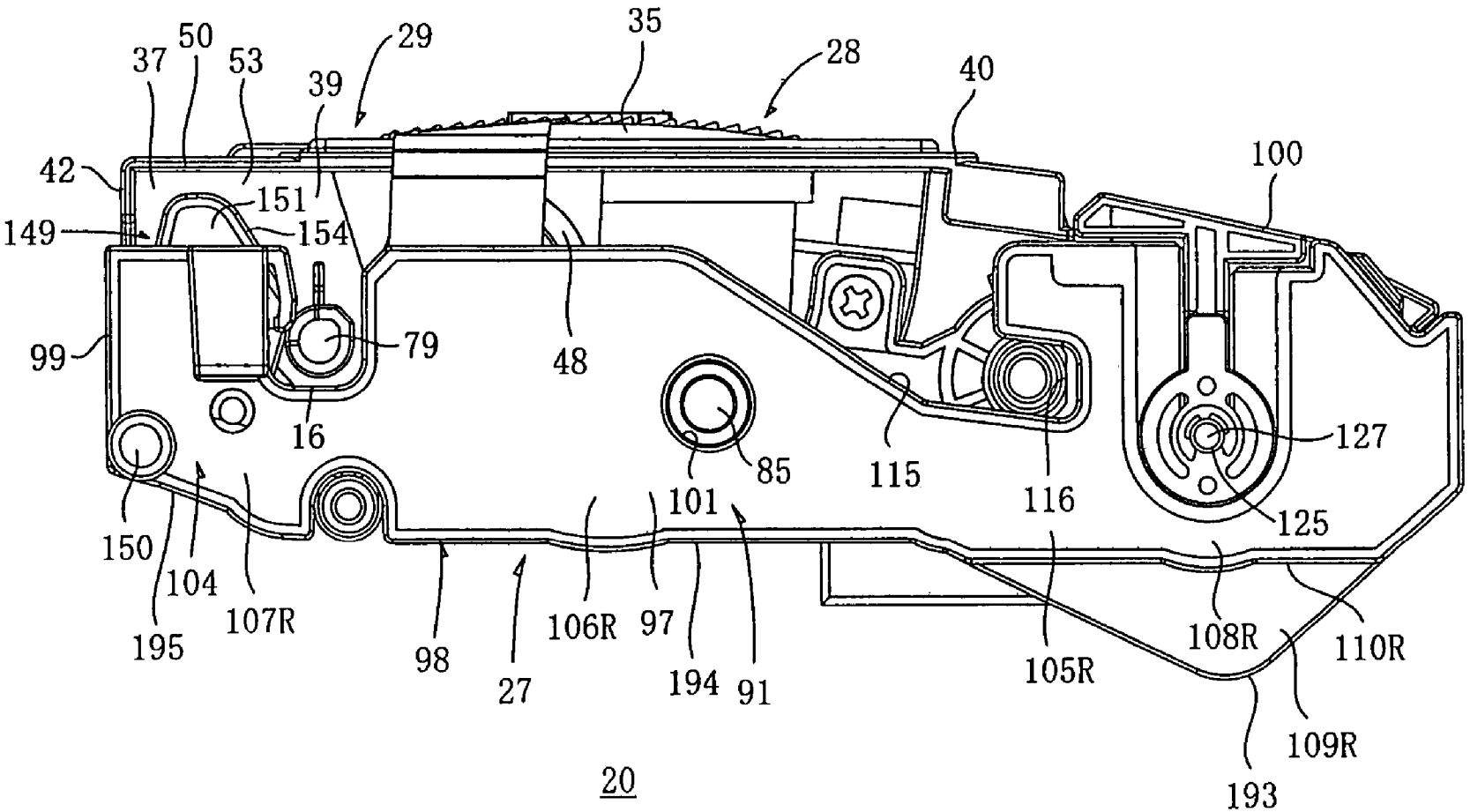
FIG. 18 is a right side view of the process cartridge shown in FIG. 3.

As illustrated in FIGS. 17 and 18, the second walls 109L, 109R may have inverted triangular-like shapes and at least a portion of the 'base' of the triangle-like shaped second walls 109L, 109R connects to the respective third walls 110L, 110R such that the second walls 109L, 109R extend downward from the respective third walls 110L, 110R. Bottom surfaces of the second walls 109L, 109R may each have a relatively rounded or pointed portion. As illustrated in FIG. 17, a thickness of each of the second walls 109L, 109R may be greatest at a substantially middle portion of the second walls 109L, 109R. The thickness of each of the second walls 109L, 109R may gradually decrease toward the front and back of the second walls 109L, 109R (i.e., to form an inverted triangle-like shape). The transfer roller 94 is accommodated between each of the second walls 109L, 109R. The thickest portion of each of the second walls 109L, 109R is substantially below the ground electrode 127 and the transfer electrode 137.

As discussed above, each of the third walls 110L, 110R connects the top portion of the respective second wall 109L, 109R to the bottom portion of the respective first wall 108L, 108R. The relatively pointed or rounded bottom edge of each of the second walls 109L, 109R corresponds to the bottom-most part of each of the back-side wall portions 105L, 105R.

The fourth wall 111 may have a concave bottom edge that generally corresponds to the shape of the corresponding portion of the photosensitive drum 92. The fourth wall 111 may be located above and to the right of the first wall 108L, and to the left of the second wall 109L. The top portion of the fourth wall 111 corresponds to the top portion of the back side wall portion 105L. A topmost edge of the fourth wall 111 is inclined with respect to horizontal so that a backmost end of the topmost edge of the fourth wall 111 is lower than a front most end of the topmost edge of the fourth wall 111.

The fifth wall 112 connects the top portion of the first wall 108L to the bottom portion of the fourth wall 111. The fifth wall 112 is substantially perpendicular to the first wall 108L and the fourth wall 111. The sixth wall 113 has a substantially rhombic-like shape, and extends in a plane substantially parallel to the first wall 108L and includes an innermost portion of the back-side wall portion 105L.

The seventh wall 114 connects a portion of the sixth wall 113 to the fourth wall 111 and further connects another portion of the sixth wall 113 to the second wall 109L. In exemplary embodiments, the seventh wall 114 substantially connects one side of the substantially rhombic shape of the sixth wall 113 to a back portion of the fourth wall 111 and further connects another side of the substantially rhombic shape of the sixth wall 113 to a back portion of the second wall 109L. In exemplary embodiments, the seventh wall 114 is substantially perpendicular to the first wall 108L.

As illustrated in FIG. 17, a portion of a photosensitive drum driving gear 191 extends out beyond the back of the first wall 108L. In the exemplary embodiment, a photosensitive drum gear opening 196 is provided between the third wall 110L and the fifth wall 112. The photosensitive drum gear opening 196 exposes part of the photosensitive drum driving gear 191.

Figure 19:
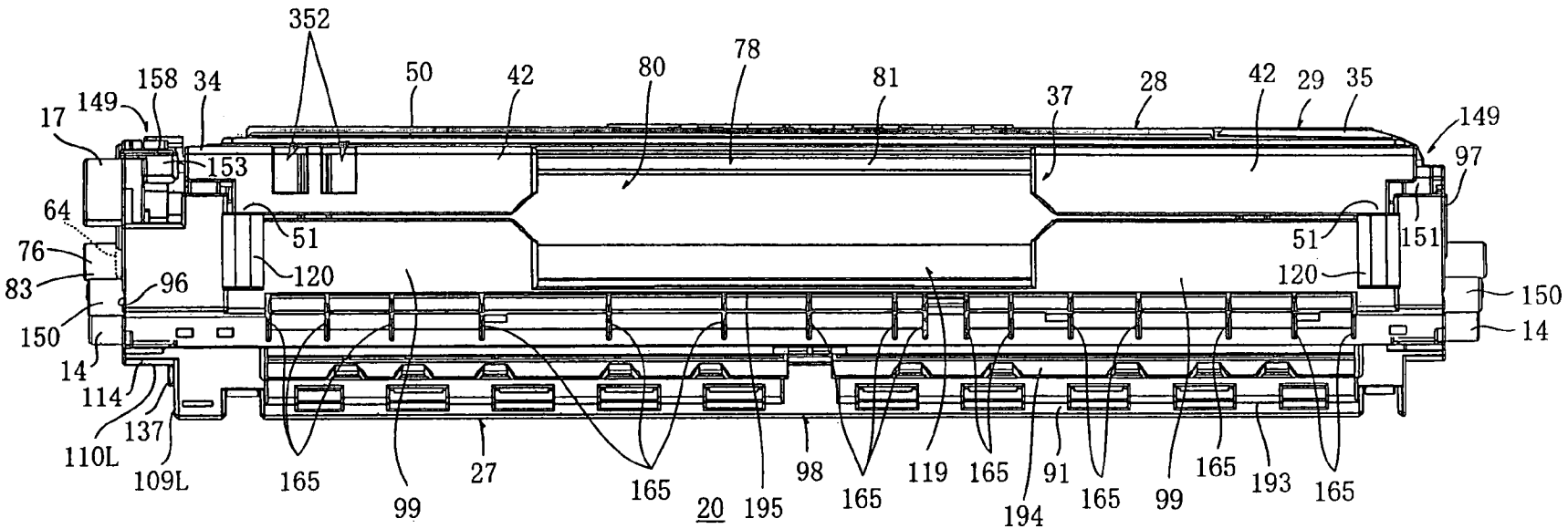
FIG. 19 is a front side view of the process cartridge shown in FIG. 3.
Figure 22:
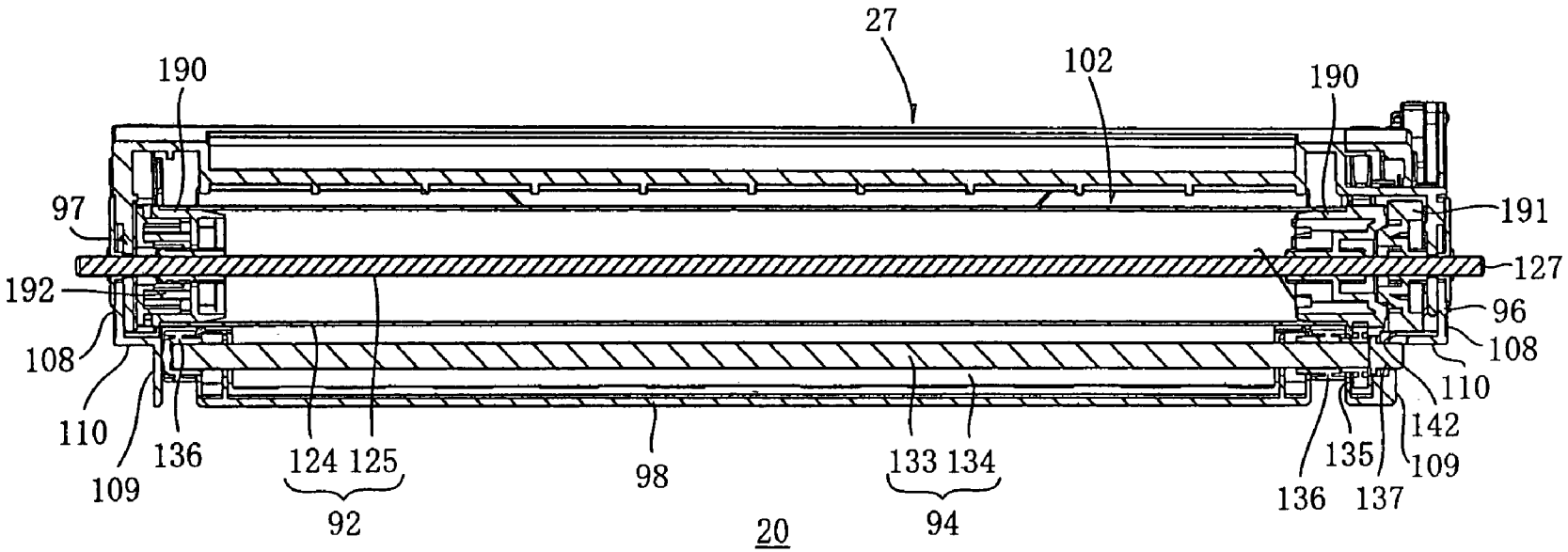
FIG. 22 is cross-sectional view of the drum cartridge shown in FIG. 11.

FIG. 18 is a right side view of the exemplary process cartridge 20 illustrated in FIG. 3. FIG. 19 is a front side view of the exemplary process cartridge 20 illustrated in FIG. 3. FIG. 22 is a cross-sectional view, along the width direction, of the exemplary drum cartridge 27 illustrated in FIG. 11.

As illustrated in FIGS. 18, 19 and 22, the back-side wall portion 105R of the right side wall 97 may be integrally provided with the first wall 108R, the second wall 109R and the third wall 110R. In exemplary embodiments, the shape of the first wall 108R of the back-side wall portion 105R of the right side wall 97 illustrated in FIGS. 17, 18 and 19 is different from the shape of the first wall 108L of the back-side wall portion 105L of the left side wall 96.

Further, the shape of the second wall 109R of the back-side wall portion 105R of the right side wall 97 substantially corresponds to the overall shape of the second wall 109L of the back-side wall portion 105L of the left side wall 96 and a bottom portion of the sixth wall 113 of the back-side wall portion 105L of the left side wall 96. The third wall 110R of the back-side wall portion 105R of the right side wall 97 connects the bottom portion of the first wall 108R of the back-side wall portion 105R of the right side wall 97 to the top portion of the second wall 109R of the back-side wall portion 105R of the right side wall 97.

FIGS. 11 and 12 illustrate that the front side wall portions 106L, 106R of the left side wall 96 and the right side wall 97 may include a shaft guiding portion 115 for respectively guiding left and right ends of the developer roller shaft 64 during attachment and detachment of the developer cartridge 28 to/from the drum cartridge 27. A developer roller shaft receiving portion 116 may be provided at a back end of the shaft guiding portion 115 and function as a stopping/regulating member for the ends of the developer roller shaft 64 being guided along the shaft guiding portion 115 when the developer cartridge 28 is being attached to the drum cartridge 27.

The shaft guiding portion 115 defines an upper boundary of the front side wall portion 106L, 106R of each of the left side wall 96 and the right side wall 97 of the drum cartridge casing 91. The shaft guiding portion 115 includes three portions arranged from front to back: a horizontal portion 115A, a first inclined portion 115B and a second inclined portion 115C. In exemplary embodiments, the first inclined portion 115B is more inclined with respect to horizontal than the second inclined portion 115C.

The developer roller shaft receiving portion 116 may be formed as a substantially sideways U-shaped notch formed by a projecting wall 117 that projects slightly upward from an upper portion of the back side wall portions 105R, 105L and overlaps a portion of the back of the shaft guiding portion 115 of each of the left side wall 96 and the right side wall 97.

As illustrated in FIG. 12, in exemplary embodiments, the extension wall portions 107L, 107R of the left side wall 96 and the right side wall 97 of the drum cartridge casing 91 may be formed continuously with, and in the same plane as, the respective front side wall portions 106L, 106R of the left side wall 96 and the right side wall 97.

Figure 15:
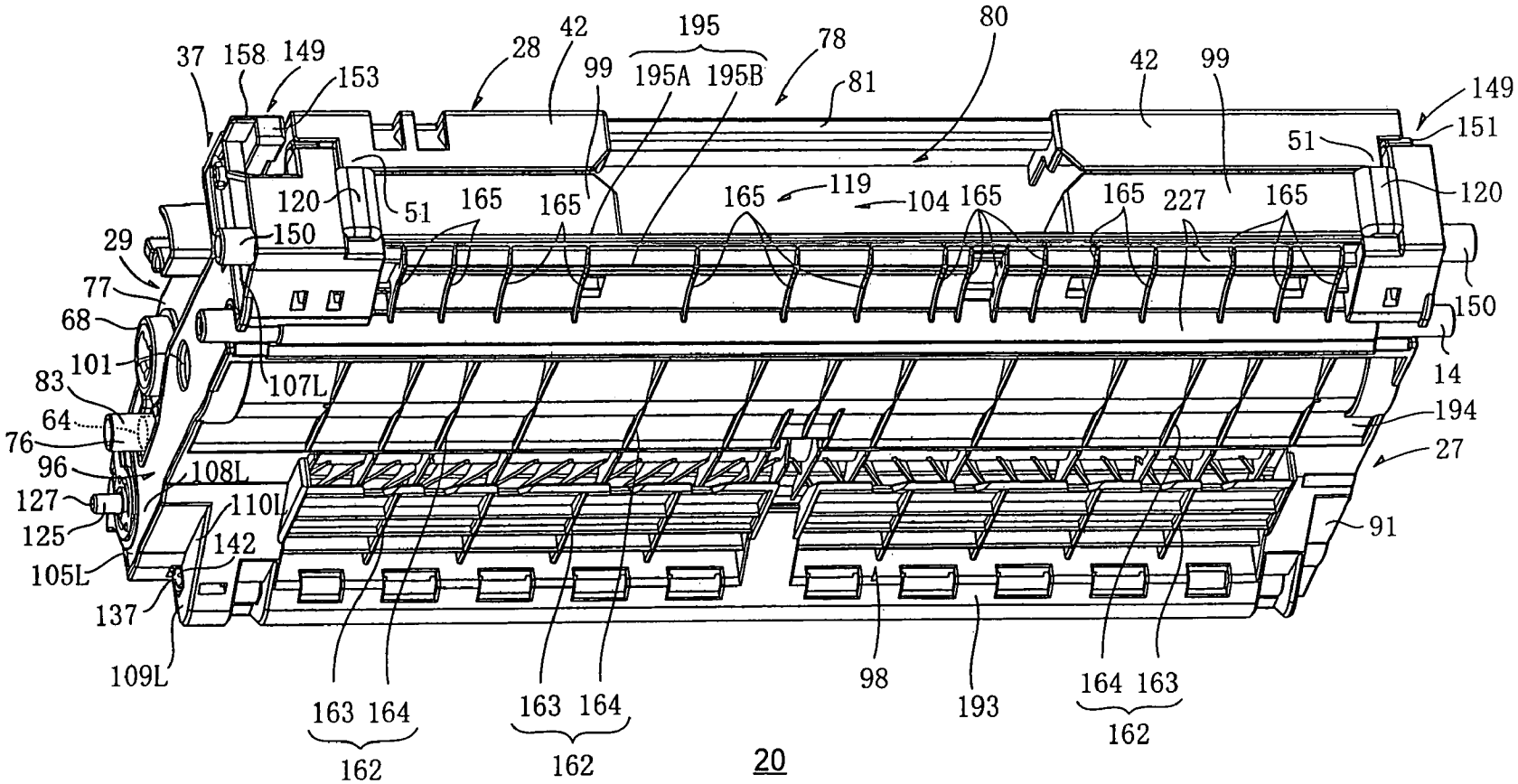
FIG. 15 is a bottom-front-left perspective view of the process cartridge shown in FIG. 3.
Figure 16:
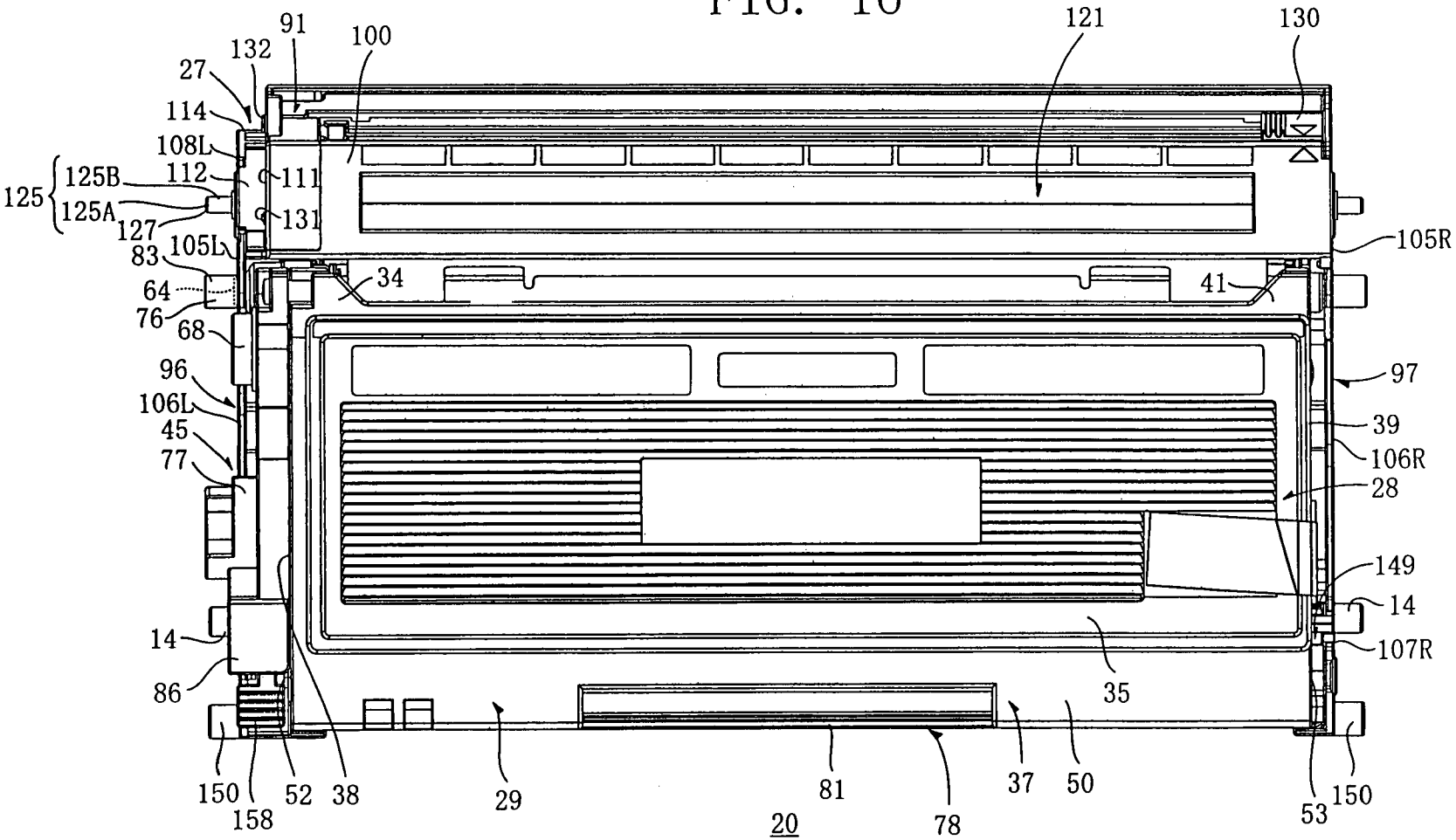
FIG. 16 is a plan view of the process cartridge shown in FIG. 3.

As illustrated in FIGS. 11 and 15, the bottom wall 98 of the drum cartridge casing 91 may be provided so as to be substantially sandwiched between the lower portion of each of the right side wall 97 and the left side wall 96. The bottom wall 98 may include a back bottom wall portion 193, a front bottom wall portion 194 and a bottom extension wall portion 195.

The back bottom wall portion 193 may, for example, connect the bottom portion of the second wall 109L of the left side wall 96 with the bottom portion of the second wall 109R of the right side wall 97 together. In exemplary embodiments, the back bottom wall portion 193 has a substantially V-like shape.

The bottom extension wall portion 195, the front bottom wall portion 194 and the back bottom wall portion 193 may be integrally connected. The bottom extension wall portion 195 may be substantially sandwiched between the extension wall portion 107L of the left side wall 96 and the extension wall portion 107R of the right side wall 97. The front bottom wall portion 194 may be substantially sandwiched between the front side wall portion 106L of the left side wall 96 and the front side wall portion 106R of the right side wall 97.

The drum cartridge casing 91 may include the lower front side wall 99 that extends upward substantially perpendicularly from a front edge of the bottom extension wall portion 195. The lower front side wall 99 and the bottom extension wall portion 195 may be formed so as to have a notch 119. The notch 119 may be formed at substantially central portion of the lower front side wall 99 in the width direction.

In some embodiments, the lower front side wall 99 may have the notch 119 formed therein, while the bottom extension wall portion 195 may extend across substantially all of the length and the width of the lower extension portion 104 such that the notch 119 cannot be seen when viewed from the bottom of the drum cartridge 27.

In other embodiments, the bottom extension wall portion 195 may be in the form of multiple layers including a first layer 195A formed integrally with the front bottom wall portion 194 and a second layer 195B that may be attached to and detached from the first layer 195A. In such a case, the first layer 195A of the bottom extension wall portion 195 may have the notch 119 formed in the first layer 195A while the second layer 195B extends along the length direction from the front side of the upper resist roller 14 to the front end of the notch 119 of the first layer 195A and, along the width direction, across the width of the notch 119 and at least a part of the first layer 195A. The second layer 195B may be attachable to and detachable from the first layer 195A.

As shown in FIG. 12, the left and right sides of the lower front side wall 99 may be continuously formed with the left side wall 96 and the right side wall 97, respectively. As shown in FIG. 13, the lower front side wall 99 aligns with the upper front side wall 42 in the up/down direction when the developer cartridge 28 is attached to the drum cartridge 27. In exemplary embodiments, the front surface of the lower front side wall 99 has a flat-plate-like shape.

As shown in FIG. 13, the notch 119 may provided in the lower front side wall 99 of the drum cartridge casing 91 at a portion corresponding to the notch 80 in the upper-front side wall 42 of the developer cartridge casing 29, when the developer cartridge 28 is attached to the drum cartridge 27. In exemplary embodiments, the notch 119 is substantially rectangular in shape, as shown in FIG. 12. When the developer cartridge 28 is attached to the drum cartridge 27, a substantially rectangular-shaped opening is formed by the combination of the notch 80 in the upper front side wall 42 and the notch 119 in the lower front side wall 99.

As shown in FIG. 12, on the right and left ends of the lower front side wall 99, receiving portions 120 may be formed. The receiving portion 120 of the lower front side wall 99 receives the respective protruding member 51 that protrudes from the upper front side wall 42 of the developer cartridge casing 29, as discussed above. In exemplary embodiments, the respective receiving portions 120 are defined by forward projecting groove-like portions in the lower front side wall 99.

As shown in FIGS. 12 and 13, the protruding members 51 may be received by the corresponding receiving portion 120 when the developer cartridge 28 is attached to the drum cartridge 27.

Turning now to the back of the drum cartridge 27, as shown in FIG. 11, the drum cartridge 27 may include the upper back side wall 100 that extends along the width direction so as to connect the upper portions of the respective back-side wall portions 105L, 105R of the left side wall 96 and the right side wall 97. The upper back side wall 100 has a substantially flat-plate-like shape and is inclined with respect to horizontal so that the front end of the upper back side wall 100 is higher than the back end of the upper back side wall 100.

The upper back side wall 100 may include, in the front portion thereof, a substantially rectangular-shaped laser incident window 121 that extends in a width direction of the exemplary drum cartridge 27. On the upper back side wall 100, a charger support member(s) 122, which supports the charger 93, and a brush supporting member(s) 123, which supports the cleaning brush 95 may be provided.

As shown in FIGS. 11 and 12, the drum cartridge casing 91, the respective back-side wall portions 105L, 105R of the left side wall 96 and the right side wall 97 are connected by the upper back side wall 100, and the back bottom wall portion 193 of the bottom wall 98. The back bottom wall portion 193 may be arranged substantially opposite to the upper back side wall 100 in the up/down direction to define at least a portion of the drum housing portion 102.

The drum housing portion 102 may be provided at the back end of the drum cartridge casing 91 and may be a substantially closed space. As shown in FIGS. 11 and 12, the drum housing portion 102 has a substantially open front side while the upper, back and lower sides of the drum housing portion 102 are substantially closed. The substantially open front side allows the photosensitive drum 92 to attach to and/or contact other components. At least a portion of the photosensitive drum 92 is exposed from the open front side of the drum housing portion 102.

The front side wall portion 106L of the left side wall 96, the front side wall portion 106R of the right side wall 97, and the front bottom wall portion 194 of the bottom wall 98 form the developer cartridge housing portion 103. The developer cartridge housing portion 103 may be provided at a substantially center portion of the drum cartridge casing 91. The developer cartridge housing portion 103 is open at a top side thereof and, in exemplary embodiments, the developer cartridge 28 may be attached to the drum cartridge 27 by placing the developer cartridge 28 in the developer cartridge housing portion 103.

As discussed above, the drum cartridge casing 91 includes the lower extension portion 104. The lower extension portion 104 may extend from the front side of the developer cartridge housing portion 103, while the drum housing portion 102 may extend from the back side of the developer cartridge housing portion 103. The extension wall portion 107L of the left side wall 96, the extension wall portion 107R of the right side wall 97, the bottom extension wall portion 195 of the bottom wall 98, and the lower front side wall 99 form the exemplary lower extension portion 104.

As illustrated in FIGS. 11 and 12, the lower extension portion 104 defines a space that extends from the developer cartridge housing portion 103 to the front side of the drum cartridge casing 91. In exemplary embodiments, the lower extension portion 104 is continuous with the developer cartridge housing portion 103, and the top side of the lower extension portion 104 is open.

As shown in FIG. 11, the front bottom wall portion 194 may include a first portion 194A and a second portion 194B arranged in a step-like manner. An opening 332, through which the sheet 3 may enter and pass, is formed between the first portion 194A and second portion 194B. An upper surface 194D of the second portion 194B may be inclined with respect to the first portion 194A. Further, the upper surface 194D of the second portion 194B may include a sloped plate-like portion 331, even further inclined with respect to the first portion 194A, on a front most end of the second portion 194B.

As shown in FIG. 12, the upper surface 194D of the second portion 194B may include a plurality of paper guiding ribs 194C. The paper guiding ribs 194C may extend substantially in the length direction and spaces may exist between adjacent ones of the paper guiding ribs 194C.

Further, as shown in FIG. 12, in some embodiments, a paper guide film 333 is provided at the back end portion of the sloped plate portion 331. As shown in FIG. 12, the paper guide film 333 may be provided, for example, as two portions that sandwich an area having a predetermined width at the center of the back end portion of the sloped plate portion 331. By providing the paper guide film 333, the sheet 3 that enters the drum cartridge 27 from the opening 332 advances along the paper guide film 333, and the leading end of the sheet 3 contacts the peripheral surface of the photosensitive drum 92. The leading end of the sheet 3 is directed between the photosensitive drum 92 and the transfer roller 94 based on the rotation of the photosensitive drum 92. By directing the sheet 3 between the photosensitive drum 92 and the transfer roller 94 after the sheet 3 contacts the photosensitive drum 92, the possibility the sheet 3 adversely affecting the charge of the photosensitive drum 92 is reduced, and preferably eliminated.

As shown in FIG. 11, the photosensitive drum 92 is arranged within the drum housing portion 102. This photosensitive drum 92 has a cylindrical shape and includes a drum body 124 that may be formed of a positively charged photosensitive layer and a drum shaft 125 that may be made of metal. The outermost surface layer of the photosensitive drum 92 may be composed of polycarbonate.

In exemplary embodiments, the drum shaft 125 and the drum body 124 extend in the width direction of the drum cartridge 27. The drum shaft 125 extends along an axial center of the drum body 124, as illustrated in FIG. 22.

The drum shaft 125 is unrotatably supported by the left side wall 96 and the right side wall 97 of the drum cartridge casing 91 while rotation support members 190 are provided at the left and right end portions of the drum body 124. The rotation support members 190 are rotatably supported by the drum shaft 125 such that the drum body 124 and the rotation support members 190 are rotatable with respect to the drum shaft 125.

Figure 14:
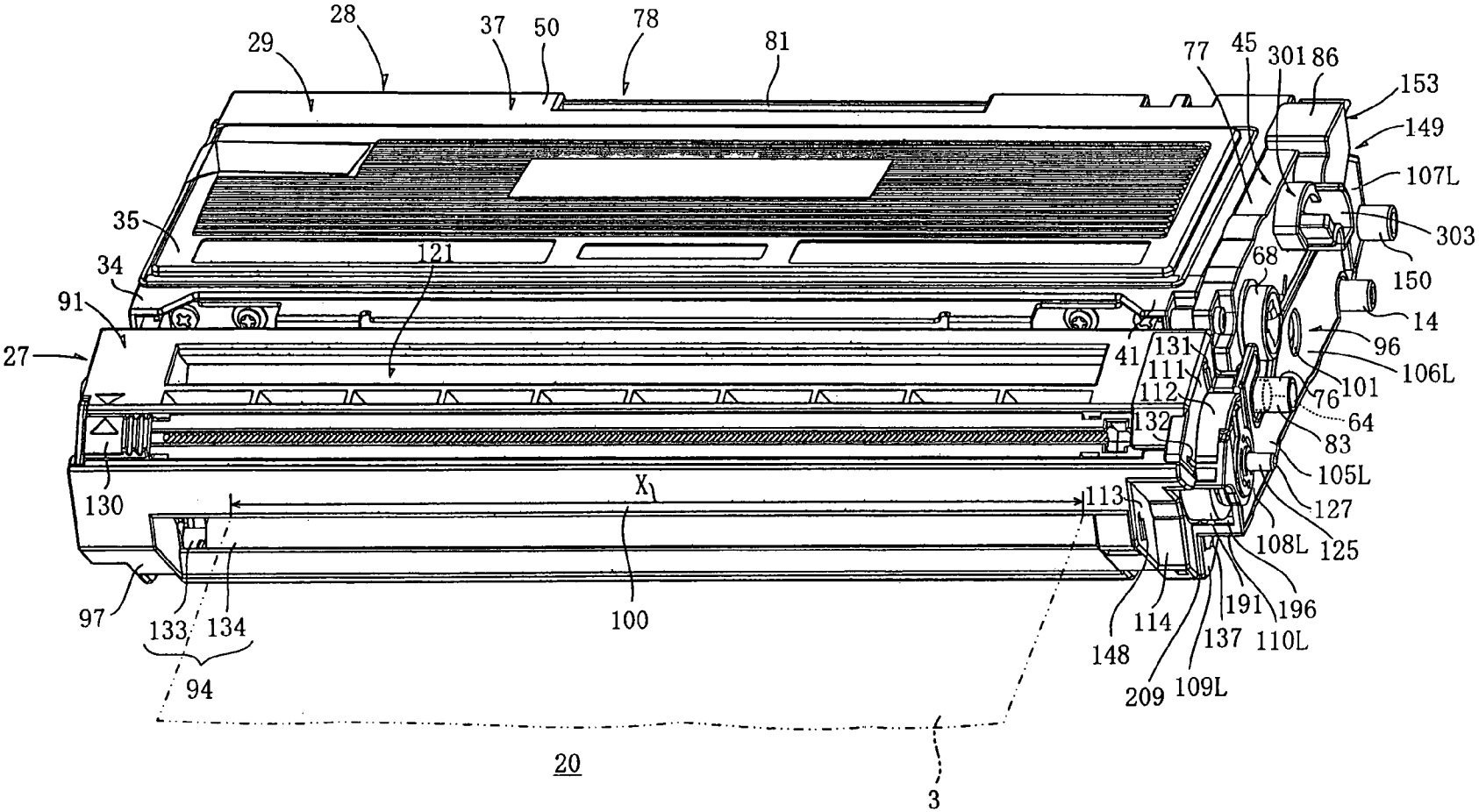
FIG. 14 is a back-top-left perspective view of the process cartridge shown in FIG. 3.

As illustrated in FIGS. 14 and 17, the left end of the drum shaft 125 protrudes from the first wall 108L of the left side wall 96. The outermost surface 125A of the left end portion 125B of the drum shaft 125 functions as a ground electrode 127. The ground electrode 127, as a photosensitive member electrode, contacts a ground electrode contacting portion 171 provided in the main casing 2.

Additionally, the photosensitive drum driving gear 191, which is rotatably supported about the drum shaft 125, is connected to the left end of the drum body 124 so as to be integrally rotatable with the drum body 124. That is, the photosensitive drum driving gear 191 is not rotatable with respect to the drum body 124. As discussed above, and as illustrated in FIG. 14, the photosensitive drum driving gear 191 is exposed from the photosensitive drum gear opening 196.

In exemplary embodiments, a compressed spring 192 is provided on the right end of the drum body 124. The compressed spring 192 may be provided between the right side wall 97 and the rotation support member 190 on the right end of the drum body 124. The compressed spring 192 causes a frictional resistance to be applied against the rotation of the drum driving gear 191 such that over-rotation of the drum body 124 is reduced, and preferably prevented.

As shown in FIG. 11, the charger 93 may be arranged within the drum housing portion 102 and may be supported by the charger support member(s) 122. The charger support member(s) 122 may be provided in the upper-back side of the photosensitive drum 92. As discussed above, the charger 93 may be provided along the upper back side wall 100. The charger 93 is spaced apart from the photosensitive drum 92 so as not to contact the photosensitive drum 92. The charger 93 includes a wire 128, a grid 129, and a wire cleaner 130.

The charger support member 122 may also support the wire 128. The wire 128 extends between the left side wall 96 and the right side wall 97. A wire electrode 131 is connected to the left end of the wire 128 and may be made, for example, from a member of sheet metal. As illustrated in FIGS. 14 and 17, the wire electrode 131 is fixed so as to be exposed to the outside of the drum cartridge casing 91 from a first slit 111A extending in the up/down direction in the fourth wall 111 of the left side wall 96.

The grid 129 may be arranged so as to extend below the wire 128 between the left side wall 96 and the right side wall 97 along the width direction of the drum cartridge 28. A grid electrode 132 made from a member of sheet metal, may be attached to the left end of the grid 129. The grid electrode 132 may be fixed so as to be exposed to the outside of the drum cartridge 28 from a second slit 111B in the fourth wall 111 of the left side wall 96. In the exemplary embodiment shown in FIGS. 14 and 17, the second slit 111B for the grid electrode 132 in the fourth wall 111 extends diagonally such that a top end of the grid electrode 132 is closer to the back of the drum cartridge 27 than a bottom end of the grid electrode 132.

The charger support member(s) 122 may also support the wire cleaner 130. The wire cleaner 130 may substantially sandwich the wire 128 and be slidably supported along the width direction of the drum cartridge 27. By sliding the wire cleaner 130 along the width direction of the drum cartridge 27, the wire 128 can be cleaned.

In the drum housing portion 102, the transfer roller 94 may also be arranged below the photosensitive drum 92. The transfer roller 94 may include a transfer roller shaft 133 made of metal, and a roller 134 made of an ion conductive rubber material that covers at least a portion of the periphery of the transfer roller shaft 133.

Figure 23A:
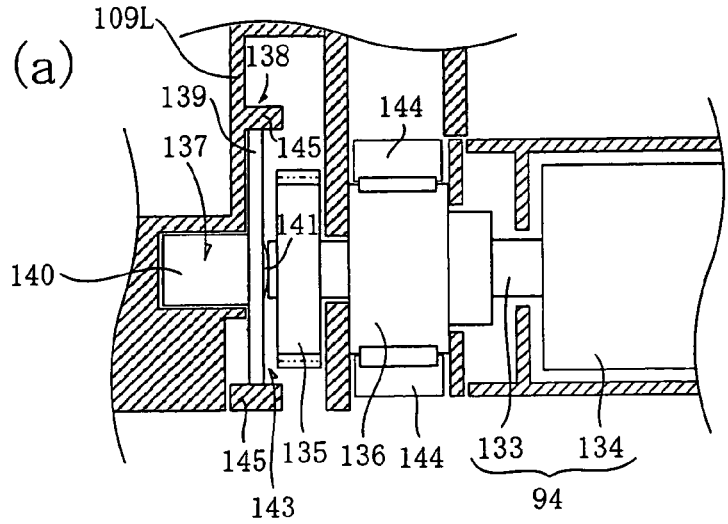
FIGS. 23(*a*), 23(*b*) and 23(*c*) are partial views of the drum cartridge shown in FIG. 11 emphasizing a left end portion of an exemplary transfer roller.
Figure 23B:
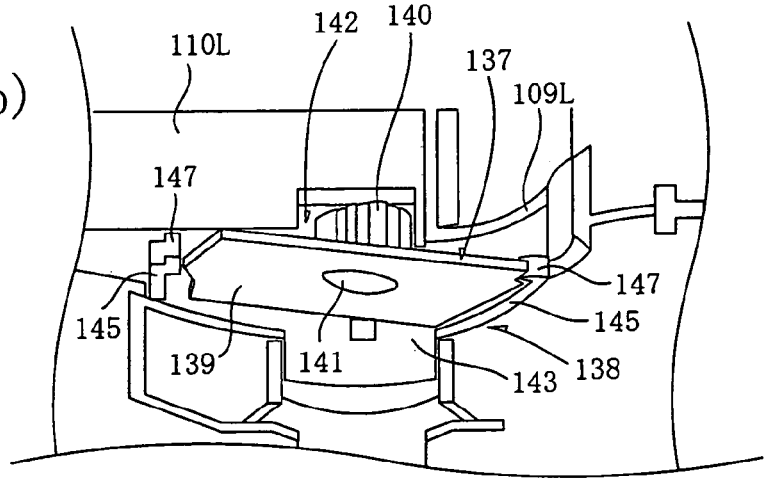
Figure 23C:
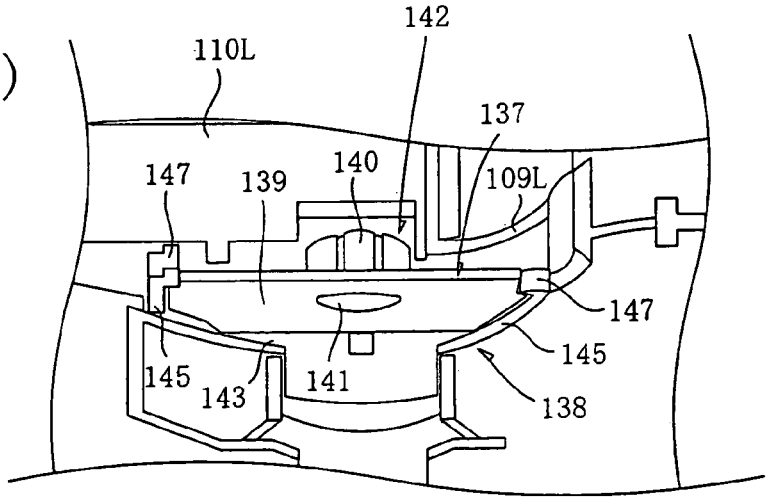

FIGS. 23(*a*), 23(*b*) and 23(*c*) illustrate the left end of the exemplary transfer roller 94 of the exemplary drum cartridge 27 illustrated in FIG. 11. More particularly, FIG. 23(*a*) illustrates a cross-sectional diagram along the width direction, FIG. 23(*b*) illustrates a perspective view in a state where a transfer electrode 137 is being attached to the drum cartridge 27, and FIG. 23(*c*) illustrates a perspective view where the transfer electrode 137 is attached to the drum cartridge 27.

As shown in FIG. 23(*a*), at the left end of the transfer roller shaft 133, a transfer roller driving gear 135 may be arranged. In exemplary embodiments, the transfer roller driving gear 135 is not rotatable with respect to the transfer roller shaft 133. A bearing member 136 may be provided at both the left and right ends of the transfer roller shaft 133. One of the bearing members 136 may be arranged adjacent to an inner side of transfer roller driving gear 135. The bearing members 136 are rotatable with respect to the transfer roller shaft 133 and the transfer roller driving gear 135. Each of the bearing members 136 may be supported by a bearing support member 144 provided on the bottom wall 98 of the drum cartridge casing 91.

The bearing support members 144 may be in the form of one or more ribs and/or grooves. In exemplary embodiments, the rib of each of the bearing support members 144 extends substantially perpendicular to the axis of rotation of the transfer roller shaft 133 along the inner surface of the bottom wall 98. The right and left ends of the transfer roller shaft 133 may each be rotatably supported by one of the bearing members 136 that is supported by one or more of the bearing support members 144 on the bottom wall 98.

The transfer electrode 137 is supported by a transfer electrode holding portion 138 of the drum cartridge casing 91. As shown in FIG. 23(*a*), in exemplary embodiments, the left end of the transfer roller shaft 133 projects through the bearing member 136 on the left side and the transfer roller driving gear 135 and contacts the electrode contacting portion 141 of the transfer electrode 137 supported by the transfer electrode holding portion 138 of the drum cartridge casing 91. Thus, the transfer roller shaft 133 may be arranged, for example, such that it extends between the bearing member 136 on the right side and the transfer electrode 137 on the left side of the drum cartridge casing 91.

The transfer electrode 137 may be made of a conductive resin material and may integrally include an engaging member 139, a protruding portion 140, and an electrode contacting portion 141 as shown in FIGS. 23(*b*) and 23(*c*). The electrode contacting portion 141 may project away from a substantially central portion of the inner surface of the engaging member 139. As illustrated in FIG. 23(*a*), the electrode contacting portion 141 bulges out from the inner surface of the engaging member 139. The transfer electrode 137 contacts the end surface of the left end portion of the transfer roller shaft 133 via the electrode contacting portion 141. The engaging member 139 may be a plate-like member that supports the protruding portion 140.

In some embodiments, the engaging member 139 may be integrally formed with the protruding member 140. In exemplary embodiments, a transfer electrode opening 142 is a continuous opening formed by a substantially rectangular cutout in each of the second wall 109L and third wall 110L of the left side wall 96, as illustrated in FIG. 15. More particularly, as shown in FIGS. 23(*b*)-(*c*), the cutout in the third wall 110L may, for example, be smaller than the cutout in the second wall 109L and slightly larger than the protruding portion 140 such that the protruding portion 140 does not contact the third wall 110L when the transfer electrode 137 is being attached to the drum cartridge casing 91. The cutout in the second wall 109L defines the transfer electrode holding portion 138.

The transfer electrode holding portion 138 of the drum cartridge casing 91 may include a transfer electrode receiving portion 143, as a receiving portion, for receiving the transfer electrode 137 in the transfer electrode opening 142. In exemplary embodiments, the transfer electrode receiving portion 143 receives the engaging member 139. More particularly, in exemplary embodiments, to attach the transfer electrode 137, the transfer electrode 137 is inserted from inside the drum cartridge casing 91 and guided into the transfer electrode holding portion 138 where the transfer electrode 137 engages with the transfer electrode receiving portion 143, as discussed below.

As shown in FIG. 15, the transfer electrode opening 142 is formed to be of a shape and size that allows the protruding portion 140 to be passed through the third wall 110L when the transfer electrode 137 is inserted into the transfer electrode holding portion 138 of the second wall 109L.

Further, when the transfer electrode 137 is engaged by the transfer electrode receiving portion 143, the transfer electrode opening 142 remains open because, as discussed above, the transfer electrode opening 142 is provided to allow the protruding portion 140 to pass the third wall 110L when the transfer electrode 137 is attached to the drum cartridge casing 91. After the protruding portion 140 passes the third wall 110L, the transfer electrode opening 142 is open (i.e., not covered).

Thus, the transfer electrode 137 is engaged in the transfer electrode receiving portion 143, as discussed below, such that the transfer electrode 137 does not slide up and/or out of the transfer electrode opening 142 and the transfer electrode receiving portion 143 during operation of the laser printer 1.

The transfer and the transfer electrode receiving portion 143 electrode receiving portion 143 may include, for example, two engaging ribs 145 positioned facing each other on each side of the transfer electrode opening portion 142. An engaging rib 145 may be provided on the front side of the transfer electrode opening 142 and another engaging rib 145 may be provided on the back side of the transfer electrode opening 142.

As illustrated in FIGS. 23(*b*) and (*c*) each engaging rib 145 may include a claw portion 147 at an end thereof. The claw portion 147 may have a hook-like shape. The claw portion 147 helps secure the transfer electrode 137 in the transfer electrode receiving portion 143 such that the transfer electrode 137 does not slide or move out from the transfer electrode receiving portion 143.

In exemplary embodiments, the transfer electrode 137 is arranged in the transfer electrode holding portion 138, as follows. As shown in FIG. 23(*b*), first, the engaging member 139, including the protruding portion 140, is positioned at the transfer electrode receiving portion 143 of the drum cartridge casing 91 by moving the engaging member 139 in a direction substantially perpendicular to the third wall 110L.

When the engaging member 139 is arranged in the transfer electrode receiving portion 143, the protruding portion 140 protrudes from the transfer electrode opening portion 142 in the width direction orthogonal to the second wall 109L. One end of the engaging member 139 is then engaged with the claw portion 147 of one of the corresponding engaging ribs 145. Then, as illustrated in FIG. 23(*c*), the engaging member 139 is rotated such that the other end of the engaging member 139 can be engaged with the claw portion 147 of the other engaging rib 145.

When the transfer electrode 137 is received by the transfer electrode receiving portion 143 and held at the transfer electrode holding portion 138, the protruding portion 140 protrudes from the transfer electrode opening 142 outwardly in the width direction so that rotation of the engaging member 139 is regulated, and preferably prevented, by the engagement of the engaging member 139 in the engaging ribs 145.

As shown in FIG. 23(*a*), when the transfer electrode 137 is received by the transfer electrode receiving portion 143, an end surface of the left end of the transfer roller shaft 33 slidably contacts the electrode contacting portion 141. In this state, the transfer roller driving gear 135 is arranged such that there is a gap between an outer surface of the transfer roller driving gear 135 and the second wall 109L in the axial (width) direction so that the transfer roller driving gear 135 may be free to rotate within the drum cartridge casing 91.

As shown in FIG. 11, the cleaning brush 95 may be positioned in the drum housing portion 102 and held by the brush supporting members 123. The brush supporting members 123 may be provided on the upper back side wall 100 at both the left and right sides of the drum cartridge casing 91 behind the photosensitive drum 92.

The cleaning brush 95 includes many brush hairs planted on a substantially rectangular bar shaped holding plate that extends along the width direction. The cleaning brush 95 may be positioned such that it lies facing the photosensitive drum 92 along the length direction. The brush hairs contact the peripheral surface of the photosensitive drum 92 such that the peripheral surface of the photosensitive drum 92 can be cleaned. A cleaning electrode 148 made, for example, from a member of sheet metal is connected to the brush supporting member 123 on the left side. The cleaning electrode 148 is fixed to the brush supporting member 123 such that it projects outward from the left side of the drum cartridge 27. In exemplary embodiments, the cleaning electrode 148 projects from a substantially vertical slit formed in the sixth wall 113 of the left side wall 96, as shown in FIGS. 14 and 17.

In the exemplary developer cartridge housing portion 103, protruding portions 118, as discussed above, may be provided. In exemplary embodiments, each protruding portion 118 contacts one of the positioning members 84 of the developer cartridge 28. As shown in FIG. 12, in exemplary embodiments, a space exists between the two protruding portions 118 along the width direction. The two protruding portions 118 are provided on the front bottom wall portion 194. As shown in FIG. 3, each protruding portion 118 is positioned to face one of the positioning members 84 of the developer cartridge 28 when the developer cartridge 28 is attached to the drum cartridge 27. Each protruding portion 118 has a substantially convex upward projecting shape.

In some embodiments, the protruding portions 118 may be provided on the developer cartridge 28 while the positioning members 84 are provided on the drum cartridge 27.

As shown in FIG. 15, bottom ribs 162, as a guide portion for guiding the sheet 3 are also provided in the developer cartridge housing portion 103. The bottom ribs 162 protrude downward from the bottom surface of the front bottom wall portion 194. The bottom ribs 162 may include a plurality of back bottom ribs 163 and a plurality of middle bottom ribs 164.

The back bottom ribs 163 extend substantially in the length direction. Gaps exist between adjacent back bottom ribs 163 in the width direction. The plurality of middle bottom ribs 164 may be positioned more towards the front than the back bottom ribs 163 and may extend substantially in the length direction. Gaps exist between adjacent middle bottom ribs 164 in the width direction.

As shown in FIG. 12, in the developer cartridge housing portion 103, toner detecting openings 101, through which light from the developing agent low/empty sensor 371 may pass, are provided on facing portions of each of the left side wall 96 and the right side wall 97. The position of the toner detecting openings 101 on each of the left side wall 96 and the right side wall 97 of the drum cartridge 27 corresponds to the position of the toner detecting windows 85 on the left side wall 38 and the right side wall 39 of the developer cartridge 28, as discussed above.

Thus, at least a portion of each of the toner detecting windows 85 and the toner detecting openings 101 are aligned such that light emitted from one side (e.g., left or right side) may pass through each set of the toner detecting windows and/or openings 85, 101 and be detected at the other side at least when the toner level is below a predetermined amount.

As discussed above, when the developing agent low/empty sensor 371 determines that the amount of toner is below the predetermined amount, in some embodiments, the image forming device may provide a signal indicating that the toner supply is empty or running low and/or may stop functioning until the toner supply is replenished.

Even when the toner level is higher than a predetermined amount/level, some of the light emitted from one side may pass through the toner detecting windows and/or openings 85, 101 and be received at the other end. Thus, the toner developing agent low/empty sensor 371 may be set to trigger the toner low/empty signal if more than a predetermined amount of light is detected at the other side.

As shown in FIG. 12, the lower extension portion 104 may include a pressing portion 149 and a drum cartridge boss 150. The drum cartridge boss 150 helps guide and arrange the exemplary drum cartridge 27 and/or the process cartridge 20 in the main casing 2 of the exemplary laser printer 1. In the exemplary drum cartridge 27, the drum cartridge boss 150 projects from the extension wall portion 107L, 107R of each of the left side wall 96 and right side wall 97.

As shown in FIGS. 12 and 17, the drum cartridge bosses 150 may have a cylindrical shape and may be provided such that they respectively protrude from the extension wall portions 107L, 107R of the left side wall 96 and the right side wall 97. The drum cartridge bosses 150 may respectively protrude outward, along the width direction, from the outer surface of the lower-front portions of each extension wall portion 107L, 107R.

The pressing portion 149 helps press the developer roller 32 towards the photosensitive drum 92 when the developer cartridge 28 is attached to the developer cartridge housing portion 103 of the drum cartridge 27. In the exemplary embodiment illustrated in FIG. 12, one pressing portion 149 is provided at each of the left and right sides of the lower extension portion 104.

In some embodiments, one pressing portion 149 may be provided while in other embodiments, more than one pressing portion 149 may be provided. Further, in some embodiments including more than one pressing portion 149, different types of pressing portions may be provided. In some embodiments, a lock lever 153, as a lock means, for locking or securing the developer cartridge 28 to the drum cartridge 27 after attachment of the developer cartridge 28 to the developer cartridge housing portion 103 of the drum cartridge 28 may be provided. In some embodiments, the developer cartridge 28 is released from the drum cartridge 27 by pressing and/or pulling the lock lever 153.

FIGS. 21(*a*), 21(*b*), 21(*c*) and 21(*d*) compose a general process diagram illustrating a process of arranging/attaching the exemplary developer cartridge 28 illustrated in FIG. 4 with the exemplary drum cartridge 27 illustrated in FIG. 11 in order to form the exemplary process cartridge 20 illustrated in FIG. 3. In the exemplary embodiment illustrated in FIG. 21, the cover extension portion 86 is not shown.

FIG. 21(*a*) illustrates a state where the developer cartridge boss 79 is positioned at an upper side of the pressing portion 149. FIG. 21(*b*) illustrates a state where the developer cartridge boss 79 is contacting an exemplary guiding surface 154 of the pressing portion 149. FIG. 21(*c*) illustrates a state where the developer cartridge boss 79 is contacting a border between the guiding surface 154 and a fixing surface 155 of the pressing portion 149. FIG. 21(*d*) illustrates a state where the developer cartridge boss 79 is contacting the fixing surface 155 of the pressing portion 149.

As shown in FIGS. 21(*a*)-(*d*), each pressing portion 149 may be provided with a pressing member 151 that engageably and disengageably contacts the respective developer cartridge boss 79 when the exemplary developer cartridge 28 is attached/arranged in and detached/removed from the exemplary drum cartridge 27. A spring 152, as an urging means, may be provided below each pressing member 151 so as to press the pressing member 151 up against the corresponding developer cartridge boss 79 on the left and right sides of the drum cartridge 27.

The pressing member 151 may be made from a thick, plate-like member having a triangular-like shape, when viewed from a left or right side of the plate-like member. In exemplary embodiments, the guiding surface 154 and the fixing surface 155 are continuously formed.

The guiding surface 154 may incline downward such that a front portion of the guiding surface 154 is at a higher level than a back portion of the guiding surface 154. The fixing surface 155 projects substantially downward and towards the front of the drum cartridge 27 from the guiding surface 154. Thus, the exemplary pressing member 151 may have the guiding surface 154 that extends substantially down and back, and the fixing surface 155 that extends substantially down and front such that the guiding surface 154 and the fixing surface 155 form an obtuse angle. The guiding surface 154 and the fixing surface 155 both face the back of the drum cartridge casing 91.

The pressing member 151 may be mounted to the drum cartridge casing 91 by a mounting/attaching portion 156 that attaches the lower end of the pressing member 151 to the drum cartridge casing 91. The lower end of the mounting/attaching portion 156 may be held movably by a fixing shaft 157 that protrudes inward (i.e., toward the inside of the drum cartridge casing 91) and substantially in the width direction, from the extension wall portion 107L, 107R of both the left side wall 96 and the right side wall 97.

One end of each spring 152 may be fixed to a lower front portion of the bottom extension wall portion 195. The other end of each spring, as discussed above may be engaged by or pressed against a bottom surface of the pressing member 151. As shown in FIGS. 21(*a*)-21(*d*), in exemplary embodiments, in the various states of the attachment/detachment process, due to the force exerted by the spring 152 and the arrangement of the spring 152 in the drum cartridge casing 91, the corresponding pressing member 151 is urged to maintain a reclined state such that the spring 152 is closer to the front of the drum cartridge 27 than the pressing member 151.

As illustrated in FIG. 13, the lock lever 153 may be provided on the left end of the lower extension portion 104. The exemplary lock lever 153 may be provided close to the pressing member 151. The lock lever 153 may have a base portion with two legs projecting from the base portion where one of the legs is a flexible member 159 extending substantially perpendicularly from one end of the base portion while the other leg is a control member 158 that extends substantially diagonally away from the other end of the base portion.

The control member 158 may be used to move or control the lock lever 153 in order to release the developer cartridge 28 from the drum cartridge 27. To help release the lock lever 153, the control member 158 may include a gripping portion (e.g., a ribbed larger/wider area of the control member 158 in FIGS. 12 and 21(*a*)-(*d*)) at one end of the control member 158.

The base portion of the lock lever 153 may form a contact portion 161 that contacts and "locks" the developer cartridge boss 79 into place. One side of the contact portion 161 may project, along the width direction, toward the inside of the developer cartridge 28 so as to provide a surface along which the developer cartridge boss 79 slides along before sliding around a lower corner of the contact portion 161 and being locked, as described below by another side of the contact portion 161. As shown in FIG. 18, when the developer cartridge boss 79 on the left side wall 96 of the developer cartridge casing 28 is locked into place, the developer cartridge boss 79 on the right side wall 97 may be arranged within a groove 16 of the drum cartridge casing 91. The groove 16 may be provided in the lower extension portion 104 substantially above the upper resist roller 14 on the right side wall 97 of the drum cartridge casing 91.

The flexible member 159 may be a thin pin-like member capable of bending and flexing to help lock and/or release the corresponding developer cartridge boss 79 relative to the drum cartridge 27, as shown in FIGS. 21(*a*)-21(*d*). The flexible member 159 may extend from one end of the base of the lock lever 153 downward towards the front of the lower extension portion 104. In exemplary embodiments, the lower end of the flexible member 159 engages, for example, with a rib (not shown) of the drum cartridge casing 91.

In exemplary embodiments, when the developer cartridge 28 is in an attached state relative to the drum cartridge 27 or the developer cartridge 28 is in a detached state relative to the drum cartridge 27, the end of the flexible member 159 that is attached to the base portion of the lock lever 153 is generally closer to the control member 158 of the lock member 153 than the other end of the flexible member 159 and the control member 158 is generally maintained substantially horizontal along the length direction of the drum cartridge 27, as shown in FIGS. 21(*a*), 21(*b*) and 21(*d*). That is, due to the elastic force of the flexible member 159, the lock lever 153 is generally positioned such that the top surface of the control member 158 is substantially aligned with the upper wall extension 50, as shown in FIGS. 13 and 19.

As shown in FIG. 21(*c*), in exemplary embodiments, when the corresponding developer cartridge boss 79 is being guided around a boundary between the lock lever 153 and the flexible member 159, the flexible member 159 bends or flexes such that the end of the flexible member 159 that is not connected to the base portion of the lock lever 153 moves closer to the control member 158 and pulls the control member 158 so that the developer cartridge boss 79 can be arranged below the contact portion 161 of the lock lever 153 (see FIG. 21(*d*)).

When the developer cartridge boss 79 is arranged below the contact portion 161, as shown in FIG. 21(*d*), the pressing portion 149 helps ensure that the developer roller 32 contacts the photosensitive drum 92 as a result of a pressing force of the spring 152 that presses the developer cartridge 28 back towards the photosensitive drum 92 of the drum cartridge 27.

As shown in FIG. 15, the upper resist roller 14 and/or front bottom ribs 165 may be provided along the outside-bottom of the lower extension portion 104. As discussed above, the upper resist roller 14 may be used for transferring the sheet 3 toward the photosensitive drum 92. The upper resist roller 14 may be rotatably provided at the front-end of the middle bottom ribs 164 and such that the upper resist roller 14 extends substantially in the width direction along the bottom surface of the bottom extension wall portion 195 of the bottom wall 98. The upper resist roller 14 is rotatable about an axis 14A.

In exemplary embodiments, the upper resist roller 14 is positioned between the front bottom ribs 165 and the bottom ribs 162 along the width direction. As shown in FIG. 1, the upper resist roller 14 is positioned facing the lower resist roller 14 in the upward and downward directions when the drum cartridge 27 is attached to the main casing 2.

The front bottom ribs 165 may be provided to help guide the sheet 3 through the laser printer 1. As shown in FIG. 15, the front bottom ribs 165 may, for example, protrude downward from the bottom surface of the lower extension portion 104 and extend substantially in the length direction. Gaps exist between adjacent front bottom ribs 165 in the width direction. The front bottom ribs 165 may be provided at the front side of the upper resist roller 14. As shown in FIG. 15, the front bottom ribs 165 may be provided across the width direction.

In some embodiments, where the notch 119 is formed in the bottom extension wall portion 195 and the lower front side wall 99, as discussed above, the bottom extension wall portion 195 may include the first layer 195A and the second layer 195B. In such a case, the front bottom ribs 165 may be provided across the outside bottom surface of the second layer 195B (discussed above), of the bottom extension wall portion 195, which overlaps the notch 119 such that sheet 3 can be guided more effectively.

In some embodiments, the front bottom ribs 165 are formed from a material that is different from the material used to form the drum cartridge casing 91. For example, the front bottom ribs 165 may be formed from a material that is harder than the material used to form the drum cartridge casing 91 so as to help reduce, and preferably prevent, damage to the front bottom ribs 165. If, as discussed above, the drum cartridge casing 91 is made of a resin material (e.g., polystyrene), the front bottom ribs 165 may be made of polyacetal resin. As discussed above, in the case where the bottom extension wall portion 195 includes the first layer 195A and the second layer 195B, the first layer 195A may be formed of the same material as the drum cartridge casing 91 while the second layer 195B is made of a harder material.

In some embodiments, the gaps between respective ones of the front bottom ribs 165, the middle bottom ribs 164 and back bottom ribs 163 may be arranged so as to improve the guiding of the sheet 3 through the laser printer 1. In exemplary embodiments, any two or more of the front bottom ribs 165, the middle bottom ribs 164 and back bottom ribs 163 may have substantially the same sized gaps between corresponding adjacent ribs. Further, in some embodiments, any two or more of the front bottom ribs 165, the middle bottom ribs 164 and back bottom ribs 163 may have different sized gaps between corresponding adjacent ribs. In exemplary embodiments, the front bottom ribs 165 and the middle bottom ribs 164 may be aligned in the length direction.

While the attachment/detachment of the developer cartridge boss 79 to the pressing portion 149 helps ensure the contact between the developer roller 32 and the photosensitive drum 92 when the developer cartridge 28 is attached to the drum cartridge 27, other portions of the drum cartridge 27 may engage with other portions of the developer cartridge 28 during attachment and detachment of the developer cartridge 28 to/from the drum cartridge 27.

As shown in FIGS. 17, 18 and 20, the left and right ends of the developer roller shaft 64 protrude outward, in the width direction, beyond the shaft guiding portion 115 of the left side wall 96 and the right side wall 97 of the drum cartridge casing 91. More particularly when the developer cartridge 28 is received in the developer cartridge housing portion 103, the collar member 83 provided, for example, at the left and/or right ends of the developer roller shaft 64 protrude(s) outward, in the width direction, beyond the shaft guiding portion 115 of each of the left side wall 96 and the right side wall 97 of the drum cartridge casing 91 and the back side of the collar member 83 contacts the back end of the developer roller shaft receiving portion 116.

As described above, when the developer cartridge 28 is arranged in the developer cartridge housing portion 103, the developer roller 32 contacts the photosensitive drum 92. A more detailed explanation of the attaching/detaching process of the developer cartridge 28 to/from the drum cartridge 27 is provided below.

In exemplary embodiments, only one pressing portion 149 is provided. In some embodiments, more than one pressing portion 149 may be provided. As illustrated in FIG. 21(*a*), to attach the developer cartridge 28 to the drum cartridge 27, the developer cartridge 28 may be positioned, for example, above the developer cartridge housing portion 103 of the drum cartridge 27 such that the left developer cartridge boss 79 is positioned at an upper side of the pressing portion 149 and the left and right ends of developer roller shaft 64 are arranged, for example, on the corresponding shaft guiding portion 115 of the drum cartridge 27.

As shown in FIG. 21(*b*), in exemplary embodiments, when the developer cartridge 28 is gradually pressed down, each of the developer cartridge bosses 79 is moved downward and the left developer cartridge boss 79 slides on the guiding surface 154 of the pressing member 151. As a result, the pressing member 151 gradually rotates about the fixing shaft 157 such that an upper portion of the pressing member 151 moves forward against the force of the spring 152 while the left and right ends of the developer roller shaft 64, being supported by the corresponding shaft guiding portion 115, slide further towards the developer roller shaft receiving portions 116.

Next, when the left developer cartridge boss 79 contacts the border between the guiding surface 154 and the fixing surface 155 of the pressing portion 149, as shown in FIG. 21(*c*), the left developer cartridge boss 79, while contacting the corresponding contact portion 161, moves further downward while the lock lever 153 rotates about the holding shaft 160 against the elastic force of the flexible member 159. The control member 158 moves downward closer to the flexible member 159.

Also, as shown in FIG. 21(*c*), when the developer roller 32 contacts the photosensitive drum 92, the collar members 83 provided at the left and right ends of the developer roller shaft 64 are received in the corresponding developer roller shaft receiving portion 116 (see FIG. 17). The left developer cartridge boss 79 reaches the border between the guiding surface 154 and the fixing surface 155 of the pressing portion 149.

After that, as the front end portion of the developer cartridge 28 is further lowered, the developer cartridge boss 79 passes between the pressing member 151 and the contact portion 161 of the lock lever 153. As shown in FIG. 21(*d*), the developer cartridge boss 79, while sandwiched between the fixing surface 155 of the pressing member 151 and one edge of the contact portion 161, slides around a corner of the contact portion 161 before being "locked" into position between the fixing surface 155 and another edge of the contact portion 161 of the lock lever 153.

As shown in FIG. 21(*d*) after the left developer cartridge boss 79 is "locked" into position, the control member 158 resumes its substantially horizontal position and/or substantial alignment with the upper wall extension 50. In this state, a backward pressing force of the pressing member 151 resulting from the spring 152 helps press the developer cartridge 28 towards the drum cartridge 27 such that the developer roller 32 is pressed against the photosensitive drum 92.

Also, in this state, because the developer cartridge boss 79 is positioned below the corresponding contact portion 161 of the lock lever 153, the contact portion 161 engages the left developer cartridge boss 79 such that the developer cartridge boss 79 cannot move upward unless the lock lever 153 is moved downward to release the left developer cartridge boss 79.

From the state shown in FIG. 21(*d*), to remove the developer cartridge 28 from the developer cartridge housing portion 103 of the drum cartridge 27, in exemplary embodiments, the control member 158 of the lock lever 153 may be pressed downward to release the developer cartridge boss 79 from below the contact portion 161.

When the lock lever 153 is pressed, the lock lever 153 rotates about the holding shaft 160, and the developer cartridge boss 79 is released as the contact portion 161 positioned above the developer cartridge boss 79 rotates toward the back of the developer cartridge 28. As a result, when the developer cartridge 28 is pulled upward, the developer cartridge boss 79 is free to moved upward between the contact portion 161 of the lock lever 153 against the backward pressing force of the spring 152 and the pressing member 151.

After the developer cartridge boss 79 is released from the pressing portion 149, when the developer cartridge 28 is pulled, both ends of the developer roller shaft 64 unoccupy the corresponding developer roller shaft receiving portion 116 and the developer cartridge 28 can be removed easily from the developer cartridge housing portion 103.

When the developer cartridge 28 is attached to the drum cartridge 27 to form the process cartridge 20, various portions of the developer cartridge 28 connect with and/or align with corresponding portions of the drum cartridge 27.

As shown in FIG. 7, the lower wall 40 of the developer cartridge casing 29 may include a stopper 341 provided at the left and right sides of the lower wall 40. The stoppers 341 may be plate-like members that project substantially perpendicularly upward from the back end of the lower wall 40. Each of the stoppers 341 engages with a stopper receiving member 244 of the drum cartridge 27, as shown in FIG. 12, when the developer cartridge 28 is attached to the drum cartridge 27 such that when the stoppers 341 engage with the stopper receiving members 244, the developer cartridge 28 is prevented from moving further backward relative to the drum cartridge 27. One of the stoppers 341 may be provided at each of the left and right ends of the developer cartridge 28 and one of the stopper receiving members 244 may be provided at each of the left and right ends of the drum cartridge 27. The stoppers 341 also help prevent leakage of the developing agent from the developer cartridge 28.

As discussed above, when the developer cartridge 28 is attached to the drum cartridge 27, each positioning member 84 of the developer cartridge 28 is positioned on the corresponding protruding portion 118 of the drum cartridge 27. The upper extension portion 37 of the developer cartridge 28 and the lower extension portion 104 of the drum cartridge 27 are aligned such that the upper extension portion 37 is arranged above the lower extension portion 104, as shown in FIG. 13.

Proper positioning of the developer cartridge 28 relative to the drum cartridge 27, and more particularly, proper positioning of the developer roller 32 relative to the photosensitive drum 92 of the drum cartridge 27, may be ensured by the combination of the stoppers 341, the stopper receiving members 244, the positioning members 84, the protruding members 118, the pressing portion 149 and the developer cartridge boss 79.

In some embodiments, as shown in FIGS. 7, 8 and 13, a new product detector 301 may be provided, for example, on the left side wall 38 of the developer cartridge 28. U.S. patent application Ser. No. 10/891,142 describes in more detail such a detector and the subject matter disclosed therein is incorporated herein by reference. As shown in FIG. 13, the new product detector 301 may include a contacting lever 302 that protrudes outward along the width direction from a substantially arc-shaped hole 303 on the gear cover 77. The contacting lever 302 may be positioned at one end (e.g., front end) of the arc-shaped hole 303 when the developer cartridge 28 is a new product, and moved by, for example, a new product detecting actuator 374 (FIG. 25) of the laser printer 1, to the other end of the arc-shaped hole 303 when the developer cartridge 28 is used for the first time. Therefore, based on the position of the contacting lever 302, the new product detector 301 can detect whether the developer cartridge 28 is new or has been used (a product having history of usage).

As discussed above, when a new developer cartridge 28 or process cartridge 20 is attached to the main casing 2, the contacting lever 302 (see FIG. 13) of the new product detector 301 provided on the developer cartridge 28 contacts the lower end portion of the new product detecting actuator 374, so that the lower end portion of the new product detecting actuator 374 is pressed rearward by the contacting lever 302. As a result, the new product detecting actuator 374 rotates counterclockwise, and based on the rotation of the new product detecting actuator 374, the developer cartridge 28 is determined to be a new product.

On the other hand, because the contacting lever 302 of the new product detector 301 of the developer cartridge 28 is moved from one end to the other end of the arc-shaped hole 303, from which the contact lever 302 projects outwardly when a used developer cartridge 28 is attached to the main casing 2, the contacting lever 302 of the user developer cartridge 28 does not contact the new product detecting actuator 374. Thus, the new product detecting actuator 374 does not rotate. Based on this operation, the determination may be made that the attached developer cartridge 28 is a used product.

When the process cartridge 20 is installed in the main casing 2, the toner detecting openings 101 of the drum cartridge 27, the toner detecting windows 85 of the developer cartridge 28 and the at least a portion of developing agent low/empty sensor 371 are aligned, along the width direction. In addition, the lower end portion of the resist roller pressing member 372 contacts the left end of the upper resist roller 14 supported by the process cartridge 20, and the left end portion of the upper resist roller 14 is pressed downward by the resist roller pressing member 372.

In exemplary embodiments, when the developer cartridge 28 is attached to the drum cartridge 27 to form the process cartridge 20, the gear mechanism 45 of the developer cartridge 28 at least partially occupies a space between the pressing portion 149 and the photosensitive drum 92.

A more detailed description of the left side of the process cartridge 20, which is formed when the developer cartridge 28 is attached to the drum cartridge 27, will be provided below. As shown in FIG. 17, the cleaning electrode 148, the grid electrode 132, the wire electrode 131, and the transfer electrode 137 are provided, for example, on the left side wall 96 of the drum cartridge casing 91. The ground electrode 127 may be provided such that it extends outward from the left side wall 96, as shown in FIG. 12.

On the left side wall 38 of the developer cartridge casing 29, the developer roller electrode 76 may be provided such that it extends outward from the developer cartridge casing 29. When the developer cartridge 28 is attached to the drum cartridge 27, the developer roller electrode 76 extends outward beyond the left side wall 96 of the drum cartridge casing 91. Thus, in exemplary embodiments of the process cartridge 20, all of the electrodes (i.e., the cleaning electrode 148, the grid electrode 132, the wire electrode 131, the ground electrode 127, the transfer electrode 137, and the developer roller electrode 76) are positioned on the left side of the process cartridge 20.

As discussed above, in exemplary embodiments, the gear mechanism 45 is also provided on the left side wall 38 of the developer cartridge casing 29 and thus the gear mechanism 45 is positioned, for example, on the same side of the developer cartridge casing 29 as the above described electrodes (i.e., the cleaning electrode 148, the grid electrode 132, the wire electrode 131, the ground electrode 127, the transfer electrode 137, and the developer roller electrode 76).

More particularly, in exemplary embodiments, the above described electrodes and the gear mechanism 45 are respectively arranged towards the back of the left side wall 96 of the drum cartridge casing 91 and the back of the left side wall 38 of the developer cartridge casing 29, as described above.

Thus, in exemplary embodiments, the above described electrodes and the gear mechanism 45 are not respectively arranged on the front side wall portion 106L and the extension wall portion 107L of the left side wall 96 of the drum cartridge casing 91, and the left side wall extension 52 of the upper extension portion 37 of the developer cartridge casing 29.

For example, in exemplary embodiments of the process cartridge 20, all of the above described electrodes are arranged behind substantially a center (see point C in FIG. 17) of the process cartridge 20 along the length direction. More particularly, in exemplary embodiments, the input gear 68 is arranged frontmost with respect to the above-described electrodes 148, 132, 131, 127, 137, 76 along the left side of the process cartridge 20.

In exemplary embodiments, among all of the above described electrodes (i.e., the cleaning electrode 148, the grid electrode 132, the wire electrode 131, the ground electrode 127, the transfer electrode 137, and the developer roller electrode 76), the cleaning electrode 148 is the back-most arranged electrode.

More particularly, in exemplary embodiments, as described above, the cleaning electrode 148 is arranged on the sixth wall 113 and thus, is the inner most, along the width direction, of the above described electrodes because the grid electrode 132 and the wire electrode 131 are provided on the fourth wall 111, the transfer electrode 137 is provided on the second wall 109L, and the ground electrode 127 and the developer roller electrode 76 extend out from the first wall 108L. Therefore, in exemplary embodiments, the cleaning electrode 148 is the back-most and the inner-most arranged electrode of the above described electrodes.

As shown in FIG. 14, in exemplary embodiments, the cleaning electrode 148 is arranged more inside, along the width direction, than the gear mechanism 45. In exemplary embodiments, the cleaning electrode 148 is positioned, along the width direction, on the process cartridge 20 outside of an image forming area X where the image to be formed is formed on the sheet 3 that passes between the photosensitive drum 92 and the transfer roller 94.

A description of the relative position of the above described electrodes along the width direction of the exemplary process cartridge 20 will be described below. As shown in FIG. 14, the developer roller electrode 76 and the ground electrode 127 project out, along the width direction, beyond the first walls 108L, 108R of the drum cartridge 27. The fifth wall 112, as discussed above, extends inward from the top of the first wall 108L and connects to the fourth wall 111, where the wire electrode 131 and the grid electrode 132 are arranged. Thus, in exemplary embodiments, the wire electrode 131 and the grid electrode 132 are arranged more inward than the developer roller electrode 76 and the ground electrode 127.

The transfer electrode 137 is arranged on the second wall 109L further inward, along the width direction, than the developer roller electrode 76, the ground electrode 127, the wire electrode 131 and the grid electrode 132. As described above, the third wall 10L which extends further inward, than the fifth wall 111, from the bottom of the first wall 108L connects to the second wall 109L, which is arranged to the right of the fourth wall 111.

The cleaning electrode 148 is arranged on the sixth wall 113 further inward, along the width direction, than the developer roller electrode 76, the ground electrode 127, the wire electrode 131, the grid electrode 132, and the transfer electrode 137. As discussed above, the seventh wall 114 extends further inward, from the fourth wall 111 and the second wall 109L, and connects the fourth wall 111 and the second wall 109L to the sixth wall 113.

Thus, in exemplary embodiments, the cleaning electrode 148, the transfer electrode 137, the wire electrode 131, the grid electrode 132, the ground electrode 127, and the developer roller electrode 76 are sequentially arranged, from right to left, on or in the vicinity of the left side wall 96 of the drum cartridge casing 91. In exemplary embodiments, the electrodes 148, 137, 131, 132, 127 and 76 are also arranged at different points along the length direction of the drum cartridge casing 91.

Next, various features of the relationship between the attachable/detachable process cartridge 20 and the main casing 2 will be described. As discussed above, the process cartridge 20 may be attached to or removed from the main casing 2, as shown in FIG. 2. As shown in FIG. 1, when the process cartridge 20 is attached to the main casing 2, the drum cartridge boss 150 engages with a positioning member 166 that may be provided on the main casing 2. The positioning member 166 helps position the process cartridge 20 in the main casing 2 such that the front end of the process cartridge 20 does not move downward when the back end of the process cartridge 20 is urged upward by a force generated by the rotation of the photosensitive drum 92 and the developer roller 32. Thus, the positioning member 166 helps ensure that the process cartridge 20 is properly arranged within the main casing 2. The positioning member 166 also helps the process cartridge 20 remain in its attached position within the main casing 2 during an image formation process when forces may urge the process cartridge 20 to move from its arranged position.

Figure 24:
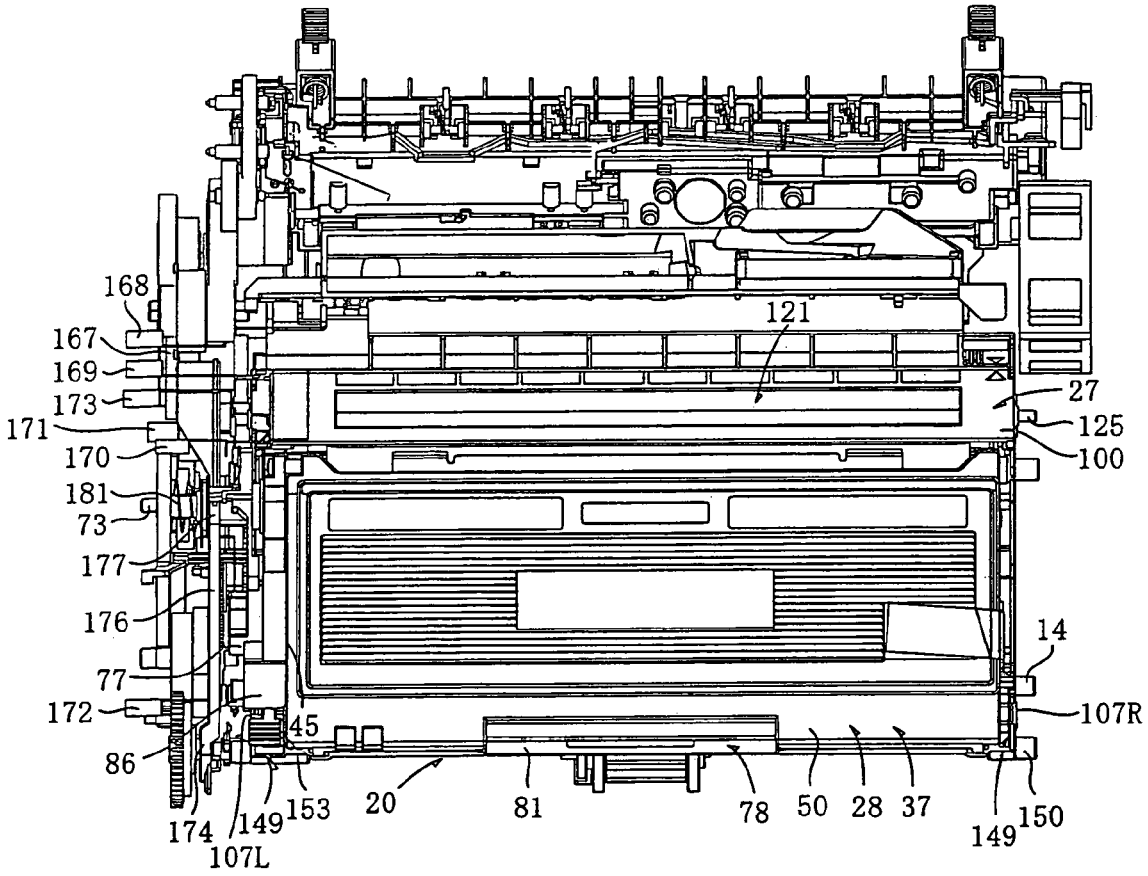
FIG. 24 is a plan view of an interior portion of the image forming device shown in FIG. 1 including the process cartridge shown in FIG. 3.

As shown in FIG. 24, the main casing 2 may include a left frame 167 at the left side of the attachment/detachment cavity 6. An inner facing side (i.e., the side facing the attachment/detachment cavity 6) of the left frame 167 may include, for example, a cleaning electrode connecting portion 168, a grid electrode connecting portion 169, a wire electrode connecting portion 170, a ground electrode connecting portion 171, a transfer electrode connecting portion 172, and a developer roller electrode connecting portion 173. The cleaning electrode connecting portion 168, the grid electrode connecting portion 169, the wire electrode connecting portion 170, the ground electrode connecting portion 171, the transfer electrode connecting portion 172, and the developer roller electrode connecting portion 173 are each connected, via undepicted wiring, to an undepicted power source (e.g., high voltage power source) provided inside the main casing 2.

The electrode connecting portions 168, 169, 170, 171, 172 and 173 are provided on the inner facing side of the left frame 167 such that when the process cartridge 20 is attached to the main casing 2, the cleaning electrode connecting portion 168, the grid electrode connecting portion 169, the wire electrode connecting portion 170, the ground electrode connecting portion 171, the transfer electrode connecting portion 172, and the developer roller electrode connecting portion 173 respectively face and contact the cleaning electrode 148, the grid electrode 132, the wire electrode 131, the ground electrode 127, the transfer electrode 137 and the developer roller electrode 76.

Each of the electrode connecting portions 168, 169, 170, 171, 172 and 173 helps supply power to or ground the corresponding electrodes 148, 132, 131, 127, 137 and 76.

The cleaning electrode connecting portion 168 may, for example, be connected to the power source via a wire. The cleaning electrode connecting portion 168 serves as a connection point for applying a cleaning bias to the cleaning electrode 148. The cleaning bias may be set to be at or about 400V.

The grid electrode connecting portion 169 may be connected via a wire to the power source. The grid electrode connecting portion 169 serves as a connection point for applying a grid voltage to the grid electrode 132. The grid voltage may be set to be at or about 900V.

The wire electrode connecting portion 170 may be connected via a wire to the power source. The wire electrode connecting portion 170 serves as a connection point for applying a discharge voltage to the wire electrode 131. The discharge voltage may be set to be at or about 7000V.

The ground electrode connecting portion 171 may be connected to the power source via a wire. The ground electrode connecting portion 171 serves as a connection point for grounding the ground electrode 127.

The transfer electrode connecting portion 172 may be connected to the power source via a wire. The transfer electrode connecting portion 172 serves as a connection point for applying a transfer bias to the transfer electrode 137. The transfer bias may be set to have a maximum at or about −6500V as a positive transfer bias, and at or about 1600V as a reverse transfer bias.

The developer roller electrode connecting portion 173 and the developer roller connecting member 175, discussed above and below, are connected via a wire to the power source. The developer roller connecting portion 173 serves as a connection point for applying a developing bias to the developer roller electrode 76. The developing bias may be set to be at or about 400V.

Figure 25:
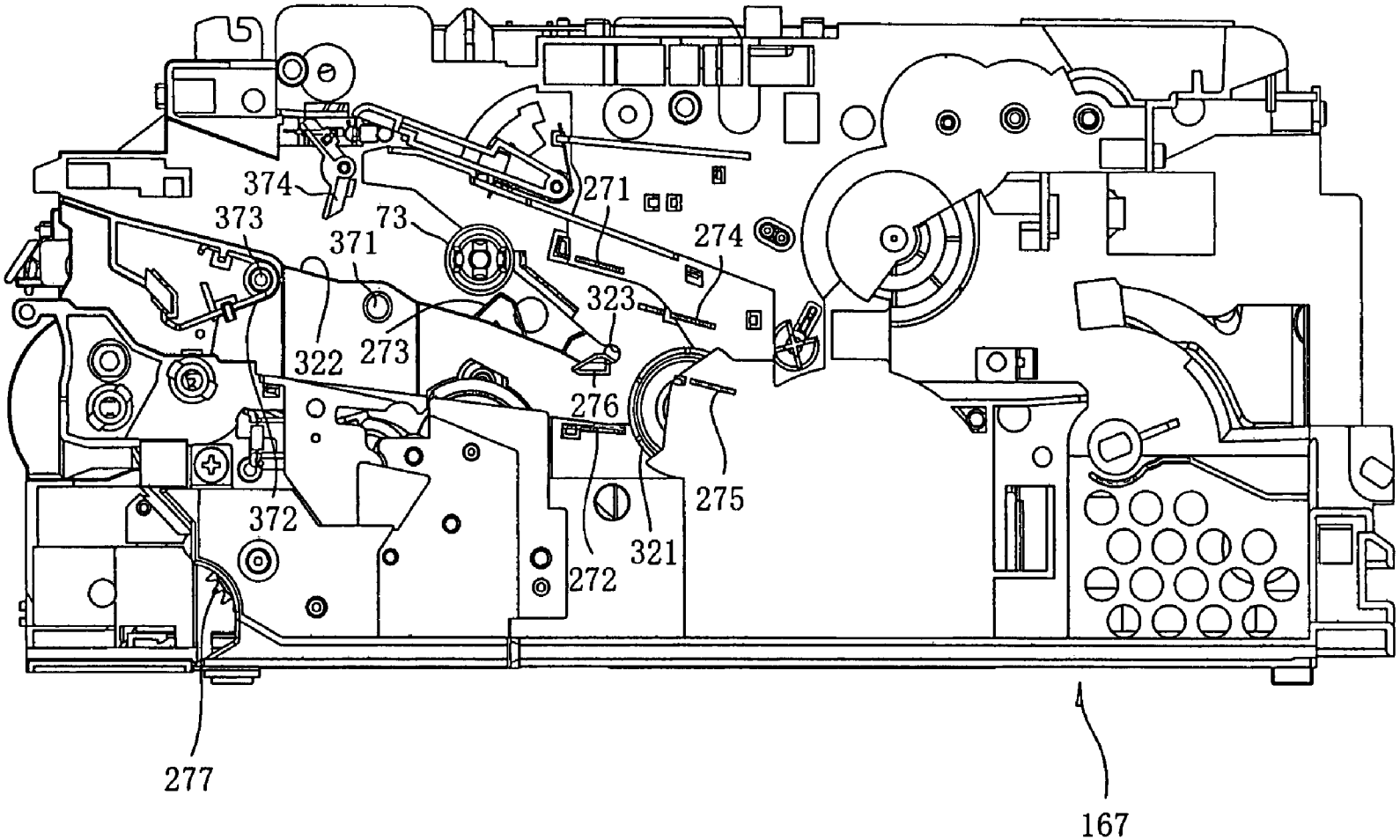
FIG. 25 is a side view of an internal surface of an exemplary left frame of the image forming device shown in FIG. 1.
Figure 26:
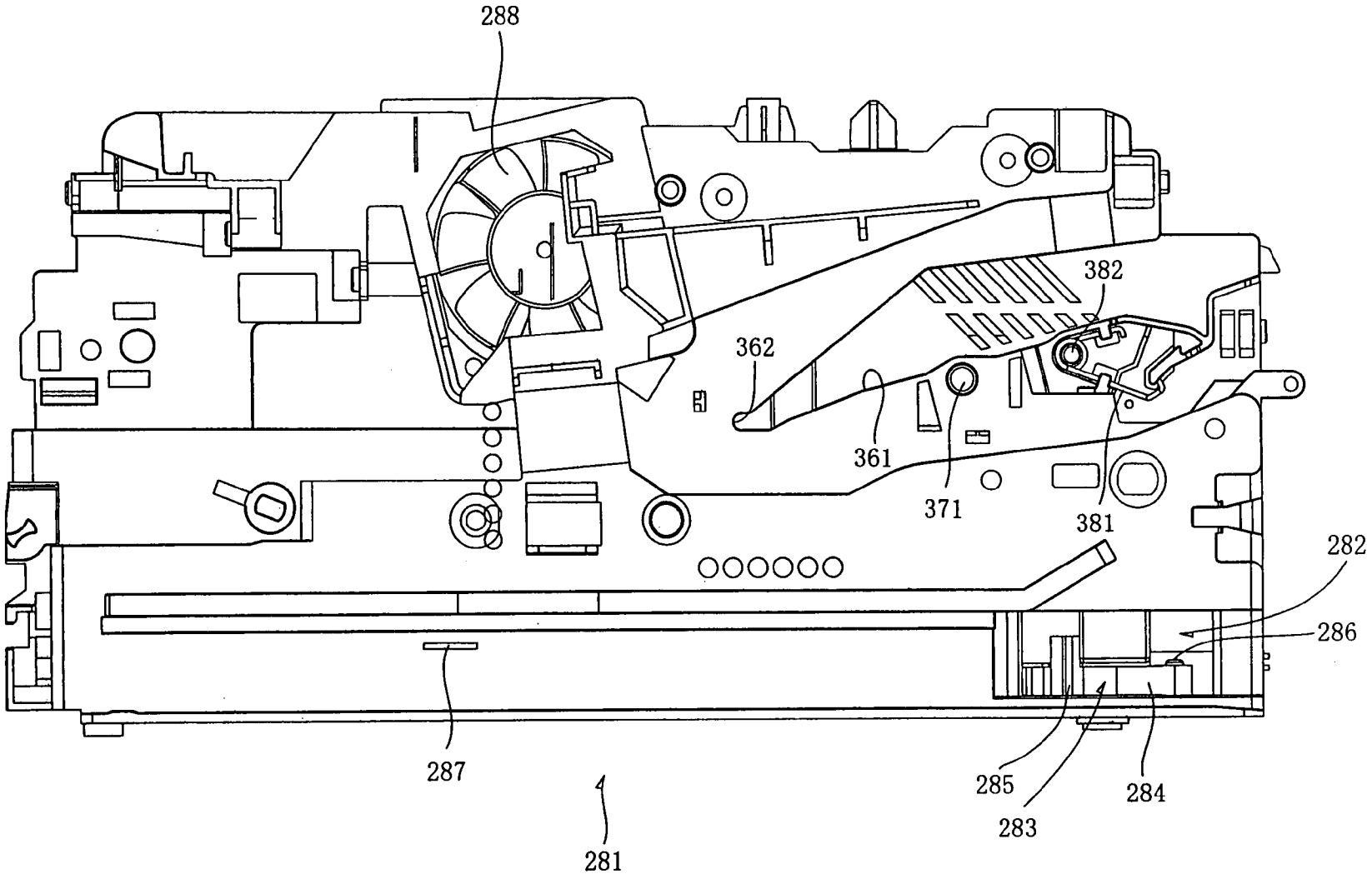
FIG. 26 is a side view of an internal surface of an exemplary right frame of the image forming device shown in FIG. 1.
Figure 27B:
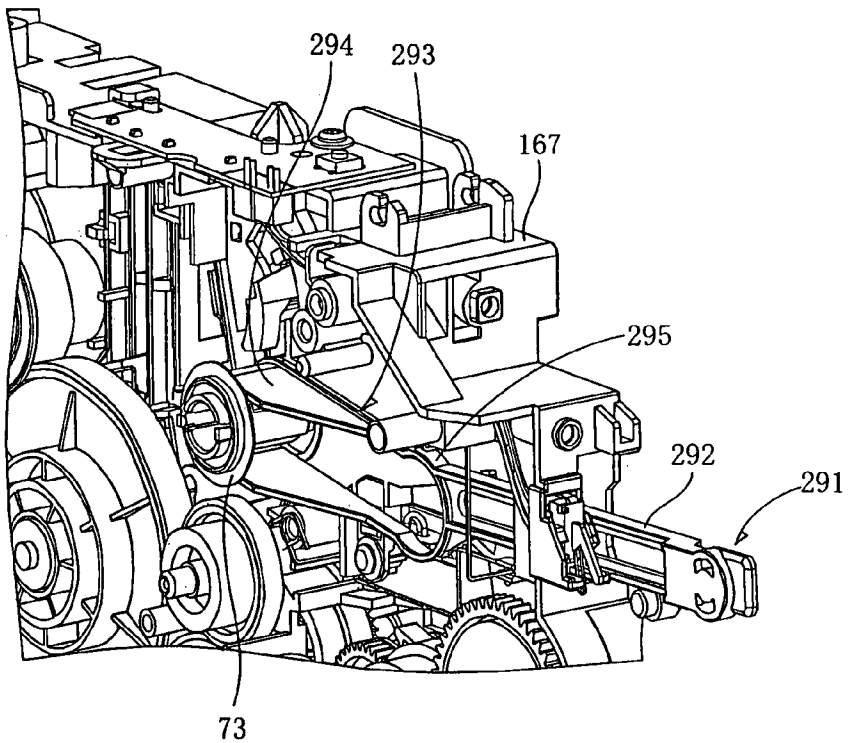
FIGS. 27(*a*) and 27(*b*) respectively illustrate an advanced and a retracted state of an exemplary coupling member.
Figure 27A:
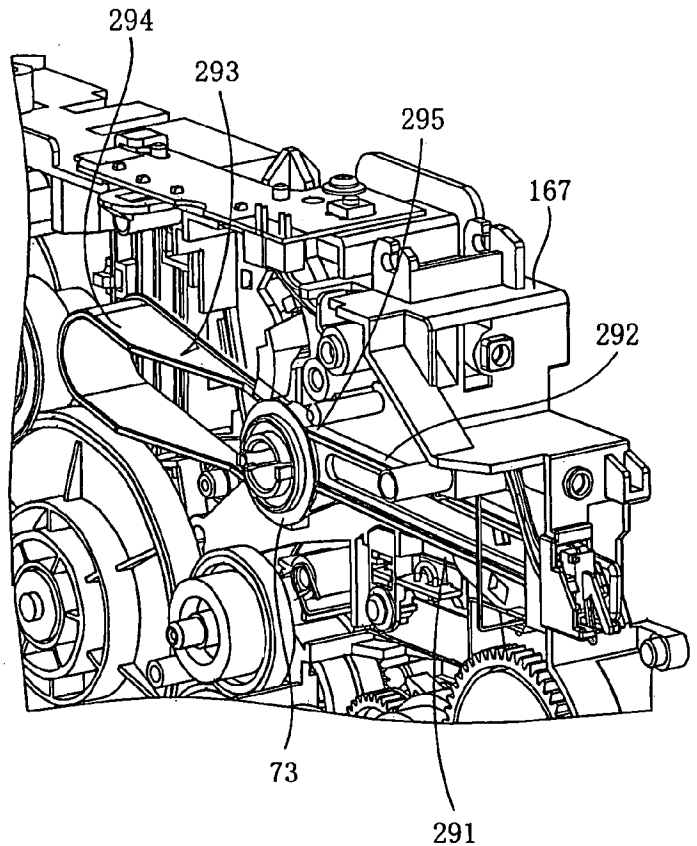

FIG. 25 is a side view of an exemplary internal surface of the left frame 167 of the laser printer 1. FIG. 26 is a side view of an exemplary internal surface of the right frame 281 of the exemplary laser printer 1. FIGS. 27(*a*) and 27(*b*) respectively illustrate an advanced and a retracted state of the exemplary coupling member 73 employable by the laser printer 1.

As shown in FIG. 25, on the inner surface of the left frame 167 (i.e., the surface facing attachment/detachment cavity 6), a wire electrode contacting portion 271, a transfer electrode contacting portion 272, a developer roller electrode contacting portion 273, a grid electrode contacting portion 274, a cleaning electrode contacting portion 275, and a ground electrode contacting portion 276 may be arranged in the main casing 2. The wire electrode contacting portion 271, the transfer electrode contacting portion 272, the developer roller electrode contacting portion 273, the grid electrode contacting portion 274, the cleaning electrode contacting portion 275, and the ground electrode contacting portion 276 respectively contact the wire electrode 131, the transfer electrode 137, the developer roller electrode 76, the grid electrode 132, the cleaning electrode 148 and the ground electrode 127 of the drum cartridge 27 when the drum cartridge 27 and/or process cartridge 20 is arranged in the main casing 2.

The wire electrode contacting portion 271 may, for example, be an exposed portion of a conductive wire that is connected to the wire electrode connecting portion 170 (see FIG. 24). The wire electrode contacting portion 271 may, for example, have a substantially U-like shape. At least the base of the U-like shaped wire electrode contacting portion 271 is exposed and connects to the wire electrode 131 when the process cartridge 20 is attached to the main casing 2. The arms of the U-like shaped wire electrode contacting portion 271 are connected to the wire electrode connecting portion 170 and to the undepicted power source (e.g., high voltage power source) provided inside the main casing 2, via undepicted wiring. The base of the U-like shaped wire electrode contacting portion 271 may extend diagonally along the length direction, as shown in FIG. 25.

The transfer electrode contacting portion 272 may, for example, be an exposed portion of a conductive wire that is connected to the transfer electrode connecting portion 172 (see FIG. 24). The transfer electrode contacting portion 272 may, for example, have a substantially U-like shape. At least the base of the U-like shaped transfer electrode contacting portion 272 is exposed and connects to the transfer electrode 137 when the process cartridge 20 is attached to the main casing 2. The arms of the U-like shaped transfer electrode contacting portion 272 are connected to the transfer electrode connecting portion 172 and to the undepicted power source (e.g., high voltage power source) provided inside the main casing 2, via undepicted wiring. As shown in FIG. 25, the transfer electrode contacting portion 272 may be positioned below the wire electrode contacting portion 271. The base of the U-like shaped transfer electrode contacting portion 272 may extend substantially horizontally along the length direction, as shown in FIG. 25.

The developer roller electrode contacting portion 273 may be an exposed portion of a conductive wire that is connected to the developer roller electrode connecting portion 173 (see FIG. 24). The developer roller electrode contacting portion 273 may, for example, have a substantially inverse broad mouthed U-like shape. As shown in FIG. 25, in exemplary embodiments, the base and arms of the inverse broad mouthed U-like shaped developer roller electrode contacting portion 273 are exposed and connect to the developer roller electrode 76. The lower portions of the arms of the inverse U-like shaped developer roller electrode contacting portion 273 may be connected to the developer roller electrode connecting portion 173 and to the undepicted power source (e.g., high voltage power source) provided inside the main casing 2, via undepicted wiring. As shown in FIG. 25, the developer roller electrode contacting portion 273 may be positioned in front of the wire electrode contacting portion 271 and the transfer electrode contacting portion 272. The developer roller electrode contacting portion 273 may also be positioned above the transfer electrode contacting portion 272 and below the wire electrode contacting portion 271.

The grid electrode contacting portion 274 may, for example, be an exposed portion of a conductive wire that is connected to the grid electrode connecting portion 169 (see FIG. 24). The grid electrode contacting portion 274 may, for example, have a substantially U-like shape. At least the base of the U-like shaped grid electrode contacting portion 274 is exposed and connects to the grid electrode 132. The arms of the U-like shaped grid electrode contacting portion 274 are connected to the grid electrode connecting portion 169 and to the undepicted power source (e.g., high voltage power source) provided inside the main casing 2, via undepicted wiring. As shown in FIG. 25, the grid electrode contacting portion 274 may be positioned to the back of the wire electrode contacting portion 271 and the transfer electrode contacting portion 272. The grid electrode contacting portion 274 may be positioned above the transfer electrode contacting portion 272 and below the wire electrode contacting portion 271. The grid electrode contacting portion 274 may be positioned closer to the wire electrode contacting portion 271 than to the transfer electrode contacting portion 272. The base of the U-like shaped grid electrode contacting portion 274 may extend diagonally along the length direction, as shown in FIG. 25.

The cleaning electrode contacting portion 275 may, for example, be an exposed portion of a conductive wire that is connected to the cleaning electrode connecting portion 168 (see FIG. 24). The cleaning electrode contacting portion 275 may, for example, have a substantially U-like shape. At least the base of the U-like shaped cleaning electrode contacting portion 275 is exposed and contacts the cleaning electrode 148. The arms of the U-like shaped cleaning electrode contacting portion 275 are connected to the cleaning electrode connecting portion 168 and to the undepicted power source (e.g., high voltage power source) provided inside the main casing 2, via undepicted wiring. As shown in FIG. 25, the cleaning electrode contacting portion 275 may be positioned to the back of the wire electrode contacting portion 271 and the transfer electrode contacting portion 272. The cleaning electrode contacting portion 275 may be positioned above the transfer electrode contacting portion 272 and below the wire electrode contacting portion 271. The cleaning electrode contacting portion 275 may be positioned closer to the transfer electrode contacting portion 272 than to the wire electrode contacting portion 271. The base of the U-like shaped cleaning electrode contacting portion 275 may extend diagonally along the length direction, as shown in FIG. 25.

As shown in FIG. 25, the ground electrode contacting portion 276, which the ground electrode 127 contacts when the process cartridge 20 is attached to the main casing 2, may be provided on the inner surface of the left frame 167. The ground electrode contacting portion 276 may be formed, for example, by bending a wire into a substantially triangular-like shape, as shown in FIG. 25.

The ground electrode contacting portion 276 may include a pressing member (not shown) such as a spring that presses the ground electrode contacting portion 276 upward so as to engage with a ground electrode receiving portion 323 (discussed below). In exemplary embodiments, the ground electrode contacting portion 276 connects to the left frame 167 via the ground electrode connecting portion 171 (see FIG. 24).

The ground electrode contacting portion 276 may be positioned below the wire electrode contacting portion 271 and above the transfer electrode contacting portion 272. The wire forming the ground electrode contacting portion 276 connects the ground electrode contacting portion 276 to the ground electrode connecting portion 171 and to the undepicted power source (e.g., grounding source) provided inside the main casing 2 or a metal portion of the main casing 2, via undepicted wiring.

The left frame 167 may also support other contact portions or members that contact corresponding portions of the drum cartridge 27, developer cartridge 28 and/or process cartridge 20.

For example, the coupling member 73 for inputting the driving force for driving the input gear 28 may, for example, be moveably arranged on the inner surface of the left frame 167 above the front side of the developer roller electrode contacting portion 273 and substantially aligned with the wire electrode contacting portion 271 along the length direction.

A drum gear 321 that engages with the photosensitive drum driving gear 191 (see FIGS. 37 and 38) of the drum cartridge 27 and/or process cartridge 20 when the drum cartridge 27 and/or process cartridge 20 is attached to the main casing 2 may be provided on the inner surface of the left frame 167. The drum gear 321 may, for example, be provided behind the transfer electrode contacting portion 272 and the ground electrode contacting portion 276, and below the grid electrode contacting portion 274.

Further, on the inner surface of the left frame 167, the developing agent low/empty sensor 371 for detecting the empty state of the toner contained in developer housing section 30 of the developer cartridge 28 may be positioned in front of the developer roller electrode contacting portion 273 such that when the process cartridge 20 is arranged in the main casing 2, the developing agent low/empty sensor 371 is aligned, along the width direction, with the toner detecting window 101 (see FIG. 35) formed on the left side wall 96 and the toner detecting window 101 of the right side wall 97 of the drum cartridge casing 91. The developing agent low/empty sensor 371 may include a light emitting element arranged on one of the left frame 167 and the right frame 281 and a light receiving element on the other of the left frame 167 and the right frame 281.

In addition, in front of the developing agent low/empty sensor 371, the resist roller pressing member 372 may be positioned. When the process cartridge 20 is attached to the main casing 2, the resist roller pressing member 372 presses the left end of the upper resist roller 14 downward. The resist roller pressing member 372 may, for example, be formed of a torsion spring that is supported by a shaft 373. The resist roller pressing member 372 may project inward, along the width direction, from the left frame 167.

As shown in FIG. 25, the resist roller pressing member 372 may be provided such that one end extends diagonally upward toward the front side of the laser printer 1, along an electrode guiding surface 322 (described below) while the other end extends diagonally downward toward the front side of the laser printer 1.

In addition, the new product detecting actuator 374 having a substantially V-shape, when viewed from a left or right side thereof, is positioned above and between the developing agent low/empty sensor 371 and the resist roller pressing member 372. The new product detecting actuator 374 may be rotatably supported by a shaft 375 projecting inward, along the width direction, from the left frame 167. The lower end portion of the of the new product detecting actuator 374 may, for example, be constantly urged towards the front of the laser printer 1 by a spring (not shown).

In some embodiments, the left frame 167 may include the electrode guiding surface 322. The electrode guiding surface 322 may be provided to help guide the ground electrode 127 and the developer roller electrode 76 during attachment and detachment of the process cartridge 20. The electrode guiding surface 322 may, for example, extend, along the length direction, from the front portion of the main casing 2 to the ground electrode receiving portion 323. The ground electrode receiving portion 323 may, for example, be provided close to the ground electrode contacting portion 276.

When the process cartridge 20 is attached to the main casing 2, the ground electrode 127 and the developer roller electrode 76 slide along the surface of the electrode guiding surface 322 until the ground electrode 127 is engaged by the ground electrode receiving portion 323. The ground electrode receiving portion 323 may, for example, be a U-like groove portion that is arranged such that the mouth of the U-like shaped ground electrode receiving portion 323 faces the front of the laser printer 1.

The electrode guiding surface 322 may, for example, be an inclined surface arranged such that the front portion of the electrode guiding surface 322 is closer to the top of the laser printer 1 than the back portion of the electrode guiding surface 322 where the ground electrode receiving portion 323 is provided. In addition, the electrode guiding surface 322 is formed so as to extend across the developer roller electrode contacting portion 273 and the ground electrode contacting portion 276. The developer roller electrode contacting portion 273 and the ground electrode contacting portion 276 are provided so as to project upward from the electrode guiding surface 322, as shown in FIG. 25.

When attaching the process cartridge 20 to the main casing 2, the ground electrode 127 is guided to the electrode guiding surface 322 until it is received by the ground electrode receiving portion 323. Before reaching the ground electrode receiving portion 323, the ground electrode connecting portion 171 presses the developer roller electrode contacting portion 273 that is projecting upward from the electrode guiding surface 322 by pressing the developer roller contacting portion 273 downward in order to pass over the ground electrode contacting portion 273. The ground electrode connecting portion 171 then presses the ground electrode contacting portion 276 down toward the electrode guiding surface 322.

When the ground electrode 127 is received by the ground electrode receiving portion 323, the ground electrode 127 and/or the ground electrode connecting portion 171 is pressed upward to a back portion of the ground electrode receiving portion 323 by the pressing member (e.g., spring) of the ground electrode contacting portion 276. As a result, the ground electrode 127 and/or the ground electrode connecting portion 171 is prevented from being separated from the ground electrode receiving portion 323, and the ground electrode contacting portion 276 is properly connected to the ground electrode 127 and/or the ground electrode connecting portion 171.

Further, the developer roller electrode 76 is guided along the electrode guiding surface 322 passes over the developer roller electrode contacting portion 273 by pressing the developer roller electrode contacting portion 273 downward. When the process cartridge 20 is attached to the main casing 2 (e.g., the ground electrode 127 and/or the ground electrode connecting portion 171 is received by the ground electrode receiving portion 323), the developer roller electrode contacting portion 273 contacts the lower-front portion of the developer roller electrode 76, and the developer roller electrode 76 and/or the developer roller electrode connecting portion 173 is pressed diagonally upward toward the upper-back side by a pressing force of the developer roller electrode contacting portion 273.

By providing the developer roller electrode contacting portion 273 such that the developer roller electrode contacting portion 273 contacts the developer roller electrode 76 and/or the developer roller electrode connecting portion 173 from the lower-front portion thereof, when the process cartridge 20 is attached to the main casing 2, the space between the developer roller electrode contacting portion 273 and the wire electrode contacting portion 271 is increased. That is, if the developer roller electrode contacting portion 273 contacted the top portion of developer roller electrode 76 and/or the developer roller electrode connecting portion 173, then a smaller space would exist between the developer roller electrode contacting portion 273 and the wire electrode contacting portion 271. Thus, by providing the developer roller electrode contacting portion 273 that contacts the developer roller electrode 76 and/or the developer roller electrode connecting portion 173 from the lower front portion thereof, efficiency and accuracy of the transfer of charge from the developer roller electrode contacting portion 273 to the developer roller electrode 76 is improved.

Referring still to the left frame 167, as shown in FIG. 25, a lever driving force transfer gear 277 may be rotatably supported by the left frame 167 such that a front-lower side portion of the lever driving force transfer gear 277 is exposed. When the sheet supply tray 9 (see FIG. 1) is attached to the main casing 2, an input gear (not shown) provided in the sheet supply tray 9 engages with the lever driving force transfer gear 277. When the driving force is supplied to the input gear 68 from the lever driving force transfer gear 277, as discussed above, the lever 17 (see FIG. 1) is rotated by the supplied driving force, and the front end portion of the sheet pressing member 15 is urged upward by the lever 17. With the lever driving force transfer gear 277 supplying the input gear 68 with a driving force, the sheet supply tray 9 is prevented from separating from the main casing 2 by the engagement of the lever driving force transfer gear 277 and a tray lock member 283 (described below).

FIG. 26 is a side view of the inner side surface of the exemplary right frame 281 of the laser printer 1. An inner surface of the right frame 281 faces the right side of the process cartridge 20 when the process cartridge 20 is attached to the main casing 2. On the inner surface of the right frame 281, a shaft guiding surface 361 and a drum shaft receiving portion 362 may be provided. The shaft guiding surface 361 guides the right end portion of the drum shaft 125 and the developer roller shaft 64 during attachment and detachment of the process cartridge 20 to the main casing 2. The drum shaft receiving portion 362 receives the right end portion of the drum shaft 125 when the drum cartridge 27 and/or the process cartridge 20 is attached to the main casing 2. In some embodiments, the right end of the drum shaft 125 may also be grounded such that the both the right and left ends of the drum shaft 125 function as ground electrodes 127.

The shaft guiding surface 361 and the drum shaft receiving portion 362 may be formed so as to symmetrically face the electrode guiding surface 322 and the ground electrode receiving portion 323 of the left frame 167, respectively. That is, the shaft guiding surface 361 may be formed so as to have an inclined surface and the front portion of the shaft guiding surface 361 may be arranged closer to the top of the laser printer 1 than to the back portion thereof where the drum shaft receiving portion 362 is provided.

When the process cartridge 20 is attached to the main casing 2, the right end of the drum shaft 125 and the right end of the developer roller electrode 76 slide along the surface of the shaft guiding surface 361 until the drum shaft 125 is engaged by the drum shaft receiving portion 362. The drum shaft receiving portion 362 may, for example, be a U-like shaped groove portion that is arranged such that the mouth of the U-like shaped drum shaft receiving portion 362 faces the front of the laser printer 1.

When mounting the process cartridge 20 to the main casing 2, the ground electrode 127 (i.e., the collar member 83) and the left developer roller electrode 76 (i.e., left end portion of the developer roller shaft 64) are guided on the electrode guiding surface 322 of the left frame 167, while the right end portion of the drum shaft 125 and the right end of the developer roller shaft 64 are guided on the shaft guiding surface 361 of the right frame 281. The right end portion of the drum shaft 125 is received by the drum shaft receiving portion 362 at substantially the same time when the ground electrode 127 is received by the ground electrode receiving portion 323.

In addition, on the inner surface of the right frame 281, the other of the light emitting element and the light receiving element of the developing agent low/empty sensor 371 may be provided such that one of the light element and the light receiving element is provided on the right frame 281 and the other is provided on the left frame 167. When the process cartridge 20 is attached to the main casing 2, the toner detecting openings 101 of the drum cartridge 27, the toner detecting windows 85 of the developer cartridge and the light receiving element or the light emitting element of the developing agent low/empty sensor 371 that is provided on the right frame 281 are aligned, along the width direction.

On the front side of the developing agent low/empty sensor 371 provided on the right frame 281, a resist roller pressing member 381 may be positioned. When the process cartridge 20 is attached to the main casing 2, the resist roller pressing member 381 presses the right end of the upper resist roller 14 downward. The resist roller pressing member 381 may, for example, be formed of a torsion spring that is supported by a shaft 382. The resist roller pressing member 381 may project inward, along the width direction, from the right frame 281. As shown in FIG. 25, the resist roller pressing member 381 may be provided such that one end extends diagonally upward toward the front side of the laser printer 1, along the electrode guiding surface 361 while the other end extends diagonally downward toward the front side of the laser printer 1.

In a state that the process cartridge 20 is mounted, the toner detecting window 101 on the right side wall 97 of the drum cartridge casing 91 and the developing agent low/empty sensor 371 face each other in the width direction. In addition, the lower end portion of the resist roller pressing member 381 contacts the right end of the upper resist roller 14 supported by the process cartridge 20, and presses the right end of the resist roller 14 downwardly.

Moreover, on the inner surface of the right frame 281, a concave portion 282 that projects outward (i.e., to the right) from the right frame 281 along the width direction may be formed at the front lower end portion of the right frame 281. In the concave portion 282, a tray lock member 283 may be provided as a locking mechanism for preventing separation of the sheet supply tray 9 (see FIG. 1).

The tray lock member 283 may extend, for example, along the length direction and include, for example, a curved arm 284 that curves such that the back end portion of the curved arm 284 is directed towards the inside of the laser printer 1 (i.e., out of the concave portion 282). A contacting area 285 may be provided at the back end portion of the curved arm 284 and the front end portion of the curved arm 284 may be rotatably attached to a shaft 286 extending along the thickness direction in the concave portion 282. In addition, a spring (not shown) is connected to the curved arm 284 such that the contacting area 285 is constantly urged towards the inside of the laser printer 1 and outside of the concave portion 282, by the force of the spring.

When the sheet supply tray 9 is mounted to the main casing 2, a lock member engaging portion (not shown) that projects from the right side of the sheet supply tray 9 contacts the contacting area 285 of the tray lock member 283, and the tray lock member 283 presses the contacting area 285 into the concave portion 282, against the force of the spring (not shown), such that the lock member engaging portion can pass by the concave portion 282 and the tray lock member 283.

When the lock member engaging portion passes by the contacting area 285, the tray lock member 283 recovers by the force supplied by the spring such that the contacting area 285 projects out from the concave portion 282 and engages with the lock member engaging portion of the sheet supply tray 9. As a result, undesired separation of the sheet supply tray 9 from the main casing 2 is prevented.

In addition, on the inner surface of the right frame 281, a pressing ground contact 287 may be provided. The pressing ground contact 287 fits into a ground connecting opening (not shown) formed on the right side surface of the sheet supply tray 9 when the sheet supply tray 9 is attached to the main casing 2.

Moreover, on the right frame 281, a fan 288 may be positioned at substantially the center portion, along the width direction, of the right frame 281. The fan 288 helps cool the inside of the laser printer 1 and counteract the heat generated by the process cartridge 20 and the fixing portion 21. The fan 288 may be positioned so as to be exposed to both the inside and the outside of the right frame 281.

FIGS. 27(*a*) and (*b*) illustrate another exemplary embodiment of a coupling member 73, and for the explanation of the advancing/retracting operations, (a) indicates the advancing state of the coupling member 73, and (b) indicates the retracting state of the coupling member 73.

The coupling member 73 advances to connect to the connecting hole 74 and retracts to disconnect from the connecting hole 74 (see FIG. 8) of the input gear 68. An arm 291 for advancing and retracting the coupling member 73 is provided on the left frame 167. The arm 291 includes a first arm 292 extending along the length direction and a second arm 293 provided at the back end portion of the first arm 292.

The second arm 293 includes a long hole extending along the length direction, and into which the coupling member 73 may be inserted. As shown in FIGS. 27(*a*)-(*b*), the back end portion of the second arm 293 has a thicker side wall than the front end portion thereof. The back end portion of the second arm 293 corresponds to a retracting portion 294 for the coupling member 73 while the front end portion of the second arm 293 corresponds to an advancing portion 295.

The arm 291 is movably supported by the left frame 167 such that the arm 291 may move along the length direction. The arm 291 may move backward when, for example, the coupling member 73 is engaged by the advancing portion 294 at the back end portion of the arm 291. The arm 291 may provided so as to move along the length direction with the opening and closing of the front cover 7.

The coupling member 73 may be positioned to be across from the connecting hole 74 of the input gear 68 when the process cartridge 20 is attached to the main casing 2. A rotating drive force may be input to the coupling member 73 from the motor (not shown) provided in the main casing 2. The coupling member 73 is constantly pressed inward, along the width direction (i.e., towards the attachment/detachment cavity 6) by a pressing member (not shown), such as a spring.

During attachment and detachment of the process cartridge 20 to and from the main casing 2, when the front cover 7 is opened, the arm 291 moves to the front side together with the opening of the front cover 7. During that time, the retracting portion 294 of the second arm 293 engages the coupling member 73 as shown in FIG. 27(*b*). Therefore, the coupling member 73 retracts from the connecting hole 74 of the input gear 68 against the force supplied by the pressing member.

After attaching the process cartridge 20 to the main casing 2, when the front cover 7 is closed, the arm 291 moves towards the back. During that time, the advancing portion 295 engages the coupling member 73 as shown in FIG. 27(*a*). Therefore, if the process cartridge 20 is attached to the main casing 2, the coupling member 73 advances into the connecting hole 74 of the input gear 68 by the force supplied by the pressing member and the coupling member 73 is unrotatably connected to the input gear 68. As a result, when the driving force from the coupling member 73 is transferred to the input gear 68, the developer supply roller 31, the developer roller 32 and the agitator 46 are rotated by the driving force transferred to the input gear 68.

As shown in FIG. 24, the coupling member 73 that connects to the connecting hole 74 of the input gear 68, when the process cartridge 20 is attached to the main casing 2, may be provided on the left frame 167. The coupling member 73 may advance and/or retract, along the width direction, to connect with the connecting hole 74 of the input gear 68. The coupling member 73 may be provided on a sliding arm 174. The coupling member 73 can be controlled between the retracted state and the advanced state depending on the position of the sliding arm 174 relative to the main casing 2, as shown in FIGS. 28(*a*)-(*b*).

The developer roller contacting member 175 may also be provided, for example, on the sliding arm 174. Depending on the position of the sliding arm 174, the developer roller contacting member 175 contacts or is disconnected from the developer roller electrode 76.

Figure 28A:
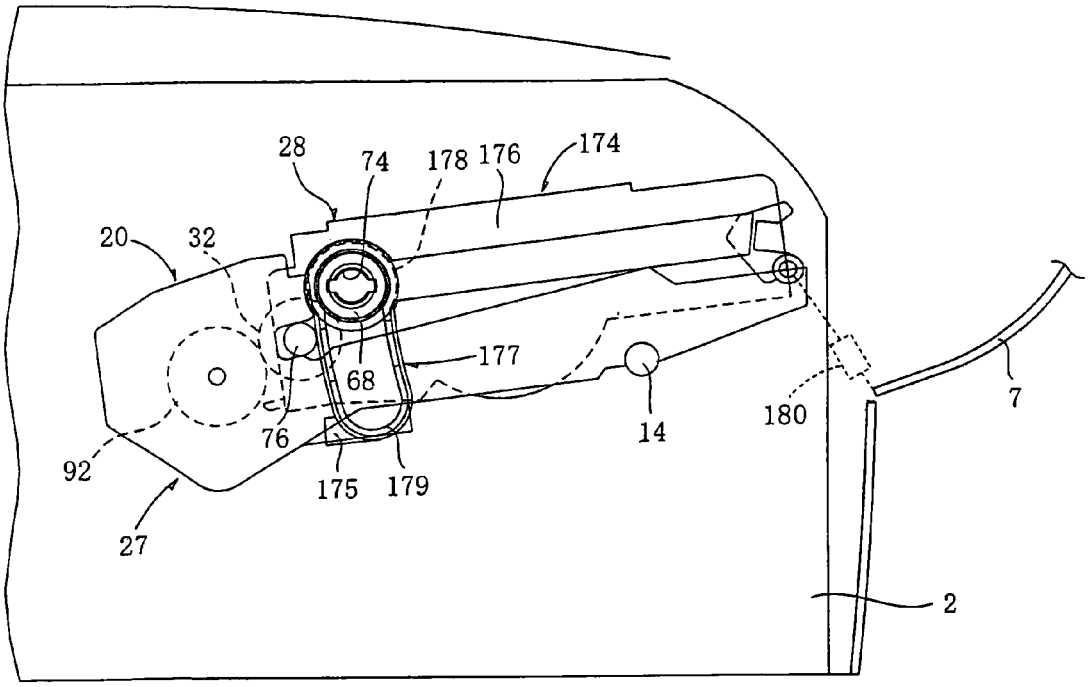
FIGS. 28(*a*) and 28(*b*) are cross sectional schematics of an exemplary image forming device including an exemplary coupling member.
Figure 28B:
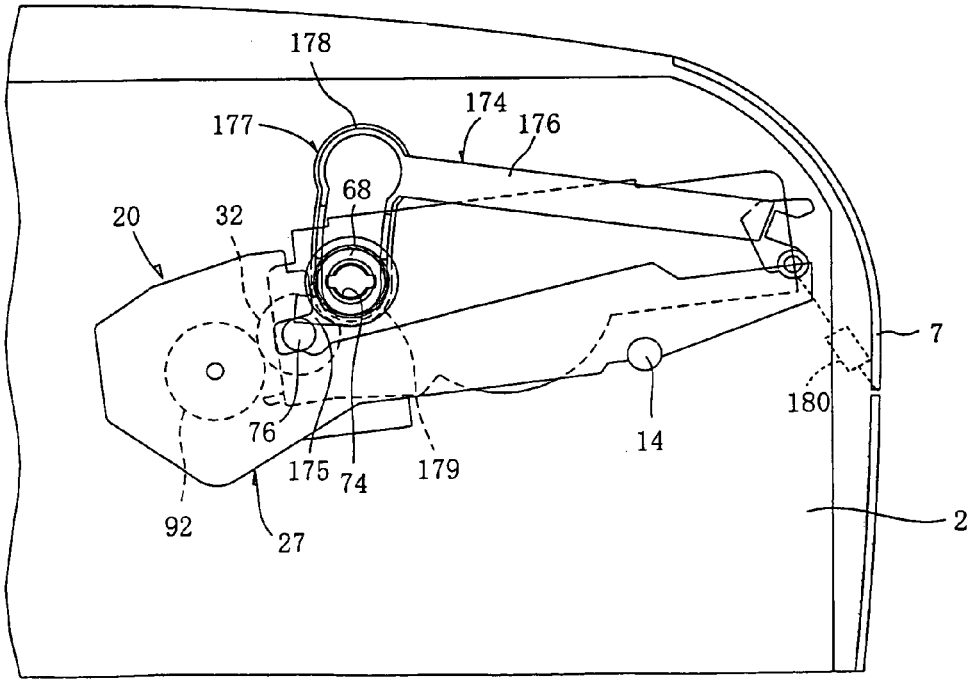
Figure 29A:
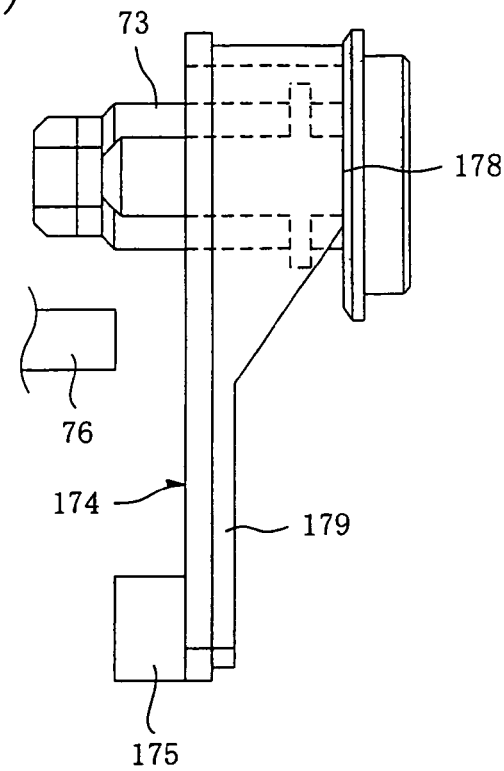
FIGS. 29(*a*) and 29(*b*) are side views of the coupling member shown in FIGS. 28(*a*) and 28(*b*)
Figure 29B:
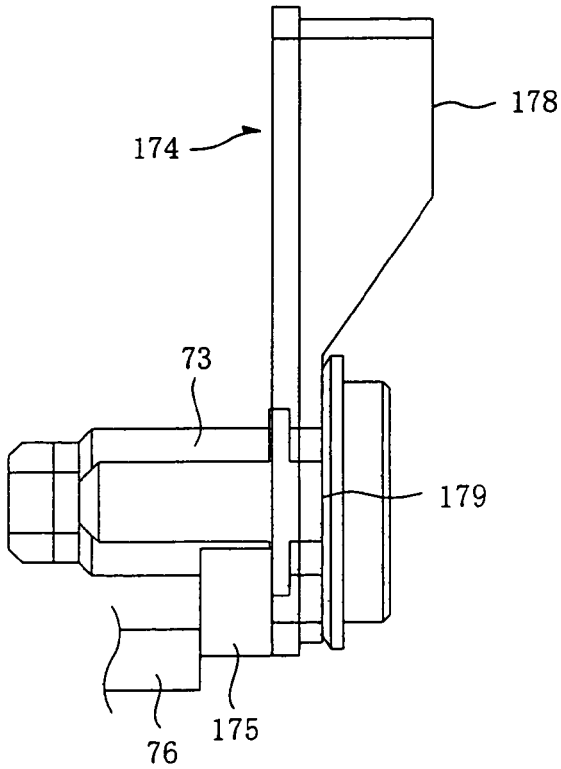

As shown in FIGS. 28(*a*)-(*b*), the sliding arm 174 may include, for example, a first arm 176 that extends along the length direction and a second arm 177. In exemplary embodiments, the second arm 177 is integrally connected to the back end of the first arm 176. The first arm 176 is substantially perpendicular to the second arm 177. On the second arm 177, a long hole or groove that extends in the upward and downward directions may be provided. The coupling member 73 may be inserted into the long hole or groove of the second arm 177. The long hole or groove allows the coupling member 73 to move from one end to another end of the second arm 177. The long hole or groove includes a retracting portion 178 and an advancing portion 179. In exemplary embodiments, the retracting portion 178 is thicker along the width direction than the advancing portion 179. Thus, the retracting portion 178 is capable of sheltering at least a portion of the coupling member 73, as shown in FIG. 29(*a*). When the retracting portion 178 of the second arm 177 of the sliding arm 174 is engaged with the coupling member 73, as shown in FIG. 29(*a*) the coupling member 73 is pulled outward, along the width direction, away from the attachment/detachment cavity 6 such that the coupling member 73 is in the retracted state.

When the advancing portion 179 of the second arm 177 of the sliding arm 174 is engaged with the coupling member 73, as shown in FIG. 29(*b*), the coupling member 73 is pushed inward, along the width direction, toward the attachment/detachment cavity 6 such that the coupling member 73 is in the advanced state.

As shown in FIGS. 29(*a*)-(*b*), the coupling member 73 may be held in the advanced state and the retracted state based on the outer surface of the second arm 177 which projects outward and is thicker along the width direction at the retracting portion 178.

In exemplary embodiments, the coupling member 73 is positioned facing, along the width direction, the connecting hole 74 of the input gear 68 of the developer cartridge 28, when the process cartridge 20 is attached to the main casing 2. A rotating driving force from a motor (not shown) provided inside the main casing 2 may be supplied, via the coupling member 73, to the input gear 68 of the developer cartridge 28. Further, in exemplary embodiments, the coupling member 73 is always urged inward towards the attachment/detachment cavity 6 by way of a spring 181 (see FIG. 24).

When the sliding arm 174 moves or rotates, the portion of the long hole or groove of the second arm 177 that is engaged with the coupling member 73 changes. Depending on whether the aligned portion of the second arm 177 is the advancing portion 179 or the retracting portion 178, the coupling member 73 is respectively set in the advanced state or the retracted state. When the retracting portion 178 of the second arm 177 is engaged with the coupling member 73, the coupling member 73 is pulled outward, against the urging force of the spring 181, along the width direction, and away from the attachment/detachment cavity 6 by way of the outer surface of the second arm 177.

As discussed above, the developer roller connecting member 175 may also be provided on the sliding arm 174. As shown in FIGS. 28(*a*)-(*b*) and 29(*a*)-(*b*), the developer roller connecting member 175 may be provided at an end of the advancing portion 179 of the second arm 177. When the retracting portion 178 of the second arm 117 is engaged with the coupling member 73, the developer roller connecting member 175 does not contact the developer roller electrode 76 and is in a disconnected state, as shown in FIGS. 28(*a*) and 29(*a*).

In exemplary embodiments, when the developer roller connecting member 175 is in the disconnected state, as shown in FIG. 28(*a*), the developer roller connecting member 175 is separated from the developer roller electrode 76 and is located, for example, below the developer roller electrode 76. When the advancing portion 179 of the second arm 177 is engaged with the coupling member 73, the developer roller connecting member 175 contacts the developer roller electrode 76 and is in a connected state.

The developer roller connecting member 175 may be in the form of a cylindrical or semi-cylindrical member that at least partially surrounds the developer roller electrode 76 when the developer roller connecting member 175 contacts the left end of the developer roller electrode 76.

In some embodiments, the developer roller connecting member 175 may be a projecting plate-like member that contacts the left end of the developer roller electrode 76. In exemplary embodiments, the developer roller connecting member 175 is, as discussed above, connected to the undepicted power source inside the main casing 2. As shown in FIG. 28, the developer roller connecting member 175 is provided so as to project rearward on the lower end of the second arm 177 of the sliding arm 174.

As shown in FIGS. 28(*a*)-(*b*), the front end portion of the first arm 176 of the sliding arm 174 may be rotatably supported by the left frame 167 such that the second arm 177 of the sliding arm 174 can move substantially up and down. When the first arm 176 rotates about the front end portion, the coupling member 73 slides along the long hole or groove of the second arm 177 so as to be arranged in the retracting portion 178 or the advancing portion 179.

In exemplary embodiments, movement or rotation of the sliding arm 174 is based on the opening and closing of the front cover 7 by way of a link 180 that links the sliding arm 174 to the front cover 7.

During the installation and removal of the process cartridge 20 into and from the main casing 2 when the front cover 7 is opened, a rear end portion of the first arm 176 is lower with the front end portion being a fulcrum, synchronizing with the opening of the front cover 7, as shown in FIG. 29(*a*), and the retracting portion 178 engages the coupling member 73, as shown in FIG. 29(*b*). As a result, the coupling member 73 retracts from the connecting hole 74 of the input gear 68 resisting the force applied by the spring 181.

When the process cartridge 20 is attached to the main casing 2, if the front cover 7 is closed, the back end of the first arm 176 rises and rotates about the front end of the first arm 176 such that the change in the state of the coupling member 73 (i.e., retracted state or advanced state), and the developer roller connecting member 175 (i.e., contacting state or disconnected state) is synchronized with the opening and closing of the front cover 7, as shown in FIGS. 28(*a*)-(*b*) and 29(*a*)-(*b*).

As discussed above, when the advancing portion 179 of the second arm 177 is engaged with the coupling member 73, the coupling member 73 advances into the connecting hole 74 of the input gear 68 by the urging force of the spring 181 such that the coupling member 73 is unrotatably attached to the input gear 68. In this state, the rotation driving force from the coupling member 73 may be transferred to the input gear 68.

As a result of work of the gear mechanism 45 described above, in exemplary embodiments, when the driving force is transferred from the coupling member 73 to the input gear 68, the driving force is also supplied to the agitator driving gear 69 via the intermediate gear 70, so that the agitator 46 is driven to rotate.

In addition, in such a state, in exemplary embodiments, the driving force is transferred from the input gear 68 to the developer roller driving gear 71 and the supply roller driving gear 72, so that the developer roller 32 and the developing agent supply roller 31 are respectively driven to rotate.

In this state, as shown in FIG. 28(*b*), and as discussed above, the developer roller connecting member 175 contacts the developer roller electrode 76 by overlapping the developer roller electrode 76 in the width direction. In such a state, in exemplary embodiments, the developing bias may be applied via the developer roller connecting member 175 to the developer roller electrode 76 from the power source.

With regard to the photosensitive drum 92, as discussed above, in exemplary embodiments, the photosensitive drum driving gear 191 is exposed from the photosensitive drum gear opening 196. When the process cartridge 20 is attached to main casing 2, the photosensitive drum driving gear 191 engages with a drum gear (not shown) that is provided in the main casing 2 by way of the photosensitive drum gear opening 196. The drum gear supplies the driving force, for rotating the photosensitive drum 92, from the motor (not shown) in order to drive the photosensitive drum 92 to rotate.

Next, a description of a toner supplying process of the developer cartridge 28 will be provided. When the process cartridge 20 so attached to the main casing 2, and the gear mechanism 45 is driven by the driving force of the motor (not shown), the toner in the developer housing section 30 of the developer cartridge 28 is agitated by the agitator 46. The toner is then discharged from the developing agent passage 58 towards the developer supplying section 36.

In exemplary embodiments, the toner discharged from the developing agent passage 58 to the developer supplying section 36 is supplied to the developer roller 32 by the rotation of the developer supply roller 31. At this time, the toner is positively charged via the developing bias applied to the developer roller 32.

The toner supplied onto the surface of the developer roller 32 moves between the pressing member 67 of the thickness regulating member 33 and the developer roller 32 in accordance with the rotation of the developer roller 32 such that the toner is held on the surface of the developer roller 32 as a thin layer having a substantially uniform thickness.

Next, an exemplary process for forming the electrostatic image on the photosensitive drum 92 will be described. The charger 93 generates a grounded discharge by applying the grid voltage and the discharge voltage, to uniformly and positively charge the surface of the photosensitive drum 92. After uniformly and positively charging the peripheral surface of the photosensitive drum 92, while the photosensitive drum 92 is rotating, the surface of the photosensitive drum 92 is exposed by the high-speed scanning of the laser beam from the scanner 19. An electrostatic latent image corresponding to the image to be formed is formed on the peripheral surface of the photosensitive drum 92. The portions of the photosensitive drum 92 that were exposed to the laser beam acquire a lower electric potential than the positively charged unexposed portions of the photosensitive drum 92.

Therefore, in exemplary embodiments, as the photosensitive drum 92 further rotates, when the positively charged toner being held on the surface of the developer roller 32 faces and contacts the photosensitive drum 92 due to the rotation of the developer roller 32, the toner is supplied to the lower potential exposed portions of the photosensitive drum 92. As a result, the electrostatic latent image on the photosensitive drum 92 becomes visible, and the toner image, formed by the reverse development process, is held on the peripheral surface of the photosensitive drum 92.

Thereafter, in exemplary embodiments, as the photosensitive drum 92 further rotates, for example, and faces the transfer roller 94, the toner image held on the peripheral surface of the photosensitive drum 92 is transferred to the sheet 3 by the transfer bias applied to the transfer roller 94 while the sheet 3 is transferred by the resist rollers 14 past the transfer position between the photosensitive drum 92 and the transfer roller 94. The sheet 3 onto which the toner image has been transferred, is then transferred to the fixing portion 21 which will be described below.

After transferring the toner image to the sheet 3, when the photosensitive drum 92 further rotates and faces the cleaning brush 95, paper dust attached to the peripheral surface of the photosensitive drum 92 is collected by the cleaning brush 95 when the cleaning bias is applied to the cleaning brush 95 via the cleaning electrode 148. The toner remaining on the peripheral surface of the photosensitive drum 92 after the image is transferred to the sheet 3 may be collected by the developer roller 32.

In exemplary embodiments, the fixing portion 21 is provided behind the process cartridge 20 in the maing casing 2, as shown in FIG. 1. The fixing portion 21 may include a fixing frame 182 that houses a heating roller 183 and a compression roller 184. The heating roller 183 may include a tube made of metal and a lamp (e.g., halogen lamp) provided inside of the tube. The heating roller 183 may be rotated by the driving force supplied by the motor (not shown).

The compression roller 184 may be positioned so as to contact the heating roller 183 from below. The compression roller 184 may include a roller shaft made of metal and a roller made of a rubber material. The roller may cover the roller shaft and rotate in accordance with the rotation of the heating roller 183.

At the fixing portion 21, the toner transferred onto the sheet 3 at the transfer position is heated and fixed while the sheet 3 passes between the heating roller 183 and the compression roller 184. The sheet 3 to which the toner has been fixed is further transferred to a paper ejecting path 185 extending in the upward and downward directions towards the upper surface of the main casing 2. The sheet 3 transferred to the paper ejecting path 185 may be ejected by a set of paper ejecting rollers 186 to a paper ejecting tray 187 formed on the upper surface of the main casing 2. The paper ejecting roller 186 may be provided above the paper ejecting tray 187, as shown in FIG. 1.

Various features of the various exemplary embodiments of the process cartridge 20 employing one or more aspects of the invention will be discussed below. In some embodiments, such as the exemplary embodiment of the process cartridge 20 shown in FIG. 17, because all of the electrodes (e.g., the cleaning electrode 148, the grid electrode 132, the wire electrode 131, the ground electrode 127, the transfer electrode 137, and the developer roller electrode 76) are positioned on one side (e.g., the left side) of the drum cartridge 27 or process cartridge 20, along the width direction, a structure of the drum cartridge 27 and/or the process cartridge 20 can be simplified while a size of the drum cartridge 27 and/or the process cartridge 20 is reduced.

In some embodiments, as shown in FIG. 14, among the electrodes (i.e., the cleaning electrode 148, the grid electrode 132, the wire electrode 131, the ground electrode 127, the transfer electrode 137, and the developer roller electrode 76), the cleaning electrode 148 may be the back-most and the inner-most electrode, along the width direction. As a result, during attachment/detachment of the process cartridge 20, because the cleaning electrode 148 may be the back-most electrode, the cleaning electrode 148 passes the electrode connecting portions 169, 170, 171, 172 and 173 of the other electrodes 132, 131, 127, 137 and 76 before aligning with the cleaning electrode contacting portion 168 along the width direction.

However, because the cleaning electrode 148 may also be the inner-most electrode along the width direction, the scratching or rubbing of the cleaning electrode 148 against the electrode connecting portions 169, 170, 171, 172, 173 and 175 is reduced, and preferably prevented.

By arranging the cleaning electrode 148 innermost of all of the electrodes 132, 131, 127, 137 and 76, a larger space exists between the cleaning electrode 148 and the electrode contacting portions 169, 170, 171, 172 and 173. Such an arrangement helps reduce, and preferably prevent, contact failure that may result from rubbing, scratching and loosening of electrodes 148, 132, 131, 127, 137 and 76 against electrode connecting portions 168, 169, 170, 171, 172 and 173.

In embodiments where the electrodes 148, 132, 131, 127, 137 and 76 are arranged at different positions along the width direction, the life-span of the drum cartridge 27 and/or the process cartridge 20 can be increased by reducing and preferably preventing the damage to the electrodes 148, 132, 131, 127, 137 and 76 and the electrode contacting portions 168, 169, 170, 171, 172 and 173 that may occur during attachment and detachment of the drum cartridge 27 and/or process cartridge 20.

As discussed above, while in some embodiments the cleaning electrode 148 may be the back-most and the inner-most along the width direction, the cleaning electrode 148 may be positioned outside of the image forming area X so that the image forming area X is not obstructed relative to the sheet 3 due to the cleaning electrode 148. Thus, contact failure of the cleaning electrode 148 can be suppressed while accurate image formation is achieved.

In some embodiments, if the cleaning electrode 148 is the back-most electrode, the cleaning brush 95 may be positioned behind the photosensitive drum 92 (i.e., downstream of the transfer position, based on the direction of rotation of the photosensitive drum 92, where the photosensitive drum 92 and the transfer roller 94 face each other). As a result, the cleaning brush 95 may be secured downstream of the image forming area X.

In some embodiments employing one or more aspects of the invention, as discussed above, the gear mechanism 45 may also be positioned on the same side (e.g., left side) as all of the electrodes 148, 132, 131, 127, 137 and 76. In such embodiments, a structure of the drum cartridge 27 and/or the process cartridge 20 can be simplified while a size of the drum cartridge 27 and/or the process cartridge 20 is reduced.

As discussed above, the gear mechanism 45 may be positioned towards the front of the left side wall 96 of the drum cartridge 27, while all of the electrodes 148, 132, 131, 127, 137 and 76 may be positioned toward the back of the left side wall 96 of the drum cartridge 27. Thus, the simplification and miniaturization of the drum cartridge 27 and/or the process cartridge 20 is possible.

In some embodiments, all of the electrodes 148, 132, 131, 127, 137 and 76 may be positioned behind the input gear 68 of the gear mechanism 45. Thus, while the driving force may be supplied to the input gear 68 via the coupling member 73 attached to the sliding arm 174, the coupling member 73 and the sliding arm 174 do not interfere with the electrodes 148, 132, 131, 127, 137 and 76 because the coupling member 73 and the sliding arm 174 are provided to the front of the input gear 68.

Thus, damage that could occur to the electrodes 148, 132, 131, 127, 137 and 76 by the movement of the coupling member 73 and the sliding arm 174 is avoided, and accurate positioning of the electrodes 148, 132, 131, 127, 137 and 76 on the drum cartridge 27 can be maintained while a stable driving force for driving the process cartridge 20 may be provided to the process cartridge 20 via the coupling member 73.

In some embodiments employing one or more aspects of the invention, although all of the electrodes 148, 132, 131, 127, 137 and 76 and the gear mechanism 45 are positioned on the same side (e.g. left side) of the process cartridge 20, all of the electrodes 148, 132, 131, 127, 137 and 76 are positioned to the back of the gear mechanism 45 so that contamination of the electrodes 148, 132, 131, 127, 137 and 76 by grease and dust generated by the gear mechanism 45 is reduced, and preferably prevented.

In some embodiments, contamination of at least some of the electrodes 148, 132, 131, 127, 137 and 76 may be further prevented by positioning at least some of the electrodes 148, 132, 131, and 137 to the right side of the gear mechanism 45 such that those electrodes can be further protected from the dust, grease, etc. generated by the gear mechanism 45. For example, in the exemplary embodiment described above, the cleaning electrode 148 is more sheltered from the dust, grease, etc. that is generated by the gear mechanism 45 than the other electrodes 132, 131, 127, 137 and 76 because the cleaning electrode 148 is arranged innermost of all of the electrodes 132, 131, 127, 137 and 76.

In some embodiments of one or more aspects of the invention, the developing agent supply opening 47 may be provided on a different side (e.g., right side) of the process cartridge 20 than the side (e.g., left side) on which the electrodes 148, 132, 131, 127, 137 and 76 are positioned. In the exemplary embodiment illustrated in FIG. 10, the developing agent supply opening 47 is provided on the right side wall 39 of the developer cartridge 28. In such an embodiment, contamination of the electrodes 148, 132, 131, 127, 137 and 76 by leakage of the developing agent, is reduced, and preferably eliminated.

In embodiments, the cleaning electrode 148, the transfer electrode 137, the wire electrode 131, the grid electrode 132, the ground electrode 127 and the developer roller electrode 76 are sequentially arranged, from right to left on the left side wall 96 of the drum cartridge casing 91. In further embodiments, the cleaning electrode 148, the transfer electrode 137, the wire electrode 131, the grid electrode 132, the ground electrode 127 and the developer roller electrode 76 are sequentially arranged, from back to front on the left side wall 96 of the drum cartridge casing 91.

As shown in FIG. 14, the electrodes 148, 137, 131, 132, 127 and 76 may also be arranged at different points along the width and length directions due to the arrangement of the third wall 110L, the fifth wall 112, and the seventh wall 114 which extend inward along the width direction and serve as connecting walls for connecting the various walls 108L, 109L, 111, 113 on which the electrodes 148, 137, 131, 132, 127 and 76 are arranged.

The distances between the electrodes 148, 137, 131, 132, 127 and 76 help reduce, and preferably prevent, leaks or shorts between the electrodes 148, 137, 131, 132, 127 and 76 while allowing miniaturization of the process cartridge 20. For example, leaks or shorts between the developer roller electrode 76 and the wire electrode 131 are reduced and preferably prevented by the fifth wall 112 which separates the developer roller electrode 76 and the wire electrode 131 along the width direction.

In some embodiments of the process cartridge 20, such as the exemplary embodiment shown in FIG. 23(*b*), the transfer electrode 137 includes the protruding portion 140 that protrudes outward along the width direction and is received by the transfer electrode opening 142, when the engaging member 139 is engaged by the transfer electrode holding portion 138. As shown in FIGS. 23(*b*)-(*c*), in exemplary embodiments, the transfer electrode 137 is attached to the drum cartridge casing 91 by inserting the engaging member 139 into the transfer electrode receiving portion 143 of the drum cartridge casing 91 from inside the drum cartridge casing 91 such that the engaging member 139 is arranged substantially perpendicular to the third wall 110L.

More particularly, in some embodiments, such as the exemplary embodiment shown in FIG. 23(*c*), the engaging member 139 is received by the transfer electrode receiving portion 143 by engaging one end of the engaging member 139 with the claw portion 147 of the respective engaging rib 145 and then rotating the engaging member 139 about the protruding portion 140 to engage the other end of the engaging member 139 with the claw portion 147 of the other engaging rib 145. As a result, the transfer electrode 137 can be easily and accurately positioned in the drum cartridge casing 91. Also, the engaging member 139 which may include, for example the protruding portion 140 and the electrode contacting portion 141 is prevented from rotating by way of the engaging ribs 145 and the claw portions 147.

When the transfer electrode 137 is arranged in the drum cartridge casing 91, as shown, for example, in FIG. 23(*a*), the left end of the transfer roller shaft 133 contacts the electrode contacting portion 141 of the transfer electrode 137. In exemplary embodiments, the transfer roller driving gear 135 is arranged inside of the drum cartridge casing 91 (i.e., to the right of the second wall 109L) and such that a predetermined distance exists between the second wall 109L and the transfer roller driving gear 135.

Also, in exemplary embodiments, the transfer roller 137 is arranged on the second wall 109L that is positioned to the right of the first wall 108L of the back-side wall portion 105L of the left side wall 96 of the drum cartridge 27. Thus, both the transfer electrode 137 and the transfer roller driving gear 135 are arranged to the right of the first wall 108L and are therefore sheltered from damage that can occur by rubbing or scratching during attachment/detachment of the process cartridge 20 to the main casing 2.

Referring to the developer cartridge 28 of the process cartridge 20, as shown in FIG. 20, the right end of the supply roller shaft 62 and the right end of the developer roller shaft 64 are rotatably held by the bearing member 82 made, for example, from an insulating resin material while the left end of the supply roller shaft 62 and the left end of the developer roller shaft 64 are mounted with the collar member 83 made, for example, from a conductive resin material.

By connecting the developer roller shaft 64 and the supply roller shaft 62 to the conductive collar member 83, the developer supply roller 31 and the developer roller 32 may be maintained at the same electric potential. Thus, the bearing member 82 that supports the right ends of the supply roller shaft 62 and the developer roller 64 can be made large to increase the positioning accuracy and the rotational stability of the supply roller 31 and the developer roller 32. Such a bearing member 82 may also be formed using inexpensive insulating material to help reduce the manufacturing cost of the developer cartridge 28 and/or process cartridge 20.

As discussed above, in some embodiments, the developer cartridge 28 may include the gear cover 77. As shown in FIG. 5, the gear cover 77 may cover at least portions of the input gear 68, the agitator driving gear 69, the intermediate gear 70, the developer roller driving gear 71, and the supply roller driving gear 72. Thus, the gear cover 77 helps protect the gears 68, 69, 70, 71, and 72 from damage that may occur when the developer cartridge 28 and/or the process cartridge 20 is being attached to and detached from the main casing 2.

Further, in exemplary embodiments, the gear cover 77 supports the gears 68, 69, 70, 71, and 72 as well as the left end of the developer roller shaft 64. Thus, the positioning accuracy of the developer roller 32 and gears 68, 69, 70, 71, and 72 can be further ensured. As a result, a stable driving force can be applied to the developer cartridge 28, while reducing the number of parts of the developer cartridge 28 and simplifying the structure of the developer cartridge 28.

Turning now to the coupling member 73 that advances to attach to the input gear 68, as discussed above, when the process cartridge 20 is arranged in the main casing 2 and the front cover 7 is closed, the advancing portion 179 engages with the coupling member 73, as shown in FIG. 28(*b*). The coupling member 73 advances into the connecting hole 74 of the input gear 68 and couples with the input gear 68 so that the coupling member 73 rotates integrally with the input gear 68. That is, the coupling member 73 is not rotatable with respect to the input gear 68.

At the same time, the developer roller contacting member 175 advances to and contacts the developer roller electrode 76 by overlapping the developer roller electrode 76 along the width direction. As a result, a connection for providing a stable supply of electric power and a stable driving force to the developer cartridge 28 is ensured.

In this state, because the developer roller contacting member 175 contacts the developer roller electrode 76 by overlapping with the developer roller electrode 76 along the width direction and pressing against the developer roller electrode 76, the developer roller contacting member 175 helps prevent the left side wall 38 of the developer cartridge 28 from moving or rotating due to the driving force being applied to the input gear 68 via the coupling member 73.

With regard to the collar member 83 and the bearing member 82 of the exemplary process cartridge 20, because the collar member 83 and the bearing member 82 are provided, for example, on both ends of the developer roller shaft 64 of the developer cartridge 28 and the respective collar member 83 is received by the corresponding shaft receiving portion 116 of the drum cartridge 27, when the driving force is transferred to the input gear 68 from the coupling member 73, movement or rotation of the developer cartridge casing 29 is regulated, and preferably prevented, by the drum cartridge casing 91.

That is, in exemplary embodiments, the collar member 83 may be shaped and sized so as to extend, along the up and down directions, substantially across the respective roller shaft receiving portion 116 such that movement and/or rotation of the developer cartridge 28 and the developer roller shaft 64 relative to the drum cartridge casing 91 is regulated, and preferably prevented.

The laser printer 1 which employs the process cartridge 20, the drum cartridge 27 and/or the developer cartridge 28 implementing one or more aspects of the invention may be reduced in size while the average length of time that the laser printer 1 reliably operates (not including image formation issues due to low or no toner in the developer cartridge 28) to form images using the process cartridge 20 is increased. While the electrode arrangement of the process cartridge 20 is advantageous for reducing, and preferably preventing, the damage to the electrodes 148, 132, 131, 127, 137 and 76, the electrode arrangement also helps reduce, and preferably prevent, damage to the electrode contacting portions 168, 169, 170, 171, 172 and 173 of the main casing 2.

Thus, contact failure between the electrodes 148, 132, 131, 127, 137 and 76 and the corresponding connecting portions 168, 169, 170, 171, 172 and 173 and/or contacting portions 271, 272, 273, 274, 275 and 276 is reduced. Thus, a stable supply of electric power necessary for stable image formation can be ensured, on average, for a longer period of time.

Aside from adequate and stable power, the process cartridge 20 also relies on proper positioning in order to process high quality images. For example, when the process cartridge 20 is attached to the drum cartridge 27, and at least when the image formation process is initiated, the developer roller 32 must contact the photosensitive drum 92. As discussed above, in exemplary embodiments, as shown in FIGS. 21(*a*)-21(*d*), to attach the developer cartridge 28 to the drum cartridge 27, the developer cartridge boss 79 engages with the pressing member 151 of the pressing portion 149 of the drum cartridge 27.

The developer cartridge boss 79 may be provided on the upper extension portion 37 of the developer cartridge 28 while the pressing portion 149 is provided on the lower extension portion 104 of the drum cartridge. When the developer cartridge boss 79 is pressed toward the pressing portion 149, the developer cartridge boss 79 contacts the pressing member 151 and by the backward urging force of the spring 152, when the developer cartridge boss 79 is "locked" into the pressing portion 149, the developer cartridge boss 79 and the developer cartridge 28 are urged back such that the exposed portion of the developer roller 32 of the developer cartridge 28 contacts the exposed portion of the photosensitive drum 92.

Thus, in such embodiments, the pressing portion 149 helps ensure that there is adequate contact between the photosensitive drum 92 and the developer roller 32 when the developer cartridge 28 is attached to the drum cartridge 27. Thus, when such a process cartridge 20 is attached to the main casing 2, the process cartridge 20 helps ensure that there is adequate contact between the photosensitive drum 92 and the developer roller 32 during image forming operations of the laser printer 1.

In exemplary embodiments, the developer cartridge boss 79 protrudes outward, along the width direction, from the back-bottom portion of at least one of the left side wall extension 52 and the right side wall extension 53. In embodiments where only one pressing portion 149 is provided, the developer cartridge boss 79 on the same side as the pressing portion 149 may easily and accurately contact the pressing member 151 of the pressing portion 149. Thus, more accurate pressing of the developer roller 32 to the photosensitive drum 92 can be ensured.

Furthermore, in exemplary embodiments of the process cartridge 20, when the developer cartridge 28 is attached to the drum cartridge 27, the contact portion 161 of the lock lever 153 provided at the lower extension portion 104 engages with the developer cartridge boss 79 of the upper extension portion 37, such that the developer cartridge boss 79 is prevented from moving upward. As a result, the developer cartridge 28 is "locked" to the drum cartridge 27 such that movement of the developer cartridge 28 relative to the drum cartridge 27 is regulated, and preferably prevented in order to maintain the contact between the developer roller 32 and the photosensitive drum 92.

When the developer cartridge 28 is to be detached from the drum cartridge 27, in exemplary embodiments, the control member 158 is pressed downward to release the developer cartridge boss 79 from the contact portion 161 of the pressing portion 149. By providing the control member 158 within the overall boundary of the process cartridge 20, such as the space between the left side wall 38 of the developer cartridge casing 29 and the left side wall 96 of the drum cartridge casing 91, in exemplary embodiments, the lock lever 153 does not protrude from the outer boundary of the process cartridge 20.

Thus, the lock lever 153, and in particular, the control member 158 is not prone to engaging with or rubbing against the main casing 2 during attachment and detachment of the process cartridge 20 to/from the main casing 2. In some embodiments, however, the control member 158 may project beyond the outer boundary of the process cartridge 20.

In exemplary embodiments of the process cartridge 20, the developer cartridge boss 79 functions as both a pressed portion (operated portion) and an engaged portion. That is, the developer cartridge boss 79 is the portion of the developer cartridge 28 that is pressed or operated on by the pressing member 151 as well as the portion of the developer cartridge 28 that engages with the contact portion 161 of the pressing portion 149. Thus, in exemplary embodiments, by having a member (i.e., the developer cartridge boss 79) that serves both as the pressed portion and the engaged portion, the structure of the process cartridge 20 is simplified and the number of parts of the developer cartridge 28 can be reduced. While the pressed portion and the engaged portion can be provided separately, the number of parts of the developer cartridge 28 may be increased.

Another mechanism provided in exemplary embodiments of the process cartridge 20 to help ensure the contact between the photosensitive drum 92 and the developer roller 32 is the protruding portions 118 of the drum cartridge 27 which engage with the positioning members 84 of the developer cartridge 28. As shown in FIG. 3, although the protruding portions 118 and the positioning members 84 may have a simple structure, the protruding portions 118 and the positioning member 84 help easily and accurately position the developer cartridge 28 relative to the drum cartridge 27. The protruding portions 118 and the positioning members 84 also help regulate the movement of the developer cartridge 28 relative to the drum cartridge 27 when the developer cartridge boss 79 is "locked" by the pressing portion 149.

Further, with regard to positioning, as discussed above and as shown in FIG. 1, the laser printer 1 may be provided with the positioning member 166 that engages with the drum cartridge boss 150 when the process cartridge 20 is attached to the main casing 2. In exemplary embodiments, because the positioning member 166 works with a relatively small member (e.g., drum cartridge boss 150) of the process cartridge 20, the positioning member 166 itself may also be small such that the positioning member 166 may help reduce the overall size of the laser printer 1, while helping to ensure that the process cartridge 20 is accurately positioned within the main casing 2.

The positioning member 166 also helps regulate movement of the process cartridge 20 during an image forming operation where rotation of the photosensitive drum 92 relative to the developer roller 32 may urge the front end of the process cartridge 20 downward while urging the back end of the process cartridge 20 upward so as to cause the process cartridge 20 to rotate about the lower front end of the process cartridge 20.

The exemplary positioning member 166 is positioned below the front end of the process cartridge 20 so as to serve as a stopper and to help prevent the front end of the process cartridge 20 from moving downward in response to the urging force resulting from the rotation of the photosensitive drum 92 and the developer roller 32.

Referring again to the process cartridge 20, by providing the gear mechanism 45 and the lock lever 153 on a same side of the developer cartridge 28, the width of the developer cartridge 28 may be reduced. Further, by providing the pressing portion 149 on the lower extension portion 104 of the drum cartridge 27 and developer cartridge boss 79 on the upper extension portion 37 of the developer cartridge 28, the thickness (i.e., distance in the up and down directions) and/or the overall size of the process cartridge 20 can be reduced.

By reducing the size of the process cartridge 20, the size of the laser printer 1 may also be reduced. For example, when the thickness of the process cartridge 20 is reduced, the thickness (i.e., distance in the up and down directions) of the attachment/detachment cavity 6 of the main casing 2 may also be reduced. More particularly, when the overall size (i.e., thickness, volume, length, and/or width) of the process cartridge 20 is reduced, the size of the attachment/detachment cavity 6 of the main casing 2 may also be reduced. As a result, the overall size of the laser printer 1 may also be reduced.

Referring now to the drum cartridge 27 of the process cartridge 20, as shown in FIG. 15, the upper resist roller 14 and the front bottom ribs 165 may be provided on the bottom surface of the bottom extension wall portion 195 of the lower extension portion 104. The bottom ribs 162 may provided on the bottom surface of the front bottom wall portion 194 of the developer cartridge housing portion 103. In exemplary embodiments, when the developer cartridge 28 is attached to the drum cartridge 27, the front bottom ribs 165 are in front of the upper resist roller 14 while the bottom ribs 162 are behind the upper resist roller 14 such that the sheet 3 supplied from the sheet supply roller 10 is guided by the front bottom ribs 165 to the upper and lower resist rollers 14 and thereafter guided to the photosensitive drum 92 by the bottom ribs 162.

More particularly, in exemplary embodiments, the combination of the bottom ribs 162 on the bottom wall 98 of the drum cartridge 27 and the front bottom ribs 165 on the bottom extension wall portion 195 of the drum cartridge 27 help strengthen the bottom wall 98 and the bottom extension wall portion 195, respectively, while forming a substantially continuous guiding mechanism for guiding the sheet 3 to the upper and lower resist roller 14 and further to the photosensitive drum 92 along the bottom extension wall portion 195 and the bottom wall 98.

Aside from features included in the process cartridge 20 to help improve the image formation process and/or to help reduce the size of the process cartridge 20, the process cartridge 20 may also be provided with features for helping a user handle the process cartridge 20, the drum cartridge 27 and/or the developer cartridge 28 during attachment/detachment thereof to the main casing 2 or each other, respectively.

As discussed above and as shown in FIG. 5, the developer cartridge 28 may be provided with the handle 81 on the front side of the developer cartridge 28. In exemplary embodiments, the gripping portion 78 is provided in front of the developer housing section 30 rather than above or below the developer housing section 30. Thus, the overall thickness (i.e., distance in the up and down directions) of the developer cartridge 28 is not increased by the gripping portion 78. Further, when the process cartridge 20 is attached to the main casing 2, the gripping portion 78 is easier to reach and grip onto.

More particularly, as discussed above, as the overall size of image forming devices such as the laser printer 1 is being reduced, the image formation process requires that the members of the process cartridge 20 generally be located deeper within the main casing 2. Thus, generally, the closer the gripping portion 78 is provided to the opening of the maing casing 2 through which the process cartridge 20 is attached and detached, the easier it will be for a user to attach/detach the process cartridge 20. In some embodiments, however, the gripping portion 78 may be provided above the developer housing section 30.

Further, by providing the gripping portion 78 on the upper extension portion 37 that may be integrally connected to the lower frame 34 of the developer cartridge housing 29, the developer cartridge 28 may be stably handled via the gripping portion 78 without requiring additional connecting parts for securing the connection between the upper extension portion 37 and the developer housing section 30. In some embodiments, however, the upper extension portion 37 may be connected to the developer housing section 30 by way of the connecting parts.

When the developer cartridge 28 is attached to the drum cartridge 27 so as to form the process cartridge 20, the gripping portion 78 may be used to simultaneously remove/attach/handle/grip the drum cartridge 27 and developer cartridge 28 (i.e., the process cartridge 20). Thus, in some embodiments, the drum cartridge 27 does not include its own handle. In other embodiments, the drum cartridge 27 may be provided with its own handle.

In exemplary embodiments of the developer cartridge 28 of the process cartridge 20, as shown in FIG. 5, the upper wall extension 50 of the upper extension portion 37 that extends along the length direction and the upper front side wall 42 of the upper extension portion 37 that extends substantially along the upward and downward directions have substantially flat outer surfaces. As the process cartridge 20 is reduced in size, when the process cartridge 20 is detached from the main casing 2, by providing substantially flat surfaces, a user can more easily handle the process cartridge 20 by grasping onto the flat outer surfaces of the process cartridge 20.

In addition, in the exemplary embodiment illustrated in FIG. 13, the combination of the notch 80 of the upper extension portion 37 and the notch 119 of the lower extension portion 104 define an open space around the handle 81 such that a user can more easily grasp the handle 81. Therefore, the handle 81 provided at substantially the middle of the developer cartridge 28, along the width direction and at substantially the middle of the upper extension portion 37, along the thickness direction (i.e., the up and down direction) may be securely and easily gripped.

In the exemplary embodiment shown in FIG. 5, the handle 81 is a rod-like member that extends, along the width direction, between facing portions of the upper front side wall 42 in the notch 80. In some embodiments, the handle 81 may be a member that projects from one or both portions of the upper front side wall 42 that extend along the length direction to form side walls of the notch 80, while in some embodiments the handle 81 may continuously extend from the inner portion of the upper front side wall 42 that extends along the width direction and forms the backwall of the notch 80. While the handle 81 may be implemented in various shapes, in exemplary embodiments, as shown in FIG. 3, the handle 81 has a U-like or concave shape in cross-section such that a user can securely and easily grasp onto the front arm of the U-like handle 81.

As shown in FIGS. 13 and 19, the lower side front wall 99 of the drum cartridge 27 extends along the up and down directions as does the upper front side wall 42 of the developer cartridge 28. Thus when the developer cartridge 28 is attached to the drum cartridge 27 the process cartridge 20 has a substantially flat front outer surface 61, with the exception of the notch 80 of the upper extension portion 37 and the notch 119 of the lower extension portion 104. Thus, as discussed above, a user may easily and comfortably handle the process cartridge 20 by wrapping his/her hands around the front of the process cartridge 20 without risking being poked or hurt by projecting portions of the process cartridge 20 and/or damage to and/or contamination of components of the process cartridge 20.

Furthermore, in exemplary embodiments, the notch 119 of the lower extension portion 104 substantially overlaps with the notch 80 of the upper extension portion 37. Thus, when the developer cartridge 28 is attached to the drum cartridge 27, the combination of the notches 80, 119 provide a larger amount of space for a user to grasp the handle 81 during attachment/detachment of the process cartridge 20 to/from the main casing 2. More particularly, in the exemplary embodiment of the process cartridge 20 shown in FIG. 13, the combination of the notches 18, 119 form a substantially rectangular shape when viewed from the front of the process cartridge 20.

In exemplary embodiments, the protruding members 51 of the upper extension portion 37 are received by the receiving portions 120 of the lower extension portion 104 when the developer cartridge 28 is attached to the drum cartridge 27. The protruding members 51 and/or the receiving portions 120 also help reduce the chance of an incorrect developer cartridge 28 being attached to the drum cartridge 27 and/or the developer cartridge 28 being attached to an incorrect drum cartridge 27.

Figure 30:
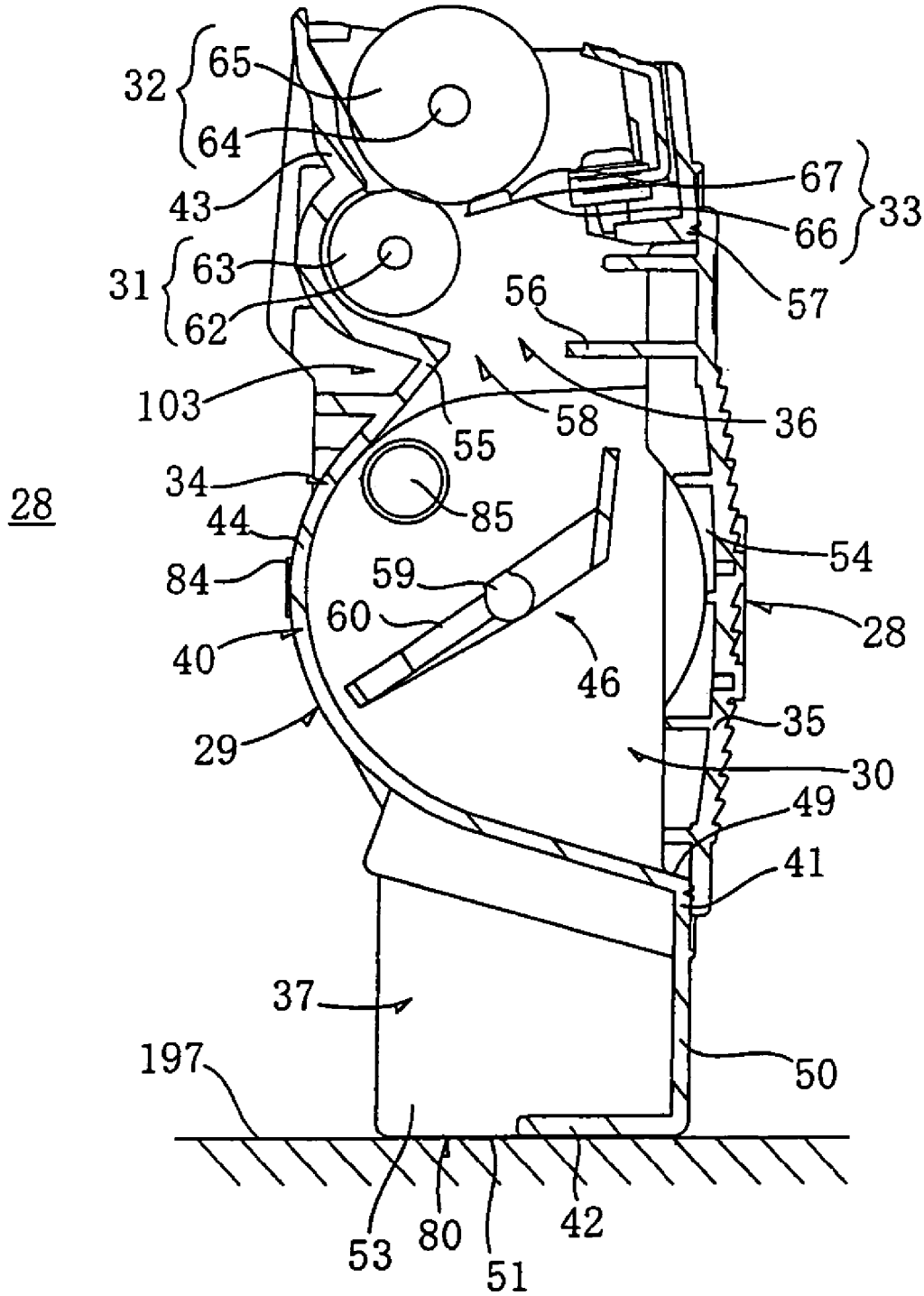
FIG. 30 is a cross sectional view of the developer cartridge shown in FIG. 4.

As a result of the upper front side wall 42 being substantially flat, the developer cartridge 28 has a substantially flat front outer surface 61, as discussed above. Thus, as shown in FIG. 30, the developer cartridge 28 may be situated front side down on a surface 197. Further, while the upper front side wall 42 may itself be sufficient to allow the developer cartridge 28 to be situated front side down on the surface 197, the protruding members 51, which extend substantially across the remaining distance along the thickness (i.e., along the up and down directions) of the developer cartridge 28, from the lower edge of the upper front side wall 42, allow the developer cartridge 28 to be more stably arranged front side down on the surface 197.

By allowing the developer cartridge 28 to be situated front side down on a surface 197, the developer cartridge 28 can be stored, for example, vertically such that damage to the developer roller 32 that may result from the developer roller 32 contacting the surface 197 on which of the developer cartridge 28 is placed, is prevented.

As discussed above, in exemplary embodiments, each of the drum cartridge 27 and the process cartridge 20 also have a substantially flat front outer surface. By providing each of the drum cartridge 27 and the process cartridge 20 with the substantially flat front outer surface when the drum cartridge 27 and/or the process cartridge 20 is removed from the main casing 2, the process cartridge 20 may be situated front side down similar to the developer cartridge 28 shown in FIG. 30.

By storing, for example, the drum cartridge 27 and/or the process cartridge 20 front side down on the surface 197, damage to the photosensitive drum 92, while the process cartridge 20 is outside of the main casing 2, can be reduced, and preferably prevented. During assembly, for example, by situating the developer cartridge 28, the drum cartridge 27 and/or process cartridge 20 front side down, parts, such as a tunnel seal (not shown), can be easily assembled.

In addition, in exemplary embodiments of the developer cartridge 28, the receiving portion 352 helps reduce, and preferably prevent, the attachment of the developer cartridge 28 to an improper image forming device (e.g., an image forming device different from the laser printer 1). By providing the receiving portions 352 in the form of grooves or indentations, rather than as projecting portions, the overall size of the developer cartridge 28 is not increased by the inclusion of the receiving portions 352. Also, by providing the receiving portions 352 in the upper extension portion 37 instead of, for example, along the front portion 44 of the lower wall 40, the volume of the developer housing section 30 (the amount of toner contained in the developer housing section 30) is not reduced.

Further, in the exemplary embodiment, the receiving portion 352 is in the form of an indentation or notch formed along the upper corner of the upper extension portion 37 such that the receiving portion 352 continuously extends from the upper extension wall portion 50 to the front side upper wall 42. Thus, the protruding portions 351 provided, for example, on the front cover 7 can more easily fit into the receiving portions 352 when the process cartridge 20 is attached to the main casing 2 and the front cover 7 is closed by rotating the front cover about its lower end.

Figure 31:
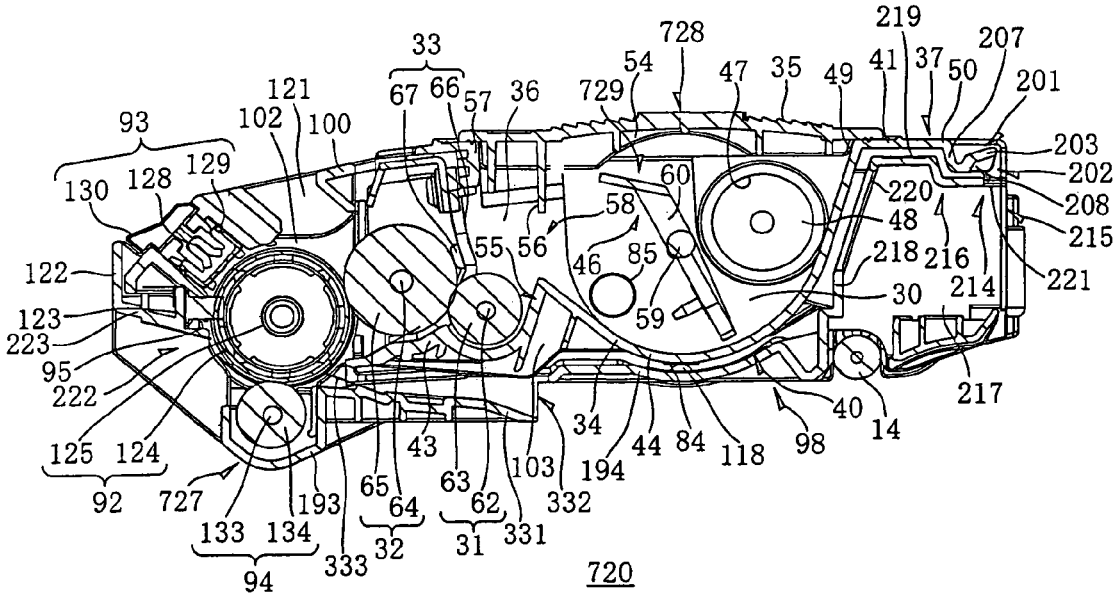
FIG. 31 is a cross sectional view of an exemplary process cartridge including an exemplary developer cartridge and an exemplary drum cartridge.

FIG. 31 is a cross-sectional view, along the length direction, of another exemplary embodiment of a process cartridge 720 including another exemplary embodiment of a developer cartridge 728, and another exemplary embodiment of a drum cartridge 727. The process cartridge 720 shown in FIG. 31 is formed by attaching the developer cartridge 728 to the drum cartridge 727 and like the embodiment described above, the process cartridge 720 may be attached to and detached from the main casing 2. FIGS. 31-41 illustrate some exemplary variations to the exemplary process cartridge 720, the exemplary drum cartridge 727 and/or the exemplary developer cartridge 728 described above in relation to FIGS. 1-30. Thus, in the following description of the exemplary embodiment shown in FIGS. 31-41, elements similar or identical to elements in the exemplary embodiment shown in FIGS. 1-30 are designated by the same reference numerals, and the description thereof may be omitted for the sake of brevity.

Figure 32:
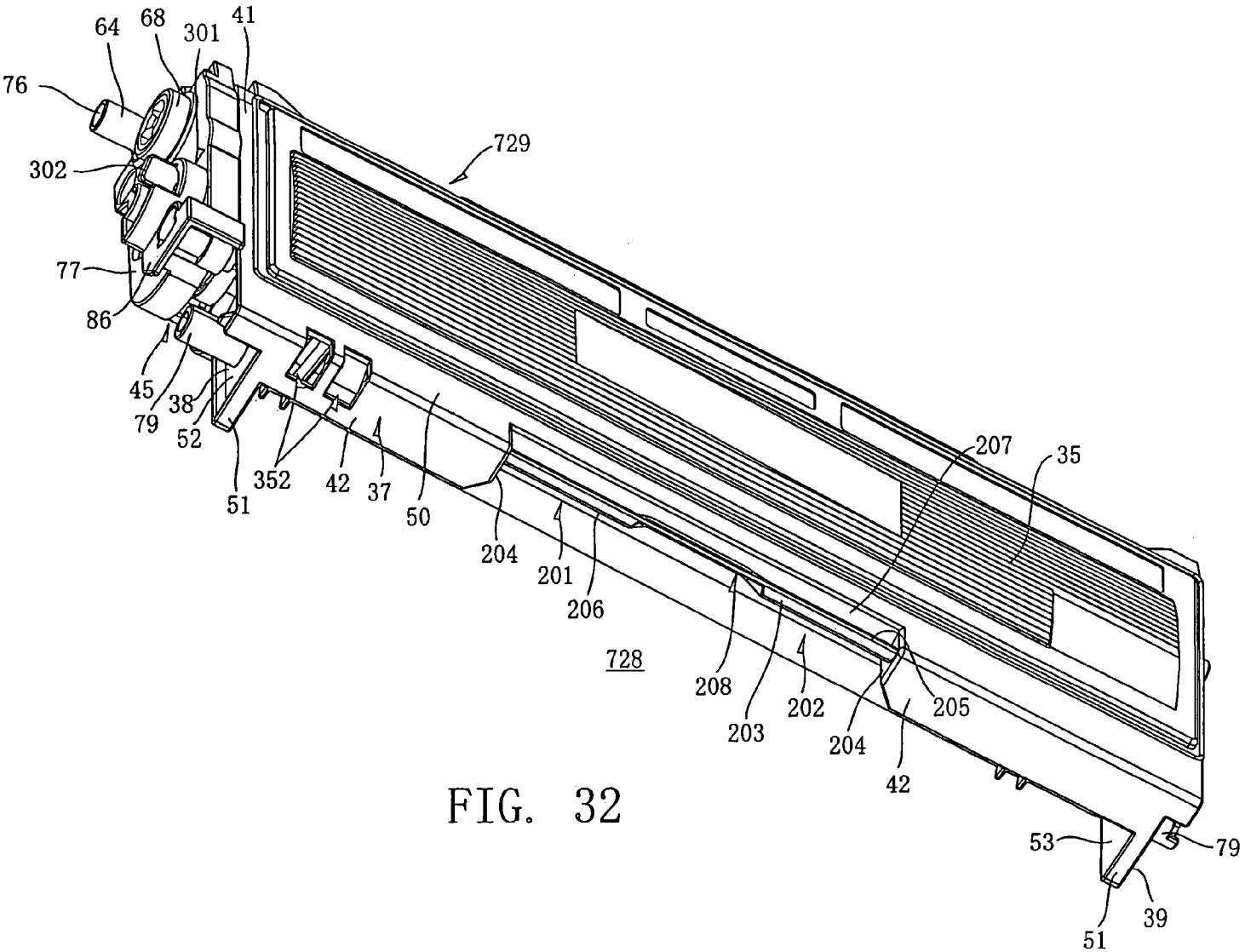
FIG. 32 is a front-top-left perspective view of the developer cartridge shown in FIG. 31.
Figure 33:
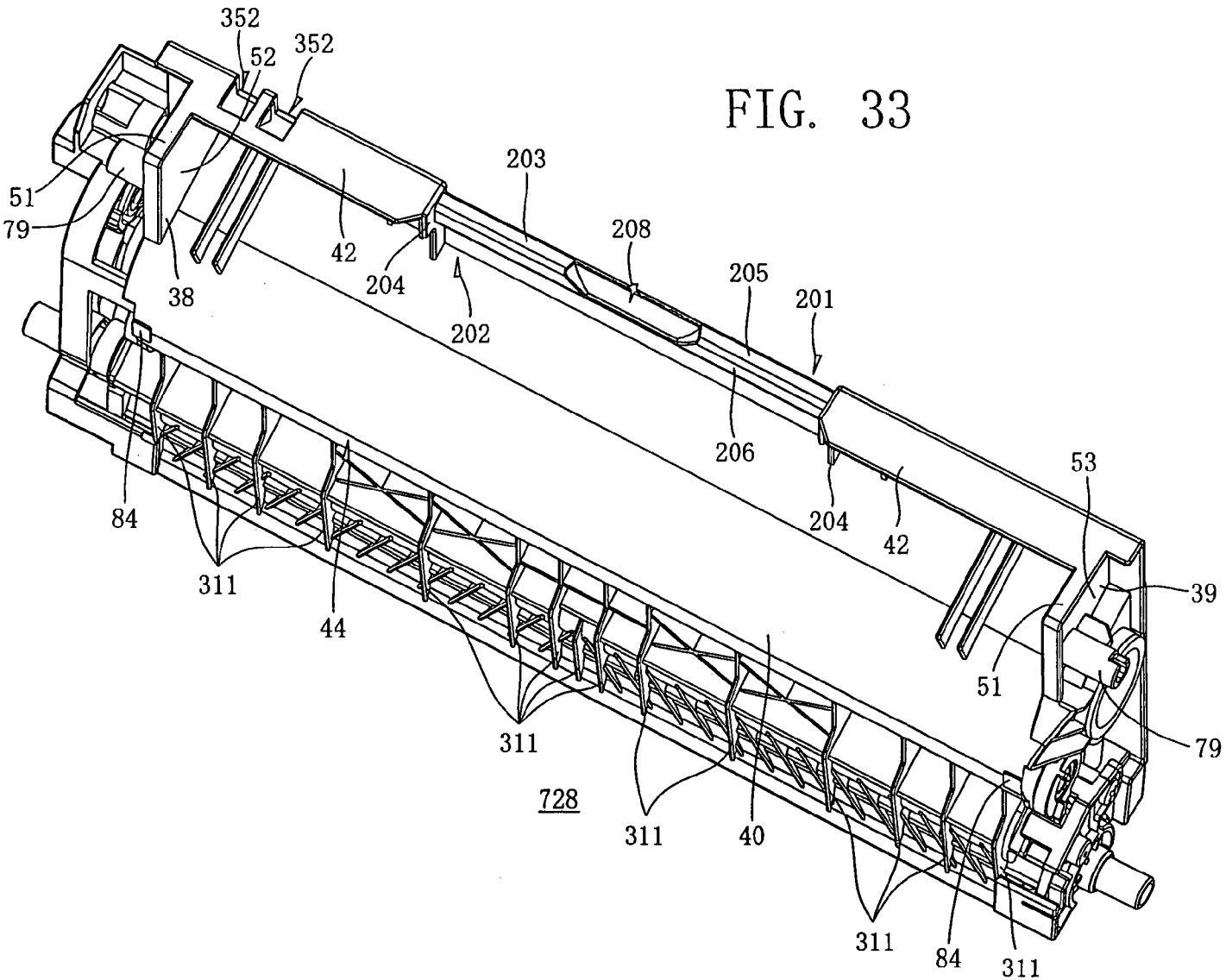
FIG. 33 is a front-bottom-right perspective view of the developer cartridge shown in FIG. 31.
Figure 34:
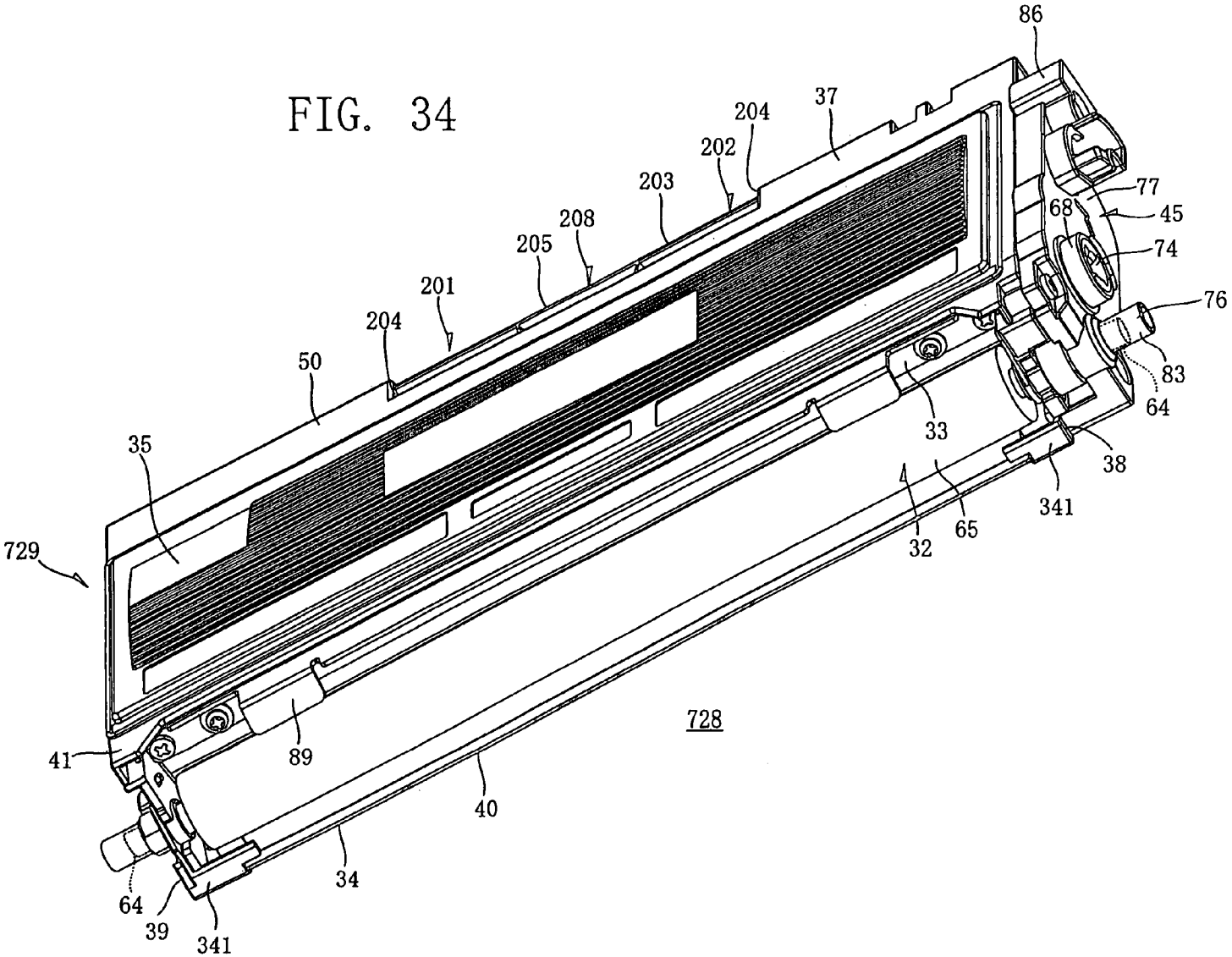
FIG. 34 is a back-top-left perspective view of the developer cartridge shown in FIG. 31.

FIG. 32 is a top-front-left-side perspective view of the developer cartridge 728 shown in FIG. 31; FIG. 33 is a front-bottom-right side perspective view of the developer cartridge 728; and FIG. 34 is a top-back-left-side perspective view of the developer cartridge 728 shown in FIG. 31.

The developer cartridge 728 may include, for example, the developer cartridge casing 729, the developer supply roller 31, the developer roller 32, the agitator 46, and the thickness regulating member 33. The developer cartridge casing 729 rotatably supports the developer supply roller 31, the developer roller 32 and the agitator 46.

The developer cartridge casing 729 may be formed, for example, of a resin material, such as polyethylene, and may have a generally rectangular-like shape with an open back side. The developer cartridge casing 729 may include the lower frame 34 and the upper frame 35. As shown in FIGS. 32 and 33, the lower frame 34 may integrally include, for example, a left side wall 38 and a right side wall 39 positioned facing each other with a space between them along the width direction, a lower wall 40 and an upper wall 41 connecting the left side wall 38 and the right side wall 39, and an upper front side wall 42, provided, for example, at the front edge of the upper wall 41. A back end portion 88 (see FIG. 4) of the upper wall 41 corresponds to the upper one of the back ends 87 of the developer supplying section 36.

As shown in FIG. 33, in some embodiments, the developer cartridge 728 may include a plurality of ribs 311 for guiding the sheet 3 on the outer-bottom surface of the back portion 43. The ribs 311 may extend substantially parallel to each other along the length direction leaving spaces between the ribs 311. Each of the ribs 311 may be formed so as to have a step-like or wave-like shape, when viewed from the left or right side of the developer cartridge 728 and such that the bottom edge of the back portion of the rib 311 is farther from the axis of rotation of the developer roller 32 than the bottom edge of the front portion of the rib 311. The ribs 311 are configured to face the paper guiding ribs 194C, when the developer cartridge 728 is attached to the drum cartridge 727. During operation, the sheet 3 is guided between the ribs 311 and the paper guiding ribs 194C. A portion of the ribs 311 that contacts the sheet 3 and faces the paper guiding ribs 194C is substantially horizontal in the length direction.

FIGS. 32 and 33 illustrate another exemplary embodiment of a gripping portion 201 for gripping and handling the developer cartridge 728 that may be used in some embodiments of the developer cartridge 728 and/or process cartridge 720. Like the gripping portion 78 shown in FIG. 13, the gripping portion 201 may be provided in the upper extension portion 37 of the developer cartridge casing 729. The gripping portion 201 includes, for example, a notch 202, and a handle 203 provided in the notch 202.

The notch 202 may be formed, for example, at substantially the center, along the width direction, of the upper wall extension 50. In exemplary embodiments, the notch 202 is formed as a result of a substantially rectangular shaped cut-out portion, along the width direction, of the front portion of the upper wall extension 50 and the upper portion of the upper front side wall 42. The cut-out portions of the upper wall extension 50 and the upper front side wall 42 may be continuously formed, as shown in FIGS. 32 and 33 such that the handle 203 may be easily accessed by a user.

The notch 202 is defined by two side wall portions 204 and a back wall portion 207 of the upper front side wall 42. The side wall portions 204 face each other and extend, along the length direction, substantially perpendicularly to both the upper front side wall 42 and the upper wall extension 50 and the back wall portion 207 extends, along the width direction, substantially parallel to the upper front side wall 42.

The handle 203 extends between the two side wall portions 204. The handle 203 may have a first wall portion 205 and a second wall portion 206 both of which extend, along the width direction, between the two side wall portions 204. A back end portion of the second wall portion 206 extends continuously from the back wall portion 207 of the upper front side wall 42. A back end portion of the first wall portion 205 extends continuously from a front end portion of the second wall portion 206.

In some embodiments, the second wall portion 206 may be a plate like member that extends substantially horizontally along the width and length directions while the first wall portion 205 may be a plate like member that extends upward from the second wall portion 206 such that the first wall portion 205 and the second wall portion 206 form an angle. In such embodiments, the combination of the back wall portion 207, the first wall portion 205 and the second wall portion 206 may form a U-like shape.

In some embodiments, such as, for example, the exemplary embodiment illustrated in FIGS. 32 and 33, a finger gripping portion 208 may be provided at a substantial middle of the handle 203. In the finger gripping portion 208, the second wall portion 206 may project upward along an incline so as to connect a substantially middle portion of the back wall portion 207 with a substantially middle and top edge of the first wall portion 205. The finger gripping portion 208 may be a substantially semi-circular or rectangular cutout formed along a front end portion of the first wall portion 205.

Figure 41:
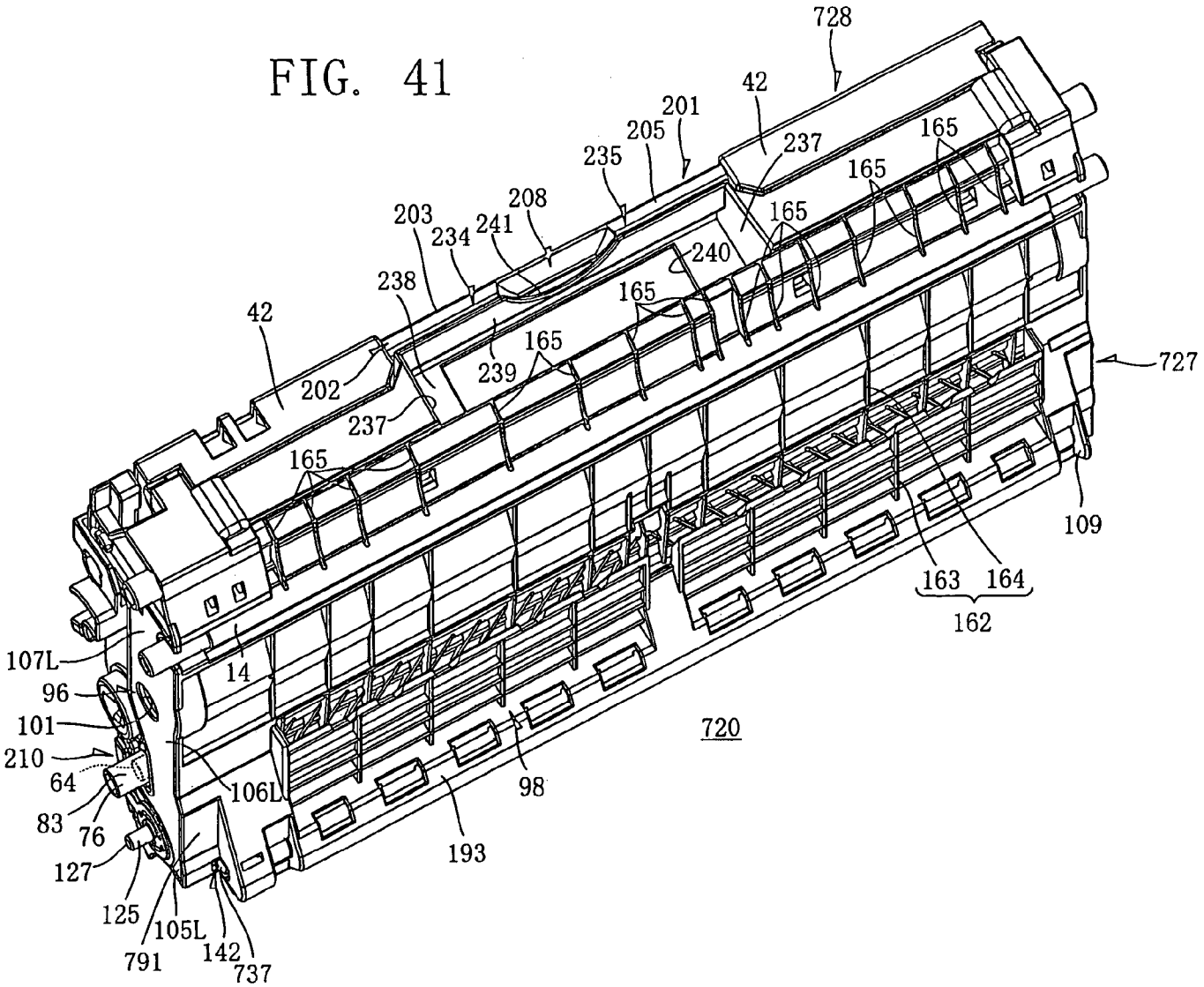
FIG. 41 is a front-bottom-left perspective view of the process cartridge shown in FIG. 31.

FIGS. 35-39 illustrate different views of the exemplary drum cartridge 727 illustrated in FIG. 31. In exemplary embodiments, the transfer electrode opening 142 is a continuous opening formed by a cutout section in each of the second wall 109L and the third wall 110L of the left side wall 96 of the drum cartridge casing 791. The transfer electrode opening 142 has an inverse substantially L-like shape in cross section along the width direction, as shown in FIG. 41. In exemplary embodiments, the transfer electrode 737 has a shape corresponding to the shape of the transfer electrode opening 142. Thus, in exemplary embodiments, the transfer electrode 737 has a substantially L-like shape in cross section along the width direction.

Figure 37:
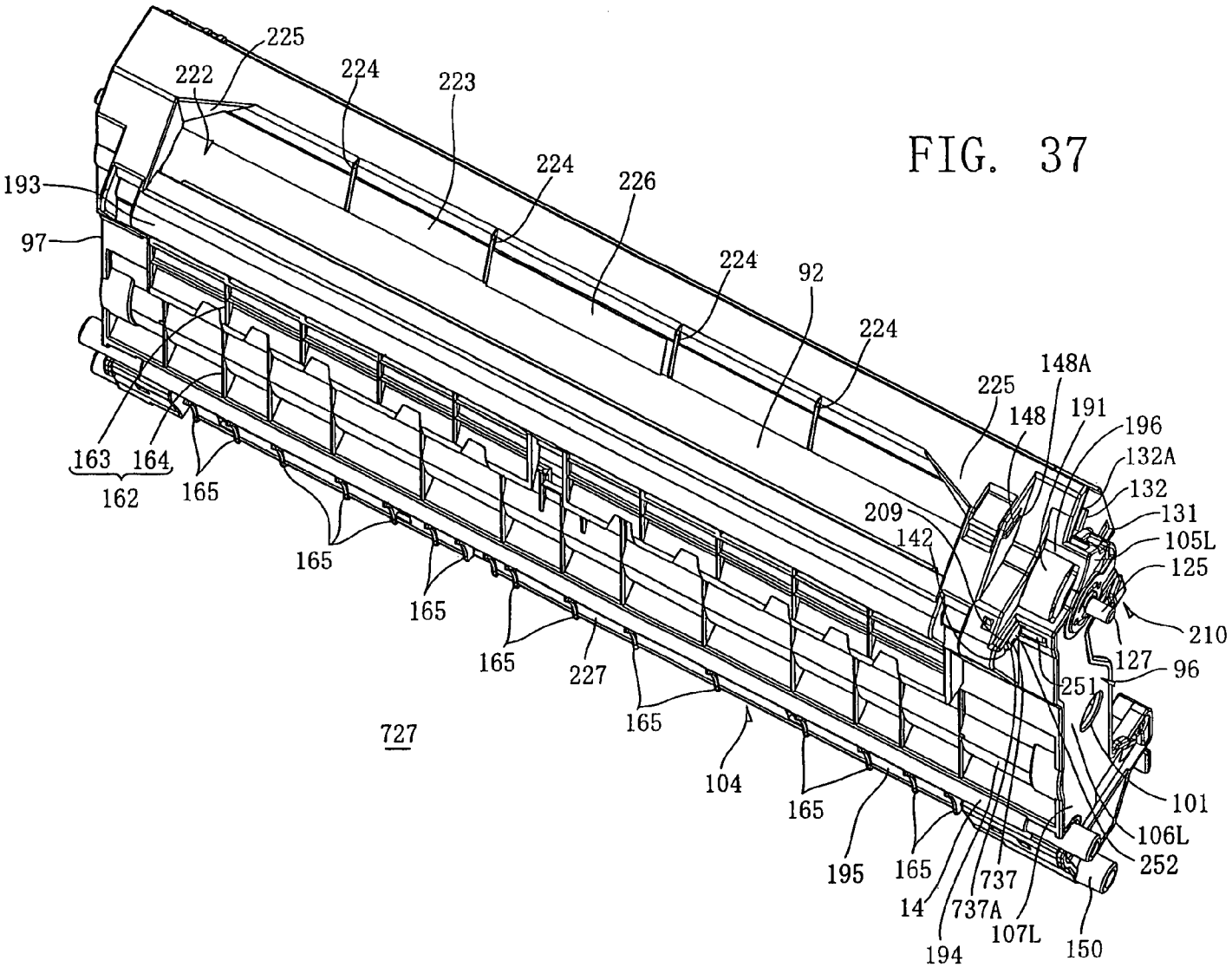
FIG. 37 is a back-bottom-left perspective view of the drum cartridge shown in FIG. 31.

The transfer electrode 737 may be formed of a conductive resin material. As shown in FIG. 37, the transfer electrode 737 may include an electrode contacting portion 252 that protrudes outward, along the width direction and an engaging portion 251 that extends further outward, along the width direction, from the top end portion of the electrode contacting portion 252 so as to form a substantially cross-sectional L-like shape. A contact member (not shown) may be provided on the inner side of the drum cartridge casing 791 (i.e., to the right of the left side wall 96). The contact member may contact the engaging portion 251 of the transfer electrode 737 from above, when the transfer electrode 737 is attached to the drum cartridge casing 791. When the contact member contacts the engaging portion 251, the transfer electrode 737 is prevented from moving or sliding out from the top of the transfer electrode receiving portion 143 during operation of the laser printer 1.

Figure 38:
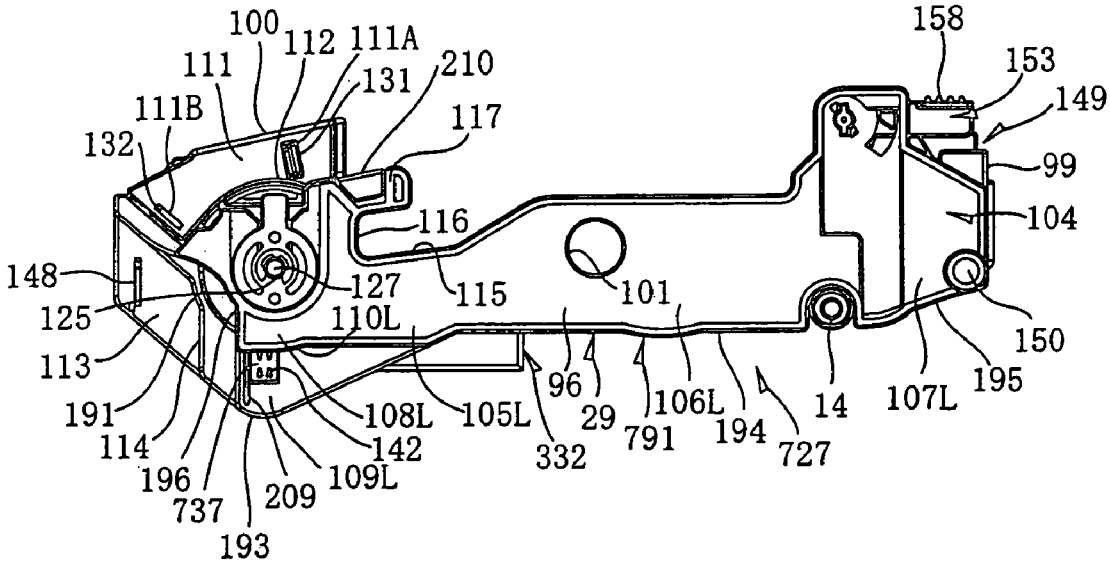
FIG. 38 is left side view of the drum cartridge shown in FIG. 31.

In exemplary embodiments, a blocking member 209 may be provided, for example, behind the transfer electrode opening 142 on the outer surface of the second wall 109L as shown in FIGS. 37 and 38. The blocking member 209 may extend substantially in the up and down direction substantially adjacent to the back border of the transfer electrode opening 142 on the outer surface of the second wall 109L. As a result of the blocking member 209, when the drum cartridge 727 and/or the process cartridge 720 is attached to the main casing 2, the blocking member 209 helps prevent a transfer electrode connecting portion 272, described below, from entering a gap between the transfer electrode holding portion 138 and the transfer electrode 737. Therefore, the transfer electrode connecting portion 272 and the transfer electrode 737 can be accurately connected.

Figure 35:
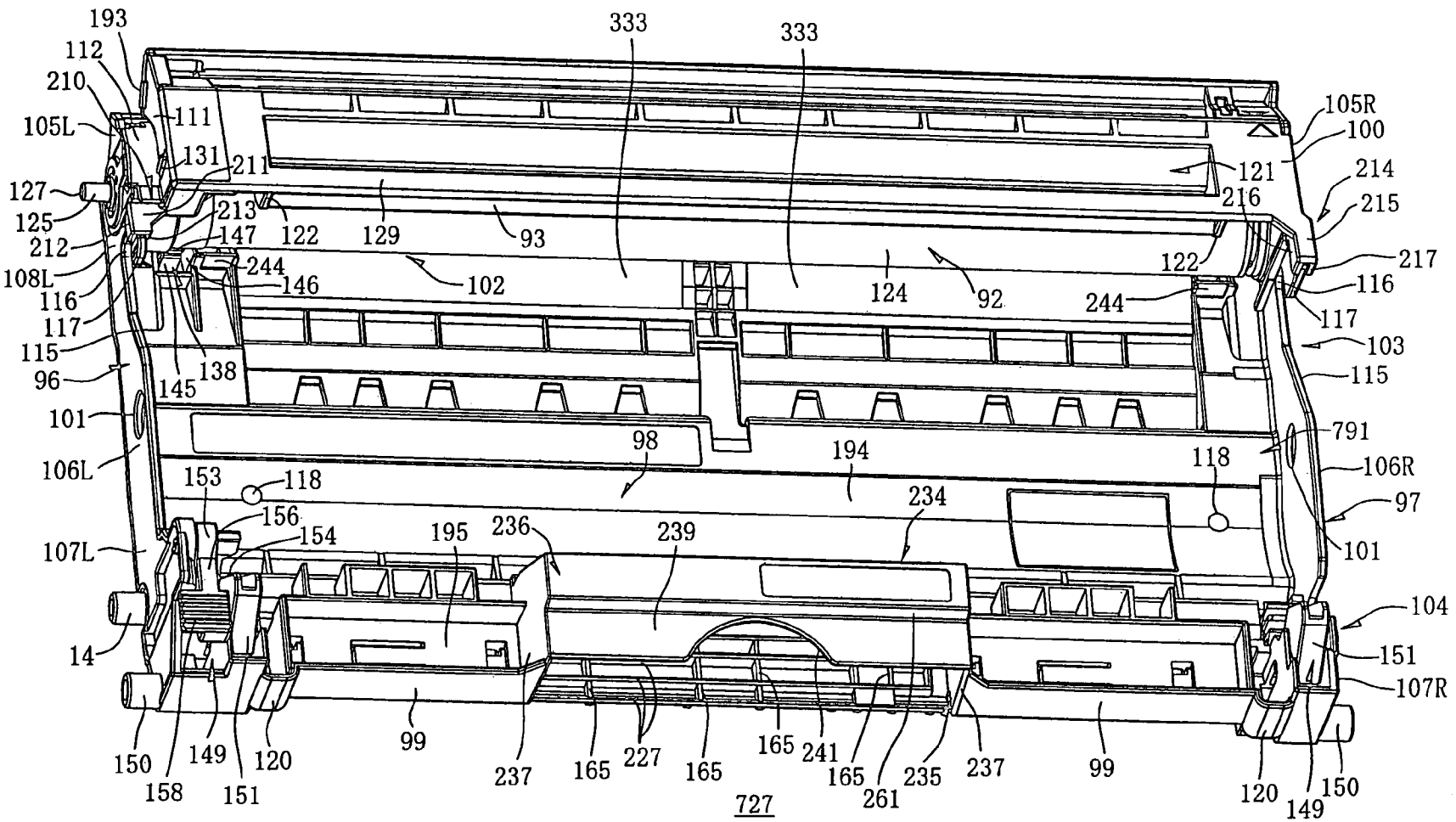
FIG. 35 is a front-top-left perspective view of the drum cartridge shown in FIG. 31.
Figure 39:
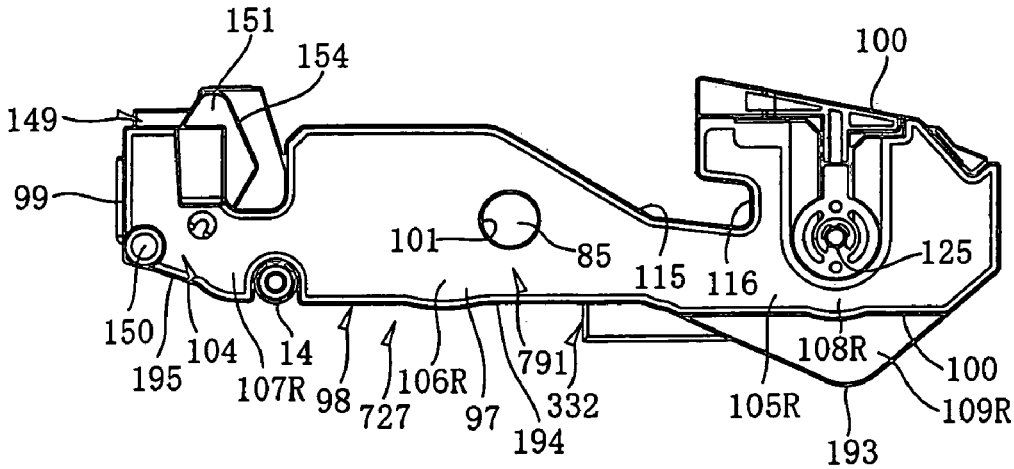
FIG. 39 is a right side view of the drum cartridge shown in FIG. 31.
Figure 40:
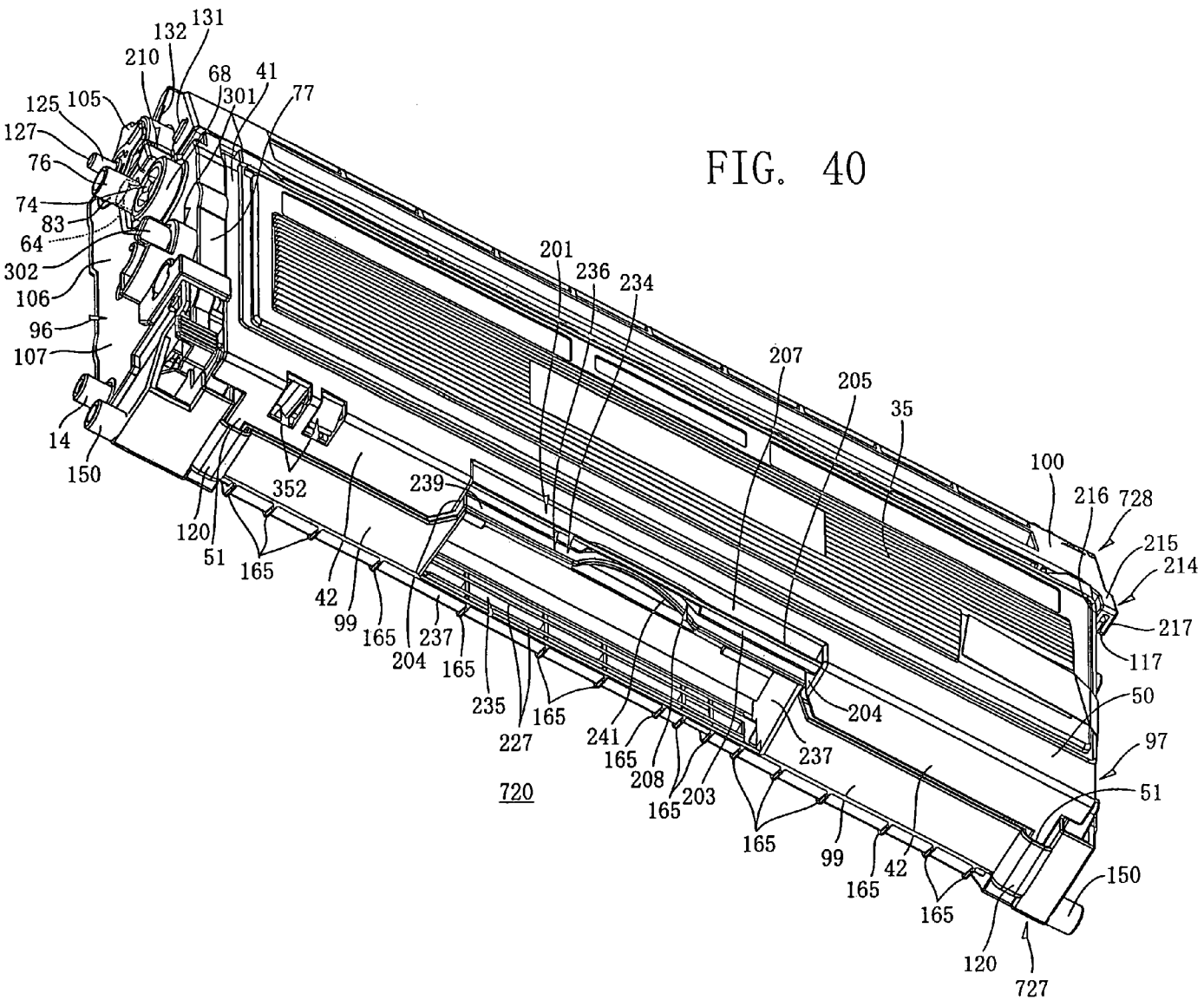
FIG. 40 is a front-top-left perspective view of the process cartridge shown in FIG. 31.

Furthermore, as shown in FIGS. 35, 38 and 39, in some embodiments, a left engaging member 210 and a right engaging member 214 are formed on the left and right ends of the upper back side wall 100. The left engaging member 210 is provided, for example, in front of the fifth wall 112 while, for example, the right engaging member 214 integrally extends from the upper back side wall 100. The left engaging member 210 and the right engaging member 214 may be, for example, downward facing groove-like members that pinch the top portion of the projecting wall 117 of the left side wall 96 and right side wall 97, respectively.

The left engaging member 210 integrally includes, for example, a top plate 211, a left side plate 212 and a right side plate 213. The left side plate 212 faces the right side plate 213 and both extend substantially along the length direction. The left side plate 212 and the right side plate 213 are substantially parallel to each other and are connected at top ends thereof by the top plate 211. The top plate 211 connects the left side plate 212 and the right side plate 213 together and extends outward, for example, from a lower-front-end portion of the fourth wall 111. Thus, the combination of the left side plate 212, the right side plate 213 and the top plate 211 forms an upside down groove capable of receiving the projecting wall 117.

The right engaging member 214, for example, integrally includes a top plate 215 that has, for example, that has a substantially rectangular shape and extends toward the front and connects the upper ends of a left side plate 216 and a right side plate 217. The left side plate 216 and the right side plate 217 are, for example, plate-like members that extend downward from the left and right ends of the top plate 215 so as to form a downward facing groove capable of receiving the projecting wall 117.

As shown in FIG. 37, in some embodiments, a paper exit opening 222 having, for example, a substantially rectangular shape may be provided between the top-back end of the back bottom wall portion 193 and the back end of the upper back side wall 100. After the sheet 3 passed between the photosensitive drum 92 and the transfer roller 94 and the image is transferred to the sheet 3, the sheet 3 is ejected through the paper exit opening 222. The paper exit opening 222 may, for example, be formed wider than the width of the sheet 3 so that the sheet 3 in the letter or A4 size, for example, can pass through.

In addition, on the back bottom wall portion 193, in some embodiments, as shown in FIG. 37, for example, a brush support plate 223 that extends from the top end of the paper exit opening 222 towards the back of the photosensitive drum 92 may be provided. The brush support plate 223 may be arranged such that the back end thereof is at a slightly higher level along the thickness direction than the front end thereof. As shown in FIG. 31, the brush supporting member 123 for supporting the cleaning brush 95 may be provided, for example, along the width direction, on the front end of the brush support plate 223.

Moreover, on the outer surface of the brush support plate 223, a plurality (e.g., 4) of contact preventing ribs 224 may be formed with spaces between them, along the width direction. The contact preventing ribs 224 may extend along the length direction. Furthermore, on the both ends of the outer surface of the brush support plate 223, a contact preventing portion 225 having, for example, a substantially triangular shape when viewing the lower or outer surface of the brush support plate 223, as shown in FIG. 37, may be provided.

The contact preventing portions 225 may be formed by downward bent back corners of the brush support plate 223, as shown in FIG. 37. The contact preventing portions 225 reduce the width of the upper portion of the paper exit opening 222 so as to help prevent the sheet 3 exiting from the paper exit opening 222 from contacting the contact preventing ribs 224 and, more particularly, the lower or outer surface of the brush support plate 223. Thus, right and left edges of the sheet 3 exiting from the paper exit opening 222 may be guided and urged away from the lower surface of the brush support plate 223 by the contact preventing portions 225.

Therefore, the middle portion of the sheet 3, along the width direction, may be prevented from being lifted to the side of the brush support plate 223. Thus, the brush support plate 223 and the contact preventing ribs 224 help reduce and preferably prevent the toner image transferred to the sheet 3 from contacting the brush support plate 223. As a result, contamination of the bottom surface of the brush support plate 223 by the toner may be reduced, and preferably prevented, and the quality of the toner image transferred to the sheet 3 may be maintained.

More particularly, as shown in FIG. 37, in some embodiments, the contact preventing ribs 224 may be provided on the lower surface of the brush support plate 223. The contact preventing ribs 224 may extend from the top end of the paper exit opening 222 toward the back side of the photosensitive drum 92. The contact preventing ribs 224 help reduce, and preferably prevent, the sheet 3, onto which the toner image has been transferred, from contacting the lower surface of the brush support plate 223. That is, in the event that the sheet 3 approaches the brush support plate 223 while exiting through the paper exit opening 222, the sheet 3 will contact the contact preventing ribs 224, which project from the lower surface of the brush support plate 223 instead of contacting the lower surface of the brush support plate 223.

Therefore, the lower surface of the brush support plate 223 is prevented from becoming dirty by toner that can later transfer to another portion of the exiting sheet 3 or a following sheet 3 and that can degrade the quality of the toner image transferred thereon. Thus, the contact preventing ribs 224 help reduce, and preferably prevent, contamination of the brush support plate 223 such that the sheet 3 exiting from the paper exit opening 222 does not get contaminated and the quality of the toner image transferred to the sheet 3 can be maintained.

In substantially a center of the lower surface of the brush support plate 223, a substantially rectangular film member 226 may be provided as shown in FIG. 37. The film member 226 may be, for example, slightly wider than the width of the pickup roller 12 along the width direction. The film member 226 may be formed of a resin material, such as polyethylene terephthalate. The film member 226 may be positioned so as to slightly project from the front end of the brush support plate 223 toward the front (e.g., toward the photosensitive drum 92).

The film member 226 may be adhered to substantially the center portion of the lower surface of the brush support plate 223 by, for example, a double-sided adhesive tape. The double-sided adhesive tape may be provided to the front end of the film member 226 (and positioned adjacent to the photosensitive drum 92). That is, the double-sided adhesive tape may also be provided at the portion of the film member 226 that projects, for example, forward from the end of the brush support plate 223.

By positioning the film member 226 at substantially the center portion of the lower surface of the brush support plate 223 so as to slightly project beyond the front edge of the brush support plate 223 towards the front side of the drum cartridge 727 (i.e., towards the photosensitive drum 92), the paper dust removed from the surface of the photosensitive drum 92 by the cleaning brush 95 can be received by the film member 226. In addition, by also providing the double-sided adhesive tape at a part of the film member 226 projecting from the front end of the brush support plate 223, the paper dust received form the cleaning brush 95 adheres to the adhesive surface of the double-sided adhesive tape, and thus the paper dust is prevented from flying off the film member 226.

In some embodiments, as shown in FIG. 35, a drum cartridge handle 234 may be provided. The drum cartridge handle 234 may, for example, be provided in the lower extension portion 104. The drum cartridge handle 234 may include, for example, a notch 235 and a drum cartridge grip 236. The drum cartridge grip 236 may, be formed by a substantially upward table-like or inverse U-like projecting portion of the bottom extension wall portion 195 of the lower extension portion 104. The drum cartridge grip 236 may be gripped, for example, to remove/attach/handle the drum cartridge 727 and/or the process cartridge 720 when the developer cartridge 728 is attached to the drum cartridge 727.

More particularly, the notch 235 may be formed at substantially the central portion of the lower side extension portion 104 along the width direction. The bottom extension wall portion 195 and the lower front side wall 99 may be continuously cut out so that the front end portion of the bottom wall extension portion 195 is cut out in, for example, a substantially rectangular shape along the width direction in the plan view. The notch 235 may be formed to have a width slightly smaller than the notch 202 formed on the upper wall extension 50 of the developer cartridge 728.

The drum cartridge grip 236 may integrally include a pair of side support members 237 extending upward substantially perpendicular from the left and right sides of the notch 235. The drum cartridge grip 236 may further include a back support member 238 that extends at a slight incline from the front bottom wall portion 194 towards the upper back end portion of the drum cartridge grip 236. The drum cartridge grip 236 may further include a top surface portion 239 having, for example, substantially rectangular shape in plan provided between the top ends of the side support members 237 and the back support member 238.

Figure 36:
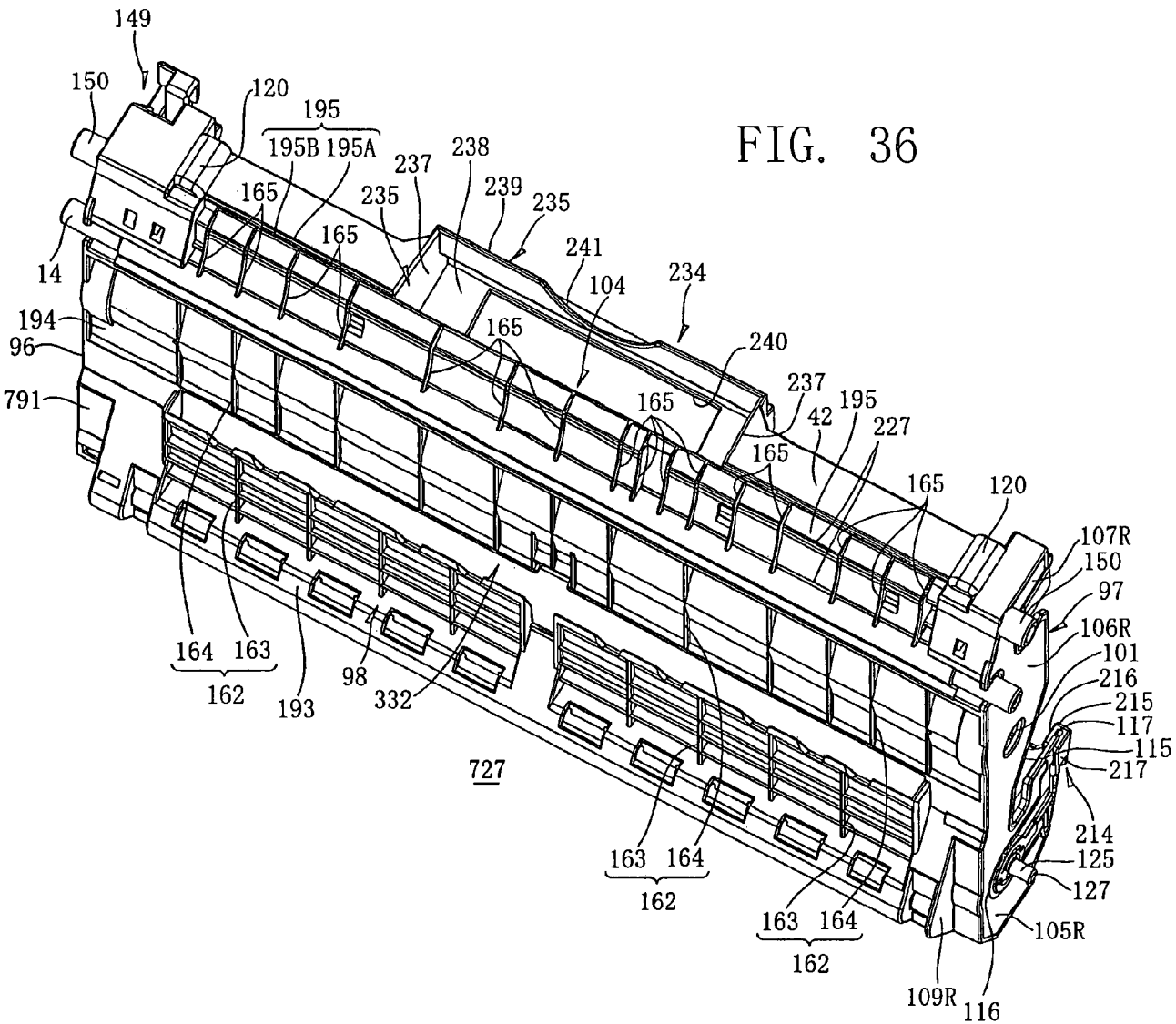
FIG. 36 is a front-bottom-right perspective view of the drum cartridge shown in FIG. 31.

Further, as shown in FIG. 36, an opening 240 may be formed on the back support member 238. The opening 240 may have a rectangular like shape, when viewed from the front. The opening 240 exposes the lower extension portion 104 to the developer cartridge housing portion 103 of the drum cartridge 727. Thus, when gripping the top surface portion 239 and the handle 203 together, fingers can be inserted, through the opening 240, such that the fingers may contact the front portion 44 of the lower wall 40 of the developer cartridge 728 when the developer cartridge 728 is attached to the developer cartridge housing portion 103. As a result, attachment and detachment of the process cartridge 720 with respect to the main casing 2 can be more accurately achieved.

In addition, in such embodiments, to detach the developer cartridge 728 from the drum cartridge 727, it is possible for a user to only grip the handle 203 via the finger gripping portion 208 that overlaps a cutout portion 241 of in the top surface portion 239.

Furthermore, as shown in FIG. 37, the drum cartridge grip 236 may fit within the notch 202 of the developer cartridge 728 when the developer cartridge 728 is attached to the drum cartridge 727. The top surface portion 239 may be shaped and/or sized so as to be slightly smaller than the notch 202, along the width direction such that when the developer cartridge 728 is attached to the drum cartridge 727, the top surface 239 extends substantially between the pair of side wall portions 204 of the developer cartridge 728.

On the top surface portion 239, a step 261 may be formed so that the substantially back half portion of the top surface portion 239 is relatively higher than the substantially front half portion of the top surface portion 239. Further, because the step 261 is formed on the top surface portion 239 such that the substantially back half portion becomes relatively high, and that the substantially front half portion becomes relatively low, the fingers can be hooked to the step 261 when gripping the top surface portion 239 and the handle 203 together. As a result, holding the top surface portion 239 and the handle 203 becomes easier, and integral attachment and detachment of the drum cartridge 727 and the developer cartridge 728 with respect to the main casing 2 can be performed more accurately.

As shown in FIG. 35, the cutout portion 241 may be formed at the top surface portion 239 at a part overlapping the finger gripping portion 208 of the handle 203 of the developer cartridge 728. The cutout portion 241 may, for example, have a substantially semicircular shape extending along the length and width directions. In some embodiments, when the developer cartridge 728 is attached to the drum cartridge 727 a very small gap exists between the top surface portion 239 and the handle 203. In some embodiments, when the developer cartridge 728 is attached to the drum cartridge 727, the top surface portion 239 and the handle 203 are in contact with each other.

As a result, as shown in FIGS. 37 and 41, when the developer cartridge 728 is attached to the drum cartridge 727, the handle 203 and the drum cartridge grip 236 can be gripped together with the finger gripping portion 208 of the handle 203. Because, for example, the top surface portion 239 of the drum cartridge grip 236 is positioned to overlap with the handle 203 provided on the upper extension portion 37 of the developer cartridge 728, the top surface portion 239 and the handle 203 can be easily gripped together. As a result, the drum cartridge 727 and the developer cartridge 728 can be easily gripped together and integrally attached to and/or detached from the main casing 2.

That is, the developer cartridge 728 is prevented from separating from the drum cartridge 727 when attaching and/or detaching the drum cartridge 727 and the developer cartridge 728 to the main casing 2 while the drum cartridge 727 and the developer cartridge 728 are in an attached state. More particularly, when the developer cartridge 728 is attached to the drum cartridge 727 and the drum cartridge grip 236 is gripped, the top surface portion 239 supports the handle 203 thereon such that both the drum cartridge 727 and the developer cartridge 728 can be easily handled in the attached state.

Referring now to the bottom extension wall portion 195, as shown in FIG. 36, the front bottom ribs 165 may be provided on the outer-bottom surface of the bottom extension wall portion 195 of the bottom wall 98 along the width direction including the bottom side of the notch 235 formed in the lower front side wall 99. As discussed above, the front bottom ribs 165 may be formed separately from the drum cartridge casing 791 and with a resin material, such as a polyacetal resin, that is harder than the material of the developer cartridge casing 729 and the drum cartridge casing 791.

Thus, if the front bottom ribs 165 become worn as a result of contact with sheet 3, the front bottom ribs 165 can be replaced without having to replace the entire drum cartridge 727 and/or the process cartridge 20. More particularly, in the exemplary embodiment illustrated in FIG. 36, for example, the plurality of the front bottom ribs 165 are positioned with spaces between them along the width direction and so as to extend along the length direction. The front bottom ribs 165 may be attached to the lower surface of the bottom extension wall portion 195 by, for example, being connected to a connecting member 227 extending along the width direction.

Thus, on the lower surface of the bottom extension wall portion 195 of the bottom wall 98 of the drum cartridge 727, the front bottom ribs 165 may be attached as part of the connecting member 227 positioned so as to extend along the width direction at least so as to cover the space between the lower ends of the side support members 237. As a result, the strength (rigidity) of the side supporting members 237 and the drum cartridge grip 236 can be increased by integrally forming the side supporting members 237 and the drum cartridge grip 236 from the bottom extension wall portion of the bottom wall 98, while the front bottom ribs 165 may be made from a stronger material than the material used to form the drum cartridge casing 791.

Thus, in some embodiments, the connecting members 227 may be formed of a material that is stronger than the material from which the drum cartridge casing 791 is made. In some embodiments, the bottom extension wall portion 195 of the bottom wall 98 may continuously extend substantially between the left and right sides of the lower extension portion 104 and integrally include a projecting portion for the drum cartridge handle 234.

Figure 42:
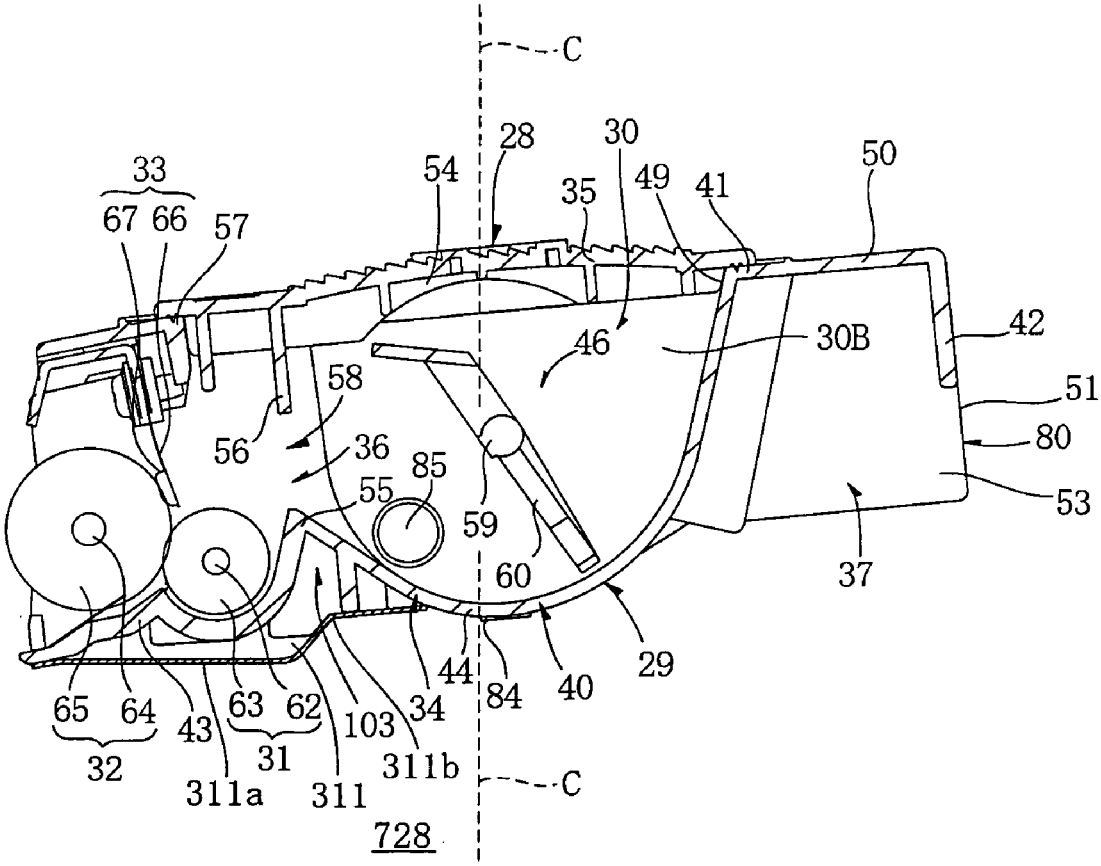
FIG. 42 is a cross sectional view the developer cartridge shown in FIG. 31.

Referring now to FIG. 42, in the exemplary embodiment shown in FIG. 42, the back end portion (i.e., the portion on the left side of line C in FIG. 42) of the developer cartridge 728 may include paper guides, such as ribs 311. The ribs 311 may extend substantially parallel to each other along the length direction and with spaces between the ribs 311 in the width direction. Each of the ribs 311 may be formed so as to have a step-like or wave-like shape, when viewed from the left or right side of the developer cartridge 28, such that the bottom edge of the back portion of each rib 311 is farther from the axis of rotation of the developer roller 32 than the bottom edge of the front portion of the rib 311 (i.e., a thickness of each rib decreases from back to front or the thickness of each rib varies in the length direction). When the developer cartridge 728 is attached to the drum cartridge 27, the portion of the ribs 311 that contacts the sheet 3 may be substantially horizontal along the length direction.

Figure 43:
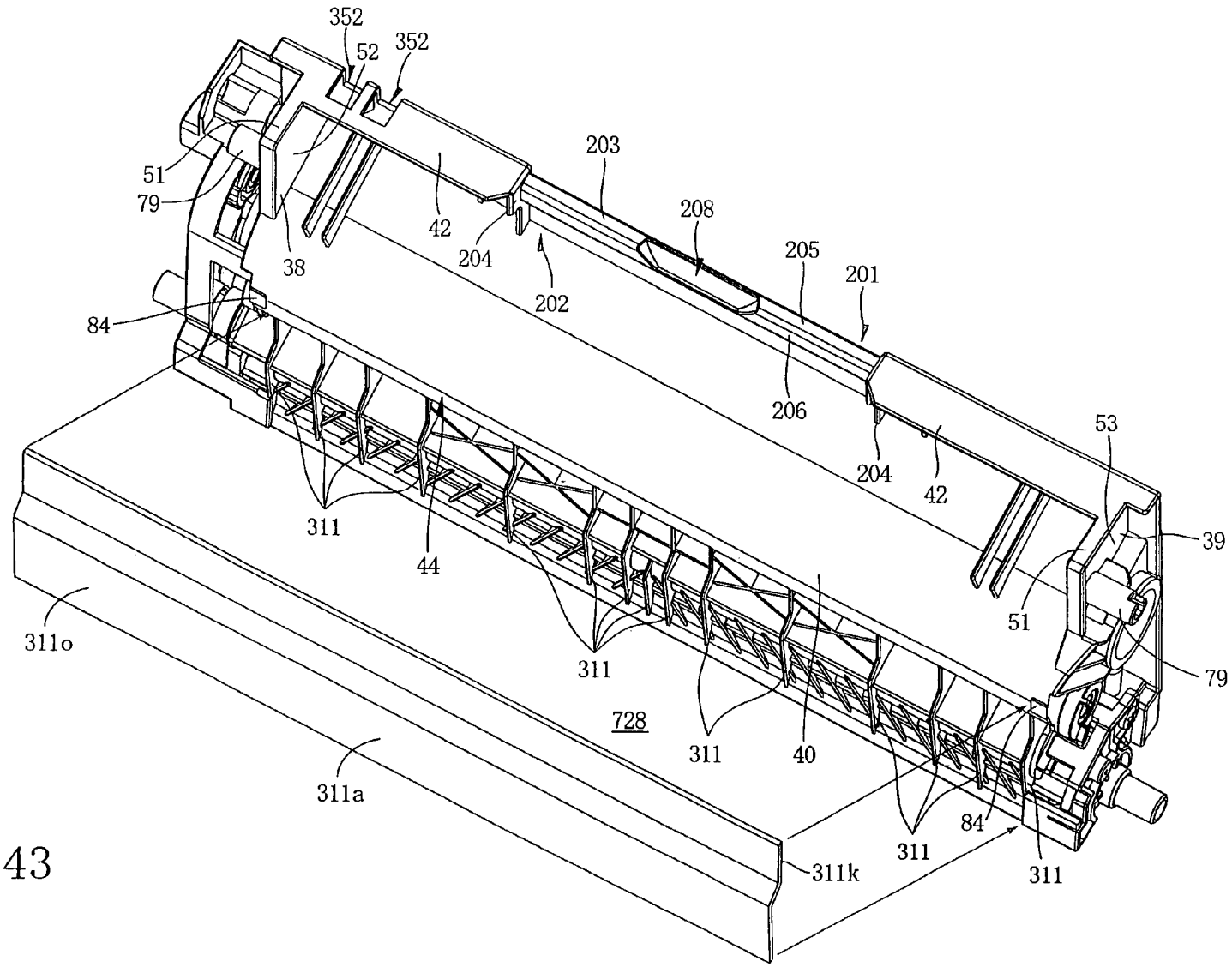
FIG. 43 is a front-bottom-right perspective view of the developer cartridge shown in FIG. 42 showing attachment of an exemplary guiding film to the cartridge.
Figure 44:
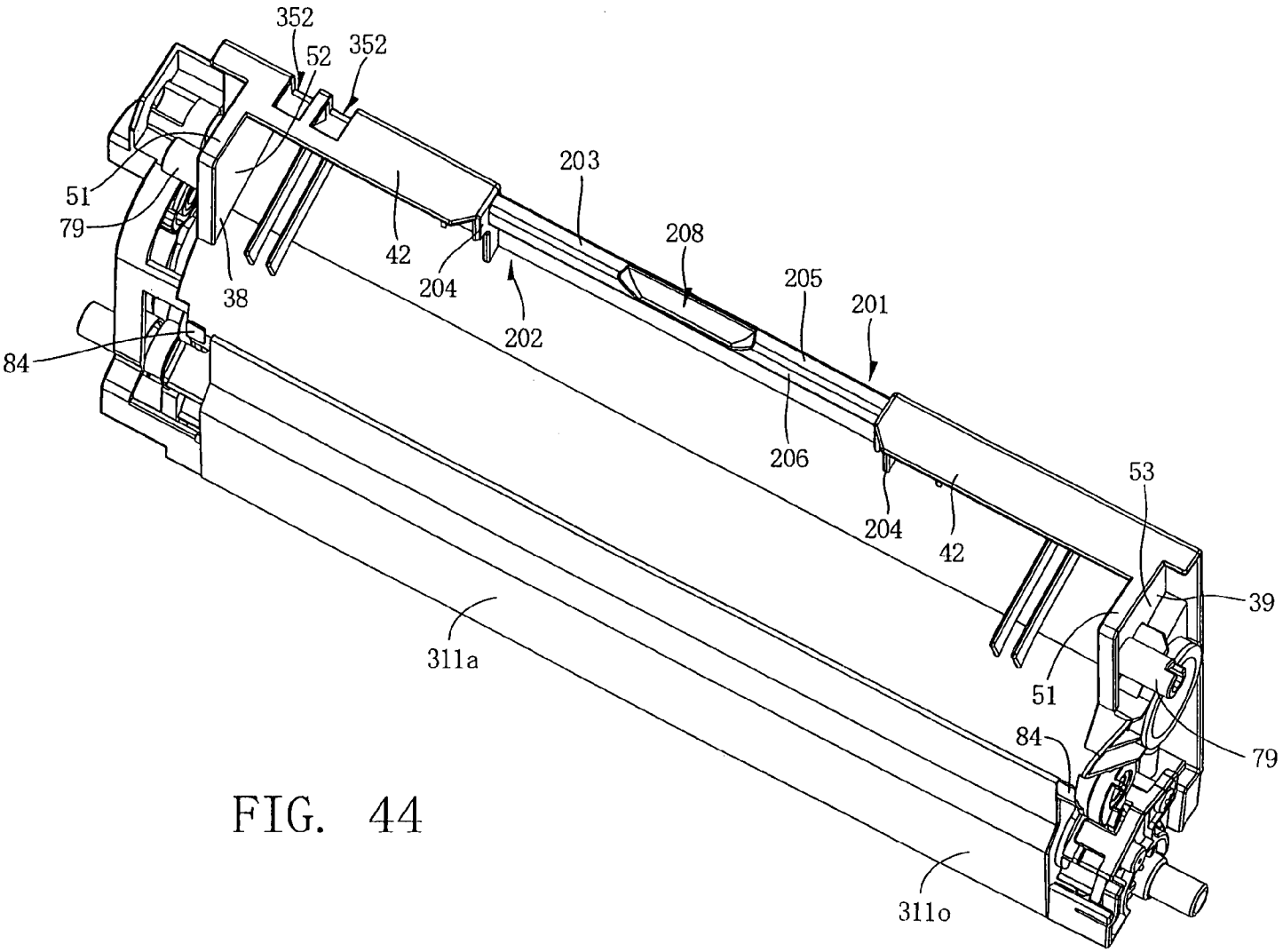
FIG. 44 is a front-bottom-right perspective view of the developer cartridge shown in FIG. 42, showing the exemplary guiding film shown in FIG. 43 in an attached state.

As shown in FIGS. 42 and 43, in some embodiments, both the ribs 311 and a guiding film 311*a* may be provided to guide the sheet 3 downstream (i.e., towards the photosensitive drum 92) during printing, along the bottom surface of the back portion 43 of the lower wall 40. As shown in FIGS. 43 and 44, the guiding film 311*a* may be arranged so that it covers all or substantially all of the ribs 311.

As shown in FIGS. 43 and 44, the guiding film 311*a* may be wider than the sheet 3 and may have a shape in the length direction corresponding to a shape of a contacting surface/portion 311*b* (i.e., lowermost edges) of the ribs 311. The guiding film 311*a* may be made of polyethylene terephthalate and held in place at adhesion areas 311*c* and 311*d* (see FIG. 48) that may be provided on the lower wall 40. The adhesion areas 311*c* and 311*d* may be provided at the back end portion and the front end portion of the ribs 311.

In embodiments where a guiding film is part of a developer cartridge, the guiding film 311*a* may become damaged as a result of friction generated between the guiding film and the sheet 3 being fed through the laser printer 1 during printing. Thus, the lifetime of such developer cartridges may not be limited by the use of all of the toner in the developer housing section 30 because toner may be refilled by using the developing agent supply opening 47, the guiding film of the developer cartridge, if damaged, may hinder the image forming process. For example, the surface of the guiding film may become jagged or irregular and cause damage to the sheet 3 or cause the sheet 3 to become jammed or improperly guided within the laser printer 1 during printing.

In embodiments where the guiding film 311*a* is made to be attachable to and detachable from the developer cartridge 28, 728 as shown in FIGS. 42-50, when the guiding film 311*a* is damaged, the guiding film 311*a* may be replaced without having to replace the developer cartridge 28, 728. Thus, in such embodiments, in general, damage or wear to the guiding film 311*a* should not trigger the end of the lifetime of the developer cartridge 28, 728.

Additionally, the guiding film 311*a* may be arranged so that it is closer to the developer roller 32 than the center of the image-developing casing 29 in the length direction (i.e., line C in FIG. 42). As a backmost portion of the guiding film 311*a* may extend toward and be very close to the photosensitive drum 92, the sheet 3 that is fed through the opening 332 of the drum cartridge 27 can be guided without mishap to the photosensitive drum 92. Also, because there are no seams between the opening 332 and the photosensitive drum 92, the sheet 3 can be transported smoothly.

In some embodiments, the guiding film 311*a* may be made of a different material than that of the lower frame 34. Thus, it may be possible to adjust the electrical potential of the sheet 3. More specifically, by using an electrically conductive material that provides better discharge characteristics to the guiding film 311*a*, as compared to the material used to form the lower frame 34, it is possible to reduce, and preferably eliminate, any electrostatic charge and high levels of resistance that the sheet 3 might have prior to the image forming process.

As a result, because this sort of adjustment of the electric potential of the sheet 3 can be carried out before the image is transferred to the sheet 3, the image forming and, in particular, the image-transfer process (i.e., the process in which an image is transferred from the photosensitive drum 92 to the sheet 3) can be made more stable. Alternatively, by using the guiding film 311*a* that has less electrical conductivity than the lower frame 34 and higher levels of electrostatic characteristics, it may be possible to adjust the electrical potential of the sheet 3 before the image transfer process takes place.

Also, because the guiding film 311*a* may be made of a different material than the lower frame 34, for example polyacetal or some other substance that is harder than the developer cartridge casing 29, 729, it is possible to restrict even further, the occurrence of paper jams caused by paper catching onto portions of the developer cartridge 28, 728 that have been re-used and/or recycled. Additionally, because of the improved wear resistance of such materials, although the guiding film 311*a* may be easily replaced, the harder material will likely increase the general lifetime of the guiding film 311*a*.

Figure 45:
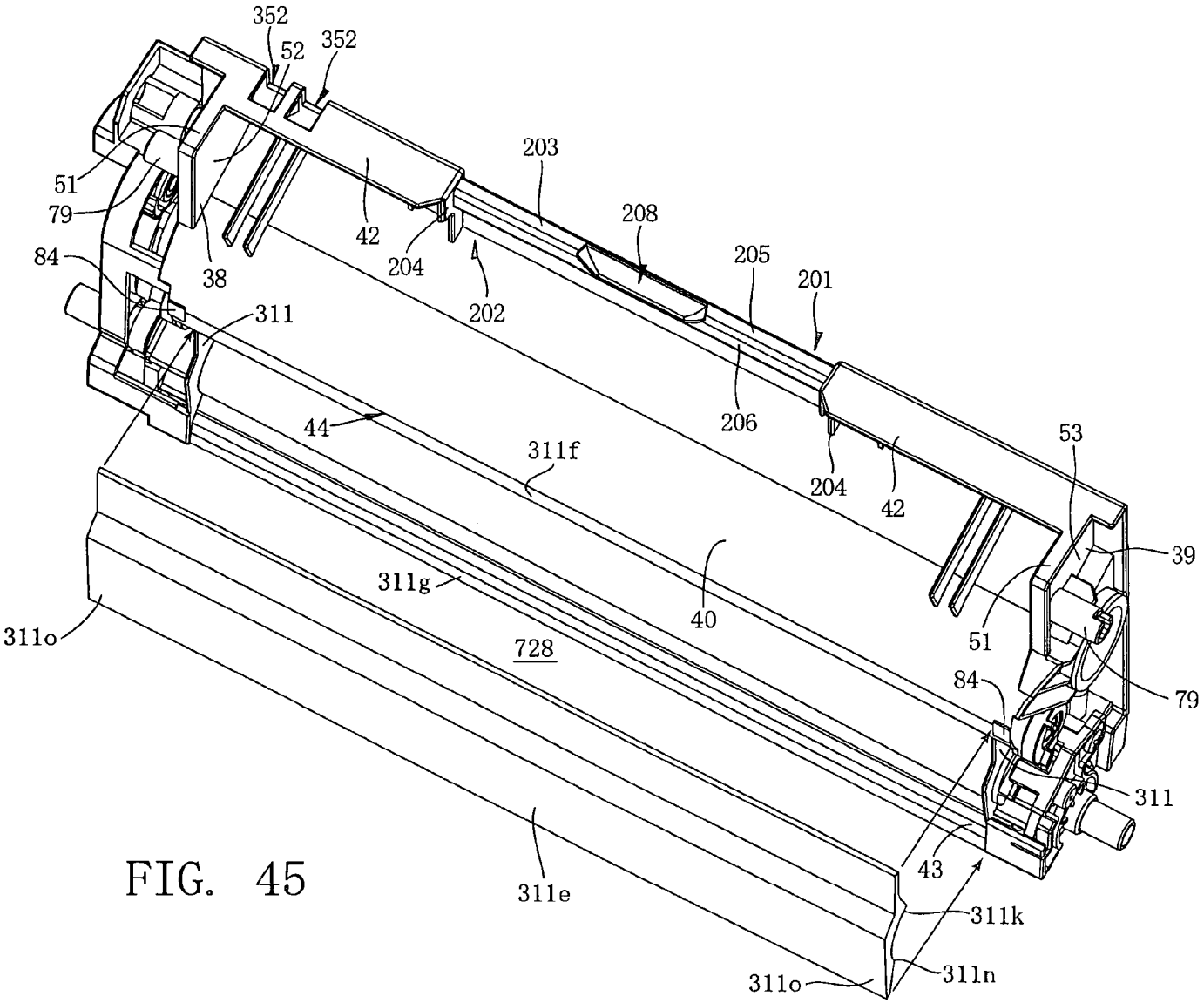
FIG. 45 is a front-bottom-right perspective view of the exemplary developer cartridge shown in FIG. 31 showing attachment of an exemplary guide to the cartridge.
Figure 46:
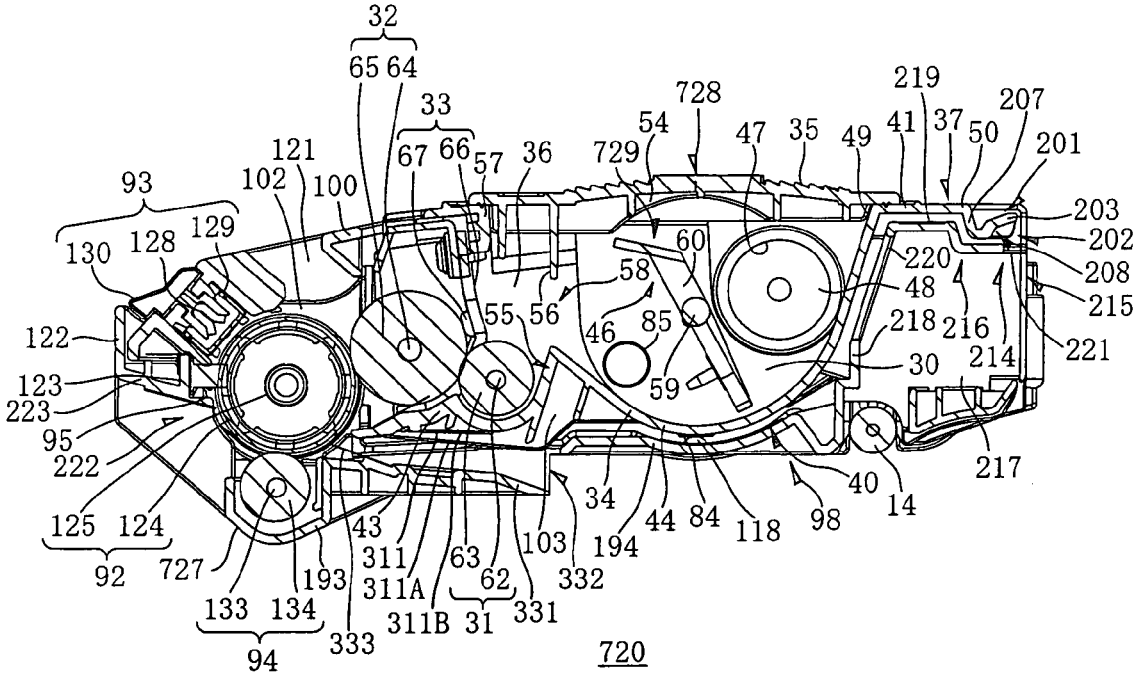
FIG. 46 is a cross sectional view of the process cartridge shown in FIG. 31 and employing the guide shown in FIG. 45.

Referring now to FIGS. 45 and 46, in some embodiments, a guide 311*e* may be attached to the developer cartridge 728. As shown in FIG. 45, the guide 311*e* may have a shape similar to the film 311*a* discussed above that corresponds to the shape of the lower surface of the ribs 311. In embodiments, the ribs 311 may be provided, for example, only on the left and right ends of the developer cartridge 728 such that when the guide 311*e* is attached, the guide 311*e* fits between the ribs 311 on the left and right sides of the developer cartridge 728. In some embodiments, the bottom surface of the back portion 43 of the lower wall 40 may be covered by the guide 311*e*. In some embodiments, the guide 311*e* may only cover some of the back portion 43 of the lower wall 40. The gap between the ribs 311 is larger than the maximum width of sheet 3 that may pass through.

In some embodiments, as shown in FIG. 45, a wall facing surface 311*k* of the guide 311*e* may include projections (e.g., ribs) 311*n* corresponding to the shape of the back portion 43 of lower wall 40 of the developer cartridge 728.

As shown in FIG. 45, the guide 311*e* may be detachably attached to the back portion 43 of the lower wall 40 and/or the ribs 311. The guide 311*e* may also be wider than the sheet 3 that is being transported. The back portion 43 of the lower wall 40 may include adhesion areas 311*f* and 311*g* to the front and to the back of the ribs 311 for attaching the guide 311*e*. The adhesion areas 311*f*, 311*g* may be, for example, in the form of double-sided tape.

The guide 311*e* may be replaced to help increase the lifetime of the developer cartridge 28, 728. Moreover, just as with the exemplary embodiment illustrated in FIGS. 43 and 44, if a plastic material or another material with better electrical conductivity than the lower frame 34 is used as the material for the guide 311*e*, the electrical potential of the sheet 3 can be adjusted in advance of image transfer process. Thus, it is possible to stabilize the image transfer process. Because the guide 311*e* and the lower frame 34 are separate members, if the material of the guide 311*e* is more durable than that used for the lower frame 34, then the occurrence of paper jams can be reduced, and preferably prevented.

Figure 47:
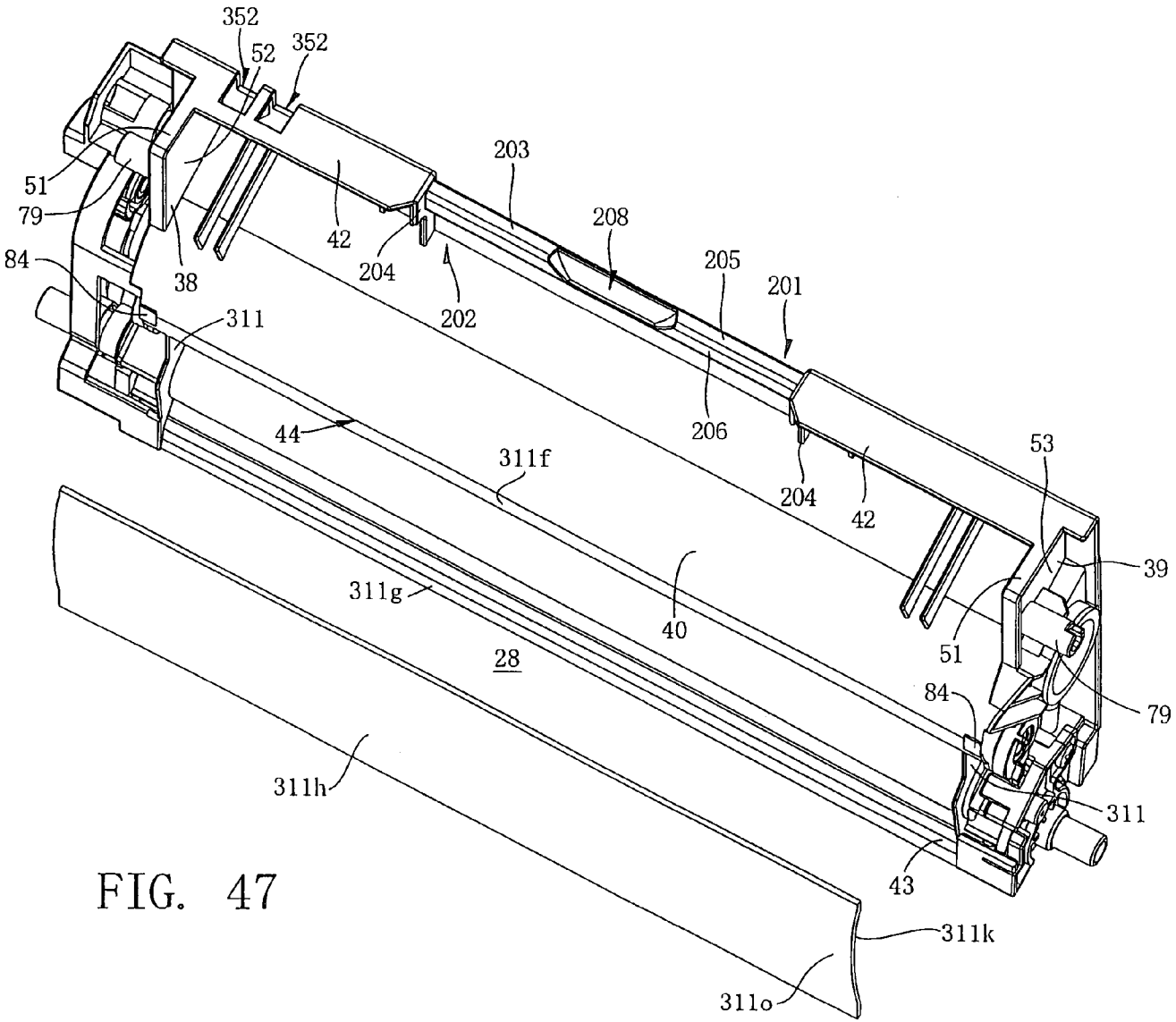
FIG. 47 is a front-bottom-right perspective view of the developer cartridge shown in FIG. 4, showing an exemplary guide in an unattached state.

In some embodiments, the guiding film 311*a* may be attached to the guide 311*e* such that both the guiding film 311*a* and the guide 311*e* are provided. In some embodiments, as shown in FIG. 47, the shape of a guide 311*h* in the length direction may not correspond to the shape of the lower wall 40. The guide 311*h* may simply extend between the adhesion areas 311*f*, 311*g* on the back portion 43 of the lower wall 40.

In the embodiments discussed above, outer surfaces 311*o* of the guiding film 311*a* and the guides 311*e*, 311*h* may be smooth and have a satin finish. Further, in order to reduce friction, the outer surfaces 311*o* may have a mirror-like finish.

Figure 49B:
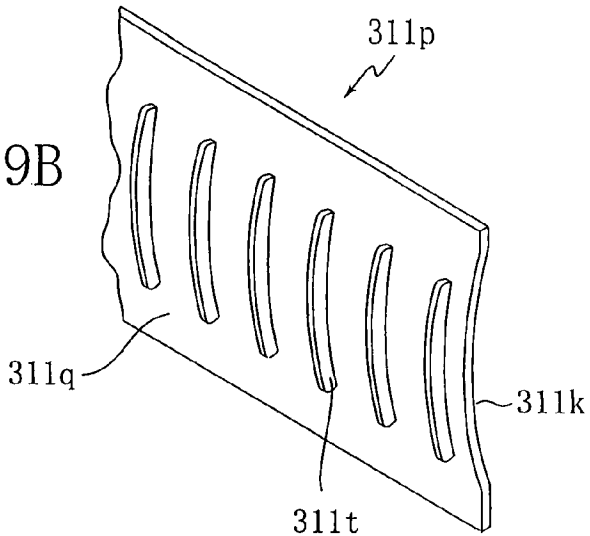
FIGS. 49(*a*)-49(*c*) are front-bottom-right perspective views of portions of exemplary guides.
Figure 49C:
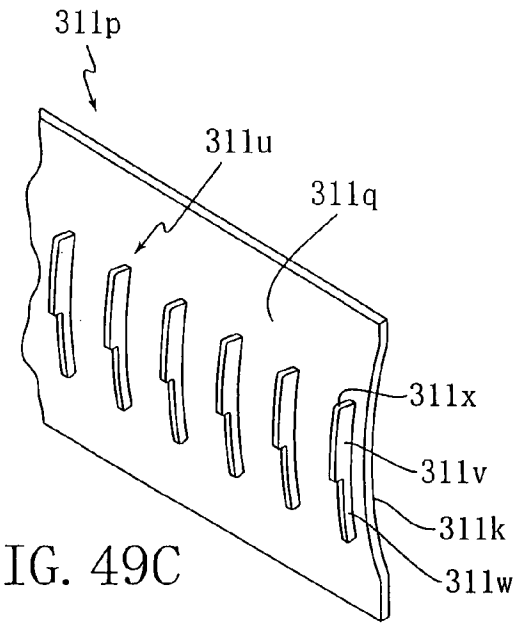
Figure 49A:
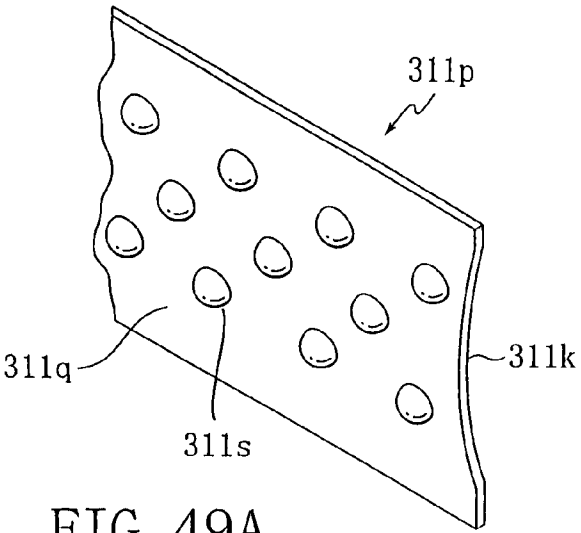

As shown in FIGS. 49(A), 49(B), and 49(C), in some embodiments, guides 311*p* may be provided with projections 311*s*, 311 *t*, 311*u* on a sheet facing surface 311*q* of the guide 311*p*. In some embodiments, as shown in FIG. 49(A), the projections 31 is may be in the form of bumps on the sheet facing surface 311*q*. In some embodiments, as shown in FIG. 49(B), the projections 311*t* may be in the form of substantially uniform ribs (i.e., the ribs have substantially the same thickness in the length direction) on the sheet facing surface 311*q*. In some embodiments, as shown in FIG. 49(C), the projections 311*u* may be in the form of ribs that have a step-like or wave-like shape, when viewed from the left or right side of the developer cartridge 28. For example, the projections 311*u* may include a first sheet contacting portion 311*v* that extends outward from the sheet facing surface 311*q* a first distance and a second sheet contacting portion 311*w* that extends outward from the sheet facing surface 311*q* a second distance, where the first distance is different than the second distance. Further, a sheet contacting end 311*x* of the first sheet contacting portions 311*v* of the projections 311*u* may extend in a first plane and a sheet contacting end 311*y* of the second sheet contacting portions 311*w* of the projections 311*u* may extend in a second plane that is different from the first plane.

In some embodiments, as discussed above, the guiding film 311*a* and the guides 311*e*, 311*h*, 311*p* may be fixed in place using double-sided adhesive tape that can be removed and/or from which the guiding film 311*a* and/or the guides 311*e*, 311*h*, 311*p* may be detached. However, as shown in FIG. 48, securing members (e.g., hooks) 311*j*, which support the guiding film 311*a* from below, but permit the guiding film 311*a* to be removed in a frontward and/or backward direction, may be used to secure the guiding film 311*a*. For example, the guiding film 311*a* and/or the guides 311*e*, 311*h*, 311*p* may be placed between the hooks 311*j* in the width direction, the hooks 311*j* being located at respective ends of the adhesion areas 311*c*, 311 *d*. In some embodiments, the guiding film 311*a* and/or the guide 3111*e*, 311*h*, 311*p*, may be secured using screws, for example.

As discussed above, the guiding film 311*a* and the guides 311*e*, 311*h*, 311*p* can be wider, the same size as, or narrower than the sheet 3. In some embodiments, the guiding film 311*a* and/or the guides 311*e*, 311*h*, 311*p* may be narrower than the maximum sized sheet 3 that can be used, as long as the portion of the back portion 43 that contacts the sheet 3 is provided with one of the guides 311*e*, 311*h*, 311*p* or the guiding film 311*a*.

Figure 50:
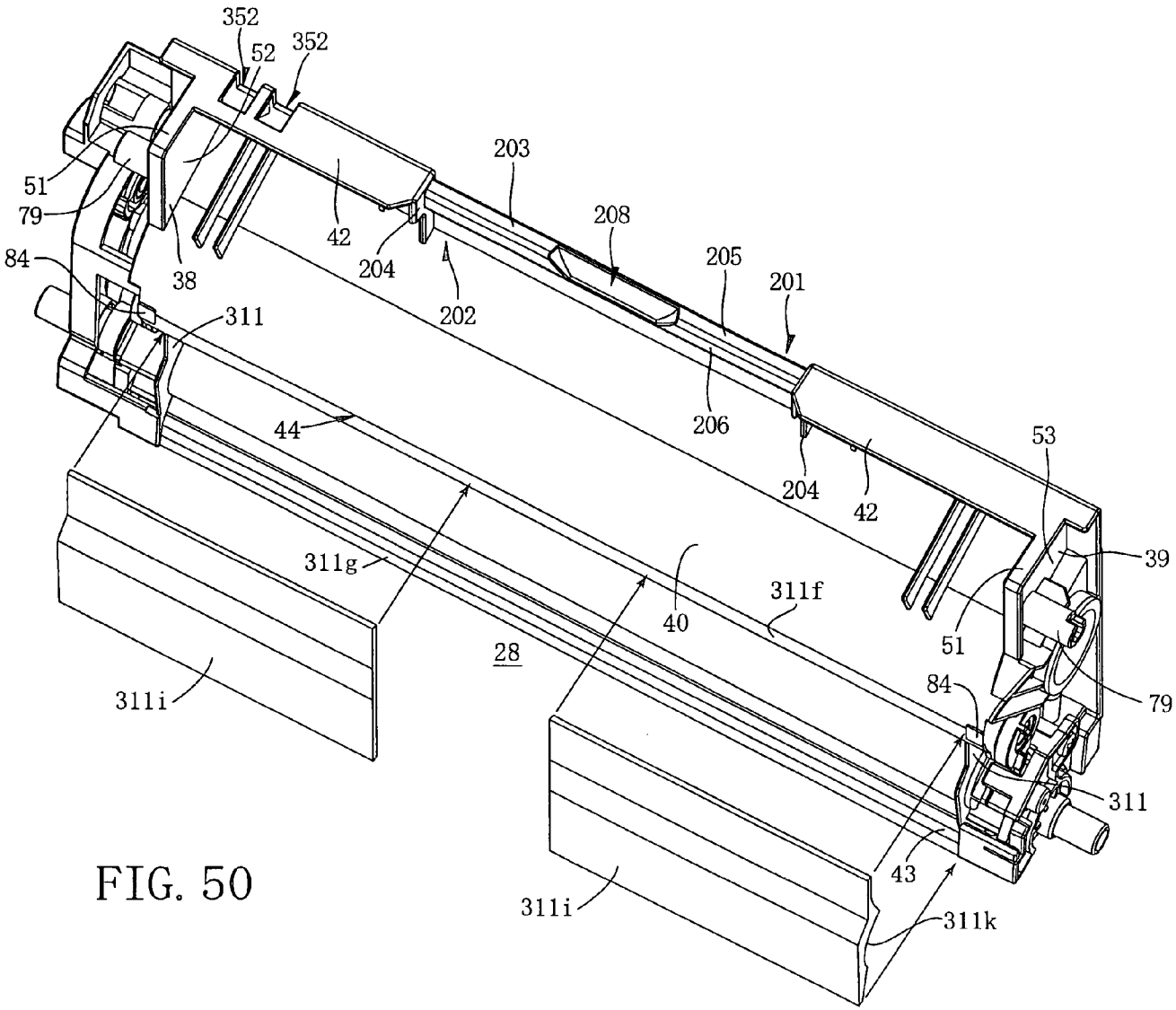
FIG. 50 is a front-bottom-right perspective view of the developer cartridge shown in FIG. 4 showing attachment of an exemplary guide to the cartridge.

As shown in FIG. 50, in some embodiments, a plurality of sub-portions (i.e., portions that are narrower than the width of the sheet 3) 311*i*, could also be arranged across the width of the developer cartridge 28, 728 so as to be parallel in the length direction with spaces provided between the portions. The sub-portions 311*i*, may include any combination of the features discussed above with regard to the guiding film 311*a* and the guides 311*e*, 311*h*, 311*p*.

In some embodiments, as discussed above, an electrically conductive plastic may be used, for example, as the material for the guiding film 311*a* and the guides 311*e*, 311*h*, 311*p* but, for example, a grounded, highly conductive metal plate could also be used.

In some embodiments, the guides may include any combination of the features described above. For example, the guiding film 311*a* and/or the guides 311*e*, 311*h*, 311*p* may include projections 311*s* in the form of bumps and projections 311*n*, 311*t*, 311*u* in the form of ribs. In various embodiments, the guides 311*e*, 311*h*, 311*p* and the guiding film 311*a* may be attached to a developer cartridge that includes ribs 311 or a developer cartridge that does not include ribs 311.

In the above description, a component is referred to as being attachable/detachable if the component can be easily attached/detached to/from another component without requiring, for example, excessive assembly or disassembly of the components in order to attach/detach the component from the other component. Thus, while a component may be referred to as being undetachable, the component may be detached if, for example, it is intentionally pried open or if screws, etc., are removed. Similarly, while a component may be referred to as being detachable, the component is meant to be easily detachable such as, for example, by simply being pulled out or being capable of being pulled out after a releasing means, for example, is engaged.

While the various aspects of the invention have been described in conjunction with exemplary embodiments outlined above, many alternatives, modifications and variations will be apparent to those skilled in the art. Accordingly, the exemplary embodiments as set forth above, are intended to be illustrative and not limiting. Various changes may be made without departing from the spirit and scope of the various aspects of the invention.

What is claimed is:

1. A developer cartridge that is attachable to and detachable from a photosensitive drum cartridge, the developer cartridge comprising:

a frame including a first side wall and a second side wall, the first side wall and the second side wall extending substantially in a length direction;

a developer housing section for housing a developer, the developer housing section extending from the first side wall to the second side wall in a width direction perpendicular to the length direction;

a developer supplying section for supplying the developer to a photosensitive member, the developer supplying section extending from the first side wall to the second side wall in the width direction; and a guide member provided over an outer surface of the developer supplying section, the guide member being detachable from the developer supplying section;

wherein the developer supplying section is formed from a first material, the guide member is formed from a second material, and the first material is different from the second material.

2. The developer cartridge of claim 1, wherein the second material has a greater hardness than the first material.

3. The developer cartridge of claim 1, wherein the second material is polyacetal.

4. The developer cartridge of claim 1, wherein the second material is a highly conductive metal.

5. The developer cartridge of claim 1, wherein the first material has a different electrical conductivity than the second material.

6. The developer cartridge of claim 5, wherein the first material is less electrically conductive than the second material.

7. The developer cartridge of claim 1, wherein the outer surface of the developer supplying section is provided with a plurality of ribs extending away from the outer surface.

8. The developer cartridge of claim 7, wherein each of the plurality of ribs extends substantially in the length direction and is aligned substantially parallel to a remainder of the plurality of ribs.

9. The developer cartridge of claim 7, wherein the developer supplying section houses a developer member that extends in the width direction and is rotatably supported by the first side wall and the second side wall.

10. The developer cartridge of claim 9, wherein the developer member has a first width, the guide member has a second width and the first width and the second width are substantially the same.

11. The developer cartridge of claim 9, wherein the guide member comprises a plurality of separate guide member sections arrayed along the developer supplying section in the width direction.

12. The developer cartridge of claim 1, wherein a first surface of the guide member opposite a second surface facing the developer supplying section is provided with a plurality of projecting members.

13. The developer cartridge of claim 1, wherein at least one double-sided adhesive strip is provided on the outer surface of the developer supplying section for adhering the guide member to the outer surface.

14. The developer cartridge of claim 1, wherein the guide member has at least one of a stepped or wavy cross-sectional shape in the length direction.

15. The developer cartridge of claim 1, further comprising at least one hook provided on the outer surface of the developer supplying section, the hook being configured to hold the guide member in communication with the outer surface.

16. A developer cartridge for use in an image forming device, the developer cartridge being attachable to and detachable from a photosensitive drum cartridge, the developer cartridge comprising:

a frame defining at least a developer supplying section and a developer housing section; and a guide member attached to an outer surface of the frame at a location on the frame where a recording sheet is conveyed in contact with the developer cartridge during printing, the guide member being detachable from the frame;

wherein the frame is formed from a first material, the guide member is formed from a second material, and the first material is different from the second material.

17. The developer cartridge of claim 16, wherein the second material has a greater hardness than the first material.

18. The developer cartridge of claim 17, wherein the first material has a different electrical conductivity than the second material.

19. The developer cartridge of claims 16, wherein the guide member is provided with a plurality of projecting ribs projecting from an outer surface of the guide member.

20. The developer cartridge of claim 19, wherein each of the plurality of projecting ribs has a first end and a second end, the first end projecting a first distance away from the outer surface of the guide member and the second end projecting a second distance away from the outer surface of the guide member;

wherein the first distance is different from the second distance.

21. A process cartridge for use with an image forming device, the process cartridge comprising:

a first frame that defines at least a developer housing section and a developer supplying section;

a second frame that defines at least a photosensitive member housing section and a developer cartridge receiving section; and a guide member attached to an outer surface of the first frame at a location on the first frame where a recording sheet is conveyed in contact with the process cartridge during printing;

wherein:

the guide member is detachable from the first frame, the first frame is formed from a first material, the guide member is formed from a second material, and the first material is different from the second material, and when the guide member is detachably attached to the first frame, the guide member faces a portion of the developer cartridge receiving section of the second frame.

22. The process cartridge of claim 21, wherein the second material has a greater hardness than the first material.

23. The process cartridge of claim 21, wherein the first material has a different electrical conductivity than the second material.

24. A recording medium guiding member for attachment to a developer cartridge that is attachable to and detachable from a photosensitive drum cartridge useable in an image forming device, the guiding member comprising:

a first surface for attachment to an outer surface of the developer cartridge, the first surface extending from a first end of the guiding member to a second end of the guiding member; and a second surface for guiding a recording medium during printing, the second surface extending from the first end to the second end;

wherein:

the first surface is substantially opposite from the second surface;

the guiding member is provided with a plurality of projecting members extending away from at least one of the first surface or the second surface; and the guiding member has at least one of a stepped or a wavy cross-sectional shape in a cross-section including the first surface, the second surface, the first end and the second end.

* * * * *